US005997198A

United States Patent [19]

Murayama et al.

[11] Patent Number: 5,997,198

[45] Date of Patent: Dec. 7, 1999

[54] SHEET FEEDER AND PRINTER

[75] Inventors: Susumu Murayama; Atsushi Nishizawa; Masaki Shimomura; Narihiro Oki; Tsuyoshi Tomii; Toshikazu Kotaka, all of Nagano, Japan

[73] Assignee: Seiko Epson Corporation, Tokyo, Japan

[21] Appl. No.: 08/956,034

[22] Filed: Oct. 22, 1997

[30] Foreign Application Priority Data

| | | | |
|---|---|---|---|
| Oct. 22, 1996 | [JP] | Japan | 8-298043 |
| Oct. 31, 1996 | [JP] | Japan | 8-305813 |
| Nov. 22, 1996 | [JP] | Japan | 8-327575 |

[51] Int. Cl.[6] ..... B41J 13/00

[52] U.S. Cl. ..... 400/624; 271/121; 271/114

[58] Field of Search ..... 400/624, 625, 400/629; 271/114, 117, 119, 120, 121, 122, 167, 225, 244, 245, 145, 124

[56] References Cited

U.S. PATENT DOCUMENTS

| | | | |
|---|---|---|---|
| 4,529,188 | 7/1985 | Sturnick | 271/114 |
| 4,579,328 | 4/1986 | Hagihara et al. | 271/119 |
| 5,253,854 | 10/1993 | Tanoue et al. | 271/121 |
| 5,316,285 | 5/1994 | Olson et al. | 271/122 |
| 5,320,337 | 6/1994 | Itoh et al. | 271/124 |
| 5,372,359 | 12/1994 | Miura et al. | 271/119 |
| 5,584,475 | 12/1996 | Asada et al. | 271/121 |
| 5,725,208 | 3/1998 | Miyauchi | 271/121 |

FOREIGN PATENT DOCUMENTS

| | | |
|---|---|---|
| 624535 | 11/1994 | European Pat. Off. . |
| 845429 | 6/1998 | European Pat. Off. . |
| 7-53062 | 2/1995 | Japan . |
| 8-3396 | 1/1996 | Japan . |

OTHER PUBLICATIONS

Patent Abstracts of Japan, vol. 014, No. 575 (M–1062), Dec. 20, 1990.

Patent Abstracts of Japan, vol. 012, No. 437 (M–765, Nov. 17, 1998.

*Primary Examiner*—Christopher A. Bennett

*Attorney, Agent, or Firm*—Sughrue, Mion, Zinn, Macpeak & Seas, PLLC

[57] ABSTRACT

A sheet feeder, or a printer incorporating the sheet feeder, has separation pads for separating a sheet to be fed by sheet feed rollers from the next sheet and a roller spring which produce urging force smaller than that produced by a spring of the separation pad. Idle rollers are brought into contact with the separation pads by means of the roller spring, thereby preventing the lowering of the next sheet. A sheet reset lever is pivoted so as to return the next sheet to a hopper. As a result, the sheet sheets stacked on the hopper in an inclined state is fed one by one through use of a separation pad method without increasing force for driving rollers and a back tension.

29 Claims, 36 Drawing Sheets

SHEET FEEDER AND PRINTER

BACKGROUND OF THE INVENTION

1. Field of the Invention

The present invention relates to a sheet feeder primarily suitable for use with a printer which feeds stacked sheet (plain sheet, coated sheet, sheet used for an OHP (Over-head Projector), glossy sheet, separated sheets such as glossy films, or envelopes) from the top one by one. Further, the present invention relates to a printer which produces a print by feeding sheets of sheet one by one, and more particularly, to the technique of feeding and conveying sheet.

2. Related Art

A feeder provided in a printer is generally known to be classified into a pawl-separation type and a pad-separation type.

As is publicly known, the pawl-separation type sheet feeder comprises pawls which are engaged with the front corners of stacked sheet and a sheet feed roller provided behind the pawls (i.e., in a downstream direction with reference to the direction in which the sheet is fed). The sheet feed roller is rotated so as to deflect the uppermost sheet of the sheet in a position between the sheet feed roller and the pawls. When the deflection of the sheet reaches a predetermined maximum value, the sheet is flipped to thereby separate the uppermost sheet from the next sheet. As a result, only the uppermost sheet is fed.

In contrast, as is also publicly known, the pad-separation type sheet feeder comprises a sheet feed roller and a separation pad. Taking a coefficient of friction between the sheet feed roller and sheet as $\mu 1$, a coefficient of friction between the separation pad and sheet as $\mu 2$, and a coefficient of friction between sheets of sheet as $\mu 3$, the sheet roller and the separation pad are arranged so as to satisfy the relationship of $\mu 1 > \mu 2 > \mu 3$. Sheet is nipped between the rotatable sheet feed roller and the separation pad to be brought into pressed contact with the sheet feed roller, thereby separating the uppermost sheet from the next sheet. As a result, only the uppermost sheet is fed.

In either case, when the rotatable roller comes into contact with the surface of the uppermost sheet and the uppermost sheet is fed, the reverse side of the roller-contacted portion of the uppermost sheet makes slidable contact with the surface of the next sheet. The surface of the next sheet is slightly flawed by the sliding action of the uppermost sheet. If the sheet is, e.g., glossy sheet or a glossy film, the thus-produced flaws become noticeable.

For the case of the pawl-separation type sheet feeder, the portion of the uppermost sheet behind the pawls, i.e., the portion of the uppermost sheet to be deflected (in other words, the flawed protion), is positioned behind sufficient to be deflected, thereby impairing a print area of the sheet.

In contrast, for the case of the pad-separation type sheet feeder, although the front edge of the surface of only the sheet is flawed, the print area is not usually flawed.

Accordingly, the pad-separation type sheet feeder is superior from the viewpoint of the degree of flaw.

However, the pad-separation type sheet feeder has the following difficulties.

For example, as shown in FIG. 34, in a case where a pad-separation type sheet feeder 1 is applied to a printer, supplied sheet P1 is conveyed while being nipped between conveyor rollers 2, 3, and printing means 4 produces a print on the sheet P1. Usually, the sheet P1 still remains in the sheet feeder at a point in time when the conveyor rollers 2, 3 commence conveying the sheet P1.

In contrast, for the case of the pad-separation type sheet feeder, taking the frictional force acting between the sheet feed roller and sheet as f1. the frictional force acting between sheet and the separation pad as f2, and the the separation pad must be brought into pressed contact with each other in such a way as to satisfy the foregoing relationship of $\mu 1 > \mu 2 > \mu 3$, i.e., f1>f2>f3. If the sheet feed roller is held in pressed contact with the separation pad at a point in time when the conveyor rollers 2, 3 commence conveying the sheet P1, a rear portion of the sheet P1 is nipped between the sheet feed roller and the separation pad.

Consequently, the sheet P1 is conveyed by the conveyor rollers 2, 3 while it still remains under the load applied by the nipping section (or still being held in a rearwardly-withdrawn state or under a back-tension state) until the rear edge of the sheet P1 passes through the nipping section between the sheet feed roller and the separation pad.

If such a load (or a back tension) is great, the accuracy of sheet-feeding action of the conveyor rollers 2, 4 becomes lower, thereby resulting in a reduction in print quality. For this reason, it is desirable to reduce the load, or the nipping force exerted on the sheet feed roller and the separation pad, to load as small as possible. However, if the nipping force exerted on the sheet feed roller and the separation pad is too small, the next sheet gradually burrows into the nipping section between the sheet feed roller and the separation pad every time the sheet feed operation is repeated, thereby rendering the separation of sheet impossible.

A sheet medium alignment mechanism disclosed in Japanese Patent Application Laid-open No. Hei-7-53062 is intended to solve the foregoing problem.

FIGS. 35A to 35E show the construction and operation of this sheet medium alignment mechanism.

In these drawings, reference numeral 18 designates sheet feed rollers; 24 designates a separation pad; and 22 designates a lever.

As shown in FIG. 35C, the lever 22 is supported by a pivot A in a pivotable manner and is forced clockwise by a cantilever spring 26 which presses an arm 22*c* of the lever 22.

With this mechanism, as shown in FIGS. 35B to 35E, the uppermost sheet S1 is separated from the next sheet S2 by a nipping section formed between sheet feed rollers 18 and a separation pad 24 as a result of rotation of the sheet feed rollers 18 in a clockwise direction. As shown in FIG. 35D, only the uppermost sheet S1 is supplied. At this time, as shown in FIGS. 35C and 35D, the lever 22 is pressed to a receded position by the sheet S1. Even if the second sheet S2 (and a sheet S3 after the sheet S2) burrows into or attempts to burrow into the nipping section between the sheet feed rollers 18 and the separation pad 24, the lever 22 is pivoted clockwise by the urging force of the cantilever spring 26 immediately after the passage of the rear edge of the sheet S1 through the upper edge of the lever 22. As shown in FIG. 35E, the next sheet S2 (and the sheet S3 after the sheet S2) is forcibly reset to their original positions.

Accordingly, this mechanism seemingly solves the difficulty of separation of sheets owing to the gradual entry of the next sheet into the nipping section between the sheet feed rollers and the separation pad. However, this mechanism suffers from another problem which will be described later (see Problem 1).

If the sheet feed rollers 18 are rod-shaped, the roller is constantly held in pressed contact with the separation pad. Therefore, the sheet feed rollers and the separation pad are susceptible to abrasion.

There is a known sheet feeder which solves this problem, i.e., the abrasion of the sheet feed rollers and the separation pad, and comprises sheet feed rollers each of which has a substantially D-shaped lateral cross section.

FIG. 36 shows a sheet feeder disclosed in Japanese Utility Model Publication No. Hei-8-3396 as one example of the sheet feeder of this type. In the drawing, reference numeral 40 designates sheet feed rollers each of which has a substantially D-shaped lateral cross section and comprises a circular-arch portion 40a and a linear portion 40*b*.

Reference numeral 41 designates a guide block which supports a shaft 40*c* of the sheet feed rollers 40.

Reference numeral 42 designates a cassette and incorporates a sheet mounting plate 42*a* therein. A plurality of sheets of sheet P are loaded on the sheet mounting plate 42*a* in a stacked manner. Reference numeral 42*c* designates a spring which forces the sheet P toward the sheet roller 40.

Reference numeral 43 designates a separation pad and is attached to a bracket 48*a*. The separation pad 43 is on the course of rotation of the circular-arch portion 40*a* of the sheet feed rollers 40 and is pushed by a spring 44 along a guide 45 toward the sheet feed roller shaft 40*c*.

Reference numeral 46 designates an idle roller which is attached to the guide block 41 in a rotatable manner; and 47 designates a movable idle roller whose shaft 47*a* is fitted, in a rotatable manner, into an elongated groove 41*a* formed in the guide block 41. The movable idle roller 47 is forced toward the separation pad 43 by means of a spring 48 and is in contact with the separation pad 43.

Urging force F2 of the spring 48 is set to become smaller than urging force F1 of the spring 44 of the separation pad 43 (i.e., to satisfy a relationship of F1>F2).

The sheet feeder having the foregoing construction operates in the following manner:

As shown in FIG. 36, when the sheet feeder is in a standby condition, the linear portion 40*b* of the sheet feed roller 40 is opposite to sheet P, and the sheet feed rollers 40 are kept from contact with the sheet P. Further, since the urging force F2 of the spring 48 of the movable idle roller 47 is set to become smaller than the urging force F1 of the spring 44 of the separation pad. 43, the movable idle roller 47 is pushed in an upward direction by the separation pad 43. As a result, the shaft 47*a* of the movable idle roller 7 is held in contact with the upper edge of the elongated groove 41*a*.

At the time of sheet feed operation, the sheet feed rollers 40 rotate in the direction designated by the arrow, and the circular-arch portion 40*a* comes into contact with the uppermost sheet P1 of the sheet P, whereby the sheet P1 is fed to the separation pad 43. At this time, the second sheet P2 is electrostatically attached to the sheet P1, or frictional force acts between the sheets P1 and P2, and the sheet P2 is sometimes fed together with the sheet P1.

However, the sheet P2 is separated from the sheet P1 by the separation pad 43 in the following manner, whereby only the uppermost sheet P1 is fed.

More specifically, the front edge of the sheet P2 collides with the separation pad 43 and is prevented from advancing. As a result, the sheet P2 is temporarily separated from the sheet P1.

Taking, the frictional force exerted between the circular-arch portion 40*a* of the sheet feed roller 40 and the sheet P1 as f1, the frictional force exerted between the sheet P2 and the separation pad 48 as f2, and the frictional force exerted between the sheets P1 and P2 as f3, the sheet feed rollers 40 and the separation pad 43 are arranged so as to satisfy the relation ship of f1>f2>f3. Therefore, even if both the sheets P1 and P2 are nipped between the circular-arch portion 40*a* of the sheet feed roller 40 and the separation pad 43 with the rotation of the sheet feed rollers 40, the sheet P2 is hindered from advancing by the frictional force exerted between the sheet P2 and the separation pad 43. As a result, the sheet P2 is separated from the sheet P1, and only the sheet P1 is fed. Since the separation pad 43 is on the course of rotation of the circular-arch portion 40*a* of the sheet feed roller 40, the separation pad 43 is pushed downward by the circular-arch portion 40*a* as a result of its rotation. However, since the movable idle roller 47 is forced toward the separation pad 43 by the spring 48, the separation pad 43 comes into contact with the movable idle roller upon depression, thereby resulting in the separation of the sheets.

The sheet feed rollers 40 perform exactly one rotation, and the sheet feeder returns to the standby condition (the state of the sheet feeder shown in FIG. 36).

Through the foregoing operations, only the uppermost sheet P1 is fed.

With such a sheet feeder, the sheet feed rollers 40 are prevented from being constantly held in pressed contact with the separation pad 43, and consequently the degree of abrasion of the sheet feed rollers and the separation pad is reduced.

Further, since the movable idle roller 47 is kept in pressed contact with the separation pad 43 by means of the spring 48, the next sheet is prevented from entering the nipping section together with the uppermost sheet to a certain extent.

<Problem 1>

In the mechanism shown in FIG. 35, since the lever 22 is pivoted by the urging force of the spring 26 when the next sheet P2 is reset. If the urging force of the spring 26 is small, a risk arises of failure to ensure reliable resetting of the next sheet P2. If the urging force of the spring 26 is increased, the next sheet S2 may be forcibly reset in a reliable manner. However, as shown in FIGS. 35C and 35D, the lever 22 must be pushed to the receded position by the sheet S1 at the time of feeding of the uppermost sheet S1. For this reason, an increase in the urging force of the spring 26 is not desirable. In order to set the lever 22 in such a way as to be pushed to the receded position by the uppermost sheet S1 in the case of the urging force of the spring 26 being increased, a force for feeding of the sheet S1, i.e., the nipping force exerted between the sheet feed rollers 18 and the separation pad 24, must be increased. In this case, the aforementioned original objective of reducing a load (or a back tension) cannot be achieved.

In order to reduce the load (or the back tension) by means of the foregoing existing mechanism, the urging force of the spring 26 must be reduced. If the urging force of the spring 26 is reduced, a risk arises of unreliable resetting of the next sheet S2.

<Problem 2>

In order to enable the previously-described sheet feeder; e.g., sheet feeder shown in FIG. 36, to appropriately feed various types of differently-sized sheet, or sheet having different widths, it is desirable to provide the sheet feeder with a pair of sheet feed rollers 40 and to make at least one of them slidable in accordance with the width of sheet.

Further, in order to enable sheet P to be readily loaded on the sheet mounting plate 42*a* while the sheet feeder is in a non-sheet-feeding state (or a standby condition), the sheet mounting plate 42 is preferably arranged so as to be separated from the sheet feed rollers 40 against the urging force of the spring 42*c* (or the sheet mounting plate 42 is moved downward) when the sheet feeder is in a non-sheet-feeding state.

With the foregoing arrangement, the sheet feeder shown in FIG. 36 presents the following problems.

For example, in a case where sheet having a comparatively wide width (e.g., A4-size sheet) is loaded on the sheet mounting plate 42*a* and sheet having a comparatively narrow width (e.g., B5-size sheet) is loaded in place of the A4-size sheet, the user sets the interval between the pair of sheet feed rollers to a narrow width in accordance with the width of the sheet in advance and loads sheet on the sheet mounting plate. There may be another case where sheet is initially loaded on the sheet mounting plate and the interval between the sheet feed rollers is adjusted to the width of the sheet.

In the case where the user loads sheet on the sheet mounting plate at the outset, the sheet mounting plate 42*a* still remains in the position separated from the sheet feed rollers 40 at the time of loading of sheet, as previously described. Because of this, the front edge portion of the top sheets (e.g., the sheets P1 and P2) of the loaded sheet P burrows into a clearance C formed between the sheet feed rollers 40 and the separation pad 43, as viewed in the axial direction of the sheet feed roller 40.

If an attempt is made to slide one of the sheet feed rollers 40 in accordance with the width of sheet, the front edge portion of the sheet burrowed into the clearance C comes into contact with the side surface of the sheet feed roller 40 or the side surface of the idle roller 47, or the like, thereby inhibiting smooth sliding action of the sheet feed roller 40. As a result, the sheet feed rollers 40 fail to slide to an optimum position. If the sheet feed rollers 40 are slid forcibly, the front edge portion of the sheet burrowed into the clearance C is nipped between the pair of sheet feed rollers 40 or by the idle roller 47, or the like, thereby rendering the sheet concertinated.

If the sheet is fed in while remaining in the concertinated state, sheet jams will occur, or the sheet will be fed diagonally.

Even if the mechanism shown in FIG. 35 is constructed so as to have the foregoing arrangement, i.e., a pair of sheet feed rollers at least one of which is slidable in accordance with the width of sheet and a sheet mounting plate which is separated from the sheet feed rollers when the sheet feeder is in a non-sheet-feeding state (or a standby condition), the previously-described problems seem not to arise, because the lever 22 is positioned so as to close the clearance formed between the sheet feed roller 18 and the separation pad 24.

However, in practice, another similar problem arises for the following reasons.

As is evident from FIG. 35E, the mechanism shown in FIG. 35 does not have any means for preventing the pivotal movement of the lever 22 in a counterclockwise direction (in a forward direction) in the drawings when the sheet feeder is in a non-sheet-feeding state.

The lever 22 is forced solely by means of the spring 26. Therefore, if sheet is loaded by a force that is sufficient to overcome the urging force of the spring 26, a risk arises of the front edge portion of the uppermost sheet burrowing into the clearance between the sheet feed roller 18 and the separation pad 24 while pivoting the lever 22, thereby imposing a problem analogous to the foregoing problems.

More specifically, if an attempt is made to construct the existing sheet feeder or sheet feeding mechanism in such a way as to enable at least one of a pair of sheet feed rollers to slide in accordance with the width of sheet and to separate the sheet mounting plate from the sheet feed rollers, a risk arises of the front edge portion of the sheet being loaded on the plate burrowing into the clearance formed between the sheet feed rollers and the separation pad when viewed in the axial direction of the sheet feed roller. For these reasons, sheet jams arise, or sheet is fed diagonally.

<Problem 3>

The previously described separation pad type sheet feeder is generally designed in such a way that the sheet is retained in a substantially horizontal state. For example, even in the case of the sheet feeders shown in FIGS. 35 and 36, the sheet is retained in a substantially horizontal state.

For this reason, the existing separation pad type sheet feeder requires a large footprint.

The problem can be solved by arranging the sheet feeder in such a way as to retain sheet in an inclined state. For example, if the sheet feeder is designed so as to retain the sheet at an angle of 45°, the footprint occupied by the sheet is reduced to half its original area.

However, it has been difficult to construct the separation pad type sheet feeder in such a way as to retain sheet in an inclined state.

For example, as is evident from the assumption that sheet would be retained in an inclined state (e.g. the sheet is inclined at about 45°) in the sheet feeder shown in FIG. 35, it is possible that the sheet will slide under its own weight if the sheet is retained in an inclined state. As a result, the next sheet (S2), the sheet after the next (S3), or the like, cause an avalanche, thereby rendering the sheet considerably easy to burrow into the nipping section between the sheet feed rollers 18 and the separation pad 24. Particularly for the case of slippery sheet, e.g., sheets for OHP purposes, the sheet is apt to cause an avalanche, thereby rendering the sheet considerably easy to burrow into the nipping section between the sheet feed rollers 18 and the separation pad 24.

For these reasons, even if the lever 22 shown in FIG. 35 is provided for the sheet feeder, a risk may arise of the front edge of the next sheet (S2) having already passed through the front end of the lever 22 when the rear edge of the uppermost sheet (S1) passes the front end of the lever 22. As a result, a risk may arise of reliable separation of sheets becoming impossible.

Even if the sheet feeder shown in FIG. 36 is arranged so as to retain sheet in an inclined state, the next sheet or the sheet after the next may cause an avalanche in an analogous manner. Thereby rendering the sheet considerably easy to burrow into the nipping section between the sheet feed rollers 40 and the separation pad 43. Consequently, the next sheet gradually (or cumulatively) burrows into the nipping section between the sheet feed rollers and the separation pad every time the sheet feeding operation is performed, thereby rendering the separation of the sheet impossible.

It is conceivable that such a problem can be solved by considerably increasing the nipping force exerted on the sheet feed rollers 18 and the separation pad 24 (or the nipping force exerted on the sheet feed rollers 40 and the separation pad 43 and the nipping force exerted on the elastic idle roller 47 and the separation pad 43 in the sheet feeder shown in FIG. 36).

However, if the nipping force is increased, the drive force exerted on the sheet feed rollers must also be increased. Since the previously-described load (or back tension) which is applied to the sheet by the conveyor rollers 2, 3 is considerably increased, the nipping force applied to the sheet by the conveyor rollers 2, 3 must be increased so as to ensure a feed force which is sufficient to overcome the load. Accordingly, a large drive force to drive the conveyor rollers, or the like, is also required, thereby rendering the sheet feeder bulky or resulting in an increase in power consumption. Further, the sheet rollers or the conveyor rollers become more susceptible to abrasion.

In short, it has been impossible to retain sheet in an inclined state and to feed the sheets of sheet one by one without increasing the drive force of various rollers or the back tension even by means of the technique shown in FIG. 35 and the technique shown in FIG. 36.

<Problem 4>

In the event of a plurality of sheets concurrently burrowing into the clearance between the sheet feed rollers and the separation pad or the clearance between the idle roller and the separation pad as a result of occurrence of an avalanche in any one of the previously-described existing sheet feeders, the sheets are integrated into the form of a wedge, thereby resulting in a risk of the uppermost sheet being locked during the course of sheet feeding operation.

SUMMARY OF THE INVENTION

A first object of the present invention is to provide a sheet feeder capable of solving the problem 1 and reliably feeding sheets of sheet one by one by thoroughly resetting the next sheet to its original position forcibly without increasing the load exerted on the sheet through use of a separation pad method.

A second object of the present invention is to provide a sheet feeder which solves the problem 2 and comprises a pair of sheet feed rollers, at least one of which is arranged so as to be slidable in accordance with the width of sheet, and prevents sheet jams or diagonal feeding of the sheet even if a hopper is separated from the sheet feed rollers when the sheet feeder is in a non-sheet-feeding state (or a standby condition).

A third object of the present invention is to provide a sheet feeder capable of solving the problem 3 and reliably feeding one by one the stacked sheet retained in an inclined state without increasing the drive force required for the rollers and a back tension (or a load) through use of a separation pad method.

A fourth object of the present invention is to provide a printer capable of solving the problems 3 and 4 at one time and of reliably feeding the stacked sheet retained in an inclined state without increasing the drive force required for the rollers and the load through use of a separation pad method.

To accomplish the first object, in accordance with a first aspect of the present invention, there is provided a sheet feeder comprising sheet feed rollers which forwardly rotate at the time of sheet feeding operation and feed the uppermost sheet of sheet retained in a stacked state on contact with it; separation pads which are forced toward the sheet feed rollers and separate the uppermost sheet to be sent by the sheet feed rollers from the second sheet by nipping the uppermost sheet between the sheet feed rollers and the separation pads; and a sheet reset lever which is rearwardly pivoted so as to forcibly reset the next sheet in a rearward direction in such a way that the front edge of the next sheet is placed in a location in a rearward direction in relation to the area where the sheet feed rollers come into contact with the separation pads, after the passage of the rear edge of the uppermost sheet fed by the sheet feed rollers, wherein the sheet reset lever is rearwardly pivoted as a result of reverse rotation of the sheet feed rollers. Preferably, the sheet feed rollers are designed so as to be temporarily rotated reversely before being forwardly rotated, thereby rearwardly pivoting the sheet reset lever. The present invention is also effective for a case where the sheet retained in a stacked state is held in an inclined state so as to be able to slide toward an area where the sheet feed rollers are in contact with the separation pad.

To accomplish the second object, in accordance with a second aspect of the present invention, there is provided a sheet feeder comprising a pair of sheet feed rollers which forwardly rotate at the time of sheet feeding operation and feed a sheet on contact with both side portions of the sheet; a hopper which holds in a stacked manner a plurality of sheets of sheet to be fed on contact with the circumferential surface of each of the sheet feed rollers, which hopper brings a sheet into pressed contact with the sheet feed rollers when the sheet feed rollers forwardly rotate, and which hopper is separated from the sheet feed rollers at least at the time of non-sheet-feeding operation; separation pads for separating the sheet to be fed by the sheet feed rollers from the next sheet by nipping the sheet between the circumferential surfaces of the sheet feed rollers and the separation pads; a sheet reset lever which is rearwardly pivoted so as to forcibly reset the next sheet in a rearward direction in such a way that the front edge of the next sheet is placed in a position in a rearward direction in relation to the area where the circumferential surface of each of the sheet feed rollers comes into contact with the separation pad or the area where they are to come into contact with each other, after the passage of the rear edge of the uppermost sheet fed by the sheet feed rollers; at least one of the pair of sheet feed rollers being slidable in accordance with the width of the sheet; and pivotal-movement prevention means which places the sheet reset lever in a location where the clearance between the sheet feed rollers and the separation pads, as viewed in the axial direction of the sheet feed rollers, is closed, and which pivotal movement prevention means prevents the forward pivotal movement of the sheet reset lever. Preferably, each of the sheet feed rollers comprises a circular-arch portion and a linear portion and has a substantially D-shaped lateral cross section. Preferably, each of the separation pads is opposite to the linear portion of the sheet feed roller and maintains the clearance between the sheet feed roller and the separation pad at the time of non-separation operation, and idle rollers are preferably provided outside the pair of sheet feed rollers and come into contact with the separation pads. Preferably, the hopper supports the sheet in an inclined state toward the clearance, and the sheet reset lever is actuated by means of operation members which are pivoted together with the sheet drive rollers and constitute the pivotal-movement prevention means. Preferably, the sheet feeder further includes a separation mechanism which separates the separation pads from the idle rollers when the sheet reset lever is rearwardly pivoted so as to forcibly reset the next sheet in a rearward direction. Preferably, the hopper separates the sheet stacked on the hopper from the sheet feed rollers when the sheet reset lever is rearwardly pivoted, and a support surface for supporting the front edge of the sheet stacked on the hopper is provided at the front end of the hopper in the sheet-feeding direction. More preferably, the sheet reset lever forcibly resets the next sheet in such a way that the front edge of the next sheet reaches a position behind the support surface, and this position behind the support surface is preferably a location where the clearance between the sheet feed rollers and the separation pads is closed. Preferably, the sheet feeder further comprises a forcing member for forcing the sheet stacked on the hopper toward the support surface of the hopper. Preferably, the sheet feeder further comprises an idle roller retraction mechanism which separates the idle rollers from the separation pads when the front edge of the sheet to be fed passes through the clearance between the separation pads and the idle rollers, and which mechanism brings the idle rollers into contact with the separation pads after the front edge of the sheet has passed through the clearance while the circular-arch portions of the sheet feed rollers still remain in contact with the separation pads with the sheet between them. Preferably, the idle roller retraction mechanism is actuated by means of came which are fitted around the shafts of the sheet feed rollers and rotate together with these shafts.

To accomplish the third object, in accordance with a third aspect of the present invention, there is provided a sheet feeder comprising sheet feed rollers, each of which has a circular-arch portion, a linear portion, and a substantially D-shaped lateral cross section and performs one forward rotation at the time of sheet feeding operation; a hopper which holds in a stacked manner a plurality of sheets to be fed on contact with the circular-arch portions of the sheet feed rollers, and which hopper brings a sheet into pressed contact with the sheet feed rollers when the sheet feed rollers forwardly rotate; separation pads, each of which is on the course of rotation of the circular-arch portion of each sheet feed roller and forced toward the corresponding sheet feed roller by means of pad forcing means, and which separation pad separates the sheet to be fed by the sheet feed rollers from the next sheet by nipping the sheet between the circular-arch portions and the separation pads; idle rollers which are forced toward the separation pads by means of roller forcing means for producing urging force smaller than that produced by the pad forcing means, and which idle rollers come into contact with the separation pads so as to prevent the lowering of the next sheet at least when the sheet is not nipped between the separation pads and the circular-arch portions of the sheet feed rollers; pad regulation means which differ from the idle rollers and regulate the movement of the separation pads toward the sheet feed rollers when the sheet is not nipped between the separation pads and the circular-arch portions of the sheet feed rollers; and a sheet reset lever which is rearwardly pivoted so as to forcibly reset the next sheet in a rearward direction in such a way that the front edge of the next sheet is placed in a position in relation to the area where the sheet feed rollers come into contact with the separation pads, after the passage of the rear edge of the uppermost sheet fed by the sheet feed rollers. Preferably, the sheet feeder further comprises a separation mechanism for separating the separation pads from the idle rollers when the sheet reset lever is rearwardly pivoted so as to forcibly reset the next sheet in a rearward direction. Preferably, the hopper separates the sheet stacked on the hopper from the sheet feed rollers when the sheet reset lever is rearwardly pivoted, and a support surface for supporting the front edge of the sheet stacked on the hopper is provided at the front end of the hopper in the sheet-feeding direction. Preferably, the sheet reset lever forcibly resets the next sheet in such a way that the front edge of the next sheet reaches a position behind the support surface. Preferably, the sheet feeder further comprises a forcing member for forcing the sheet stacked on the hopper toward the support surface of the hopper. More preferably, the sheet feed rollers are temporarily rotated reversely before performing one forward rotation, thereby rearwardly pivoting the sheet reset lever. Preferably, the sheet feeder farther comprises an idle roller retraction mechanism which separates the idle rollers from the separation pads when the front edge of the sheet to be fed passes through a clearance between the separation pads and the idle rollers, and which mechanism brings the idle rollers into contact with the separation pads after the front edge of the sheet has passed through the clearance while the circular-arch portions of the sheet feed rollers still remain in contact with the separation pads with the sheet between them. Further preferably, the idle roller retraction mechanism is actuated by means of cams which are fitted around the shafts of the sheet feed rollers and rotate together with these shafts.

The third object is also accomplished by a sheet feeder including sheet feed rollers which rotate at the time of sheet feeding operation, a hopper which holds in a stacked manner a plurality of sheets to be fed on contact with the circumferential surface of each of the sheet feed rollers and brings a sheet into pressed contact with the sheet feed rollers when the sheet feed rollers forwardly rotate, and separation pads for separating the sheet to be fed by the sheet feed rollers from the next sheet by nipping the sheet between the circumferential surfaces of the sheet feed rollers and the separation pads, the sheet feeder comprising the hopper which supports the front portion of the sheet in an inclined state and has at a rear portion thereof a support member for supporting the rear portion of the sheet in a substantially horizontal state. Preferably, the support member is pivotable and capable of supporting the rear portion of the sheet in an inclined state.

To accomplish the fourth object, in accordance with a fourth aspect of the present invention, there is provided a printer including sheet feed rollers, each of which has a circular-arch portion, a linear portion, and a substantially D-shaped lateral cross section and performs one forward rotation at the time of sheet feeding operation; a hopper which holds in a stacked manner a plurality of sheets to be fed on contact with the circular-arch portions of the sheet feed rollers, and which hopper brings a sheet into pressed contact with the sheet feed rollers when the sheet feed rollers forwardly rotate; a support surface for supporting the front edge of the sheet stacked on the hopper; separation pads, each of which is on the course of rotation of the circular-arch portion of the sheet feed roller and forced toward the sheet feed roller by means of pad forcing means, and which separation pad separates the sheet to be fed by the sheet feed rollers from the next sheet by nipping the sheet between the circular-arch portions and the separation pads; idle rollers which come into contact with the separation pads when the sheet is not nipped between the separation pads and the circular-arch portions of the sheet feed rollers; and conveyor rollers for carrying the sheet fed from the sheet feed rollers, the printer comprising the conveyor rollers which reversely carry the sheet at least over the distance between the support surface on the course of transmission of the sheet and the area where the separation pads come into contact with the idle rollers, by being reversely rotated after having carried the front edge of the sheet over the distance or more. Preferably, the printer further comprises a sheet reset lever which is rearwardly pivoted so as to forcibly reset the next sheet in a rearward direction in such a way that the front edge of the next sheet is placed in a position in a rearward direction in relation to the area where the front edge of the next sheet comes into contact with the separation pads, after the passage of the rear edge of the uppermost sheet fed by the sheet feed rollers. Preferably, the printer further comprises a separation mechanism which separates the separation pads from the idle rollers when the sheet reset lever is rearwardly pivoted so as to forcibly reset the next sheet in a rearward direction. Preferably, the sheet reset lever forcibly resets the next sheet in a rearward direction in such a way that the front edge of the next sheet reaches a location behind the support surface. More preferably, the sheet feed rollers are temporarily rotated reversely before performing one forward rotation, thereby reversely pivoting the sheet reset lever. Preferably, the printer further comprises a forcing member which forces the sheet stacked on the hopper toward the support surface of the hopper. Preferably, the printer further comprises an idle roller retraction mechanism which separates the idle rollers from the separation pads when the front edge of the sheet to be fed passes through a clearance between the separation pads and the idle rollers, and which mechanism brings the idle rollers into contact with the separation pads after the front edge of the sheet has passed through the clearance while the circular-arch portions of the sheet feed rollers still remain in contact with the separation pads with the sheet between them. More preferably, the idle roller retraction mechanism is actuated by means of cams which are fitted around the shafts of the sheet feed rollers and rotate together with these shafts.

BRIEF DESCRIPTION OF THE DRAWINGS

FIG. 5 is a cross sectional view primarily showing a sheet feed roller, a hopper, or the like;

DETAILED DESCRIPTION OF THE PREFERRED EMBODIMENTS

With reference to the accompanying drawings, preferred embodiments of the present invention will be described hereinbelow.

<First Embodiment>

Figure 1:
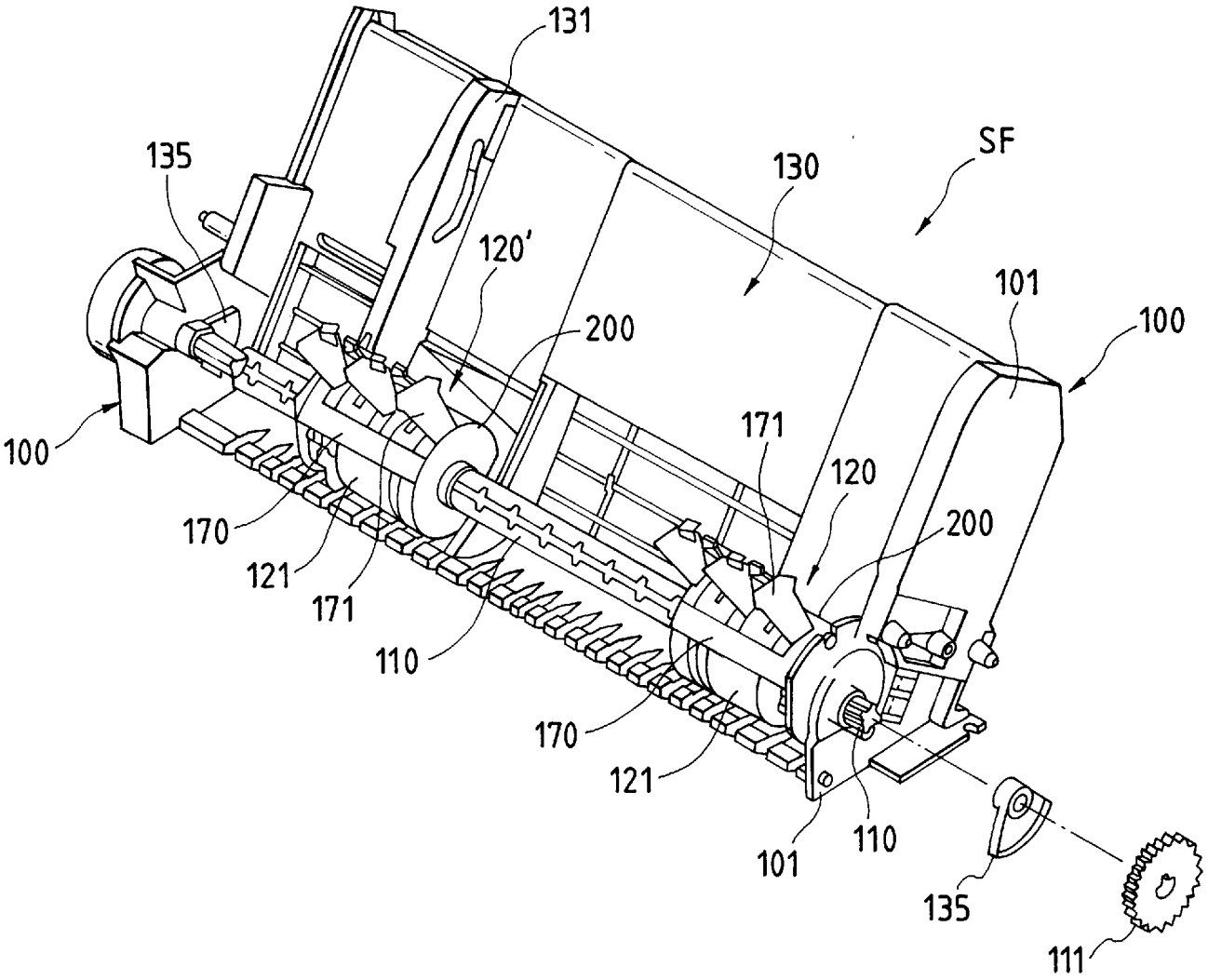
FIG. 1 is a perspective view showing a sheet feeder in accordance with a first embodiment of the present invention.
Figure 2:
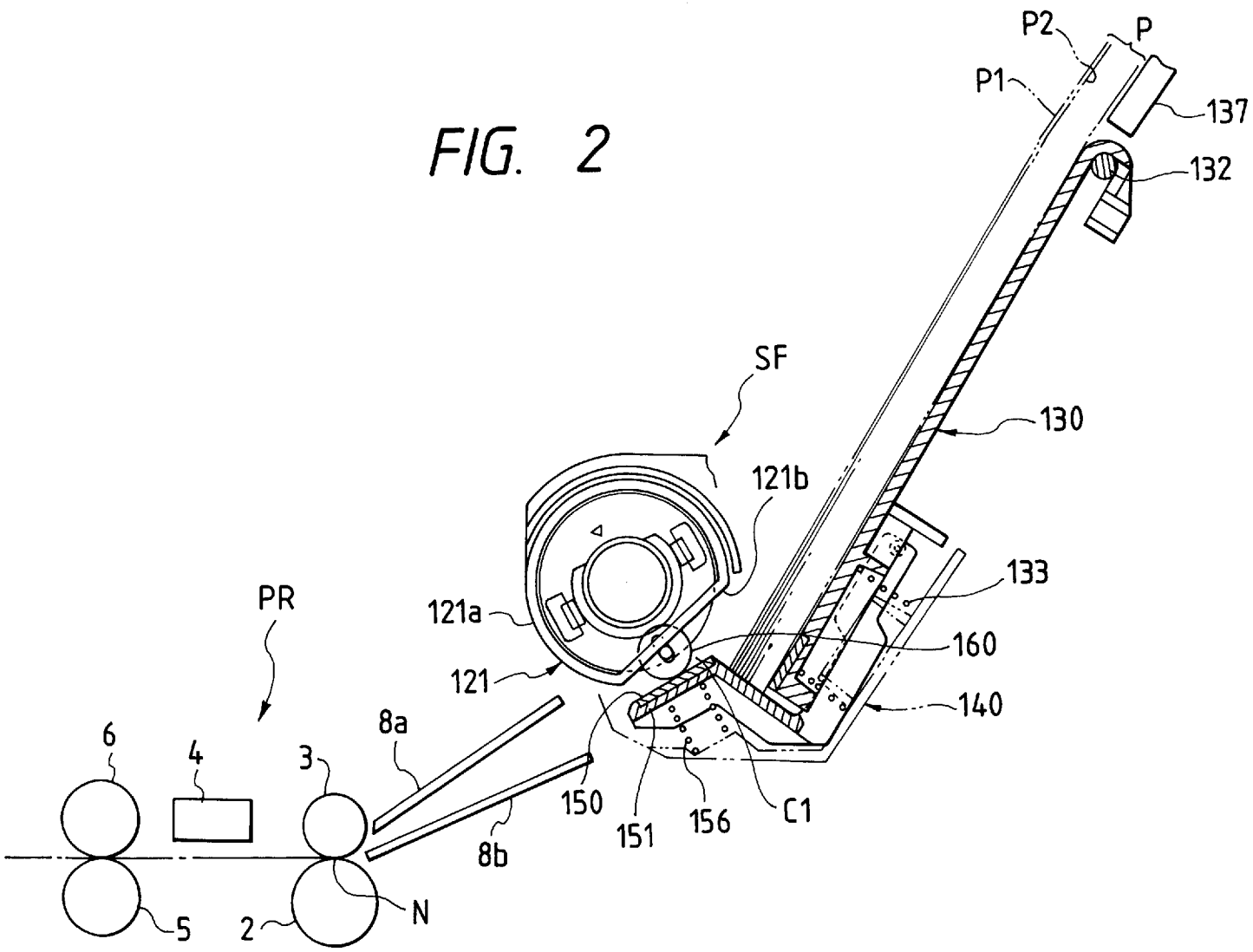
FIG. 2 is a partially-omitted-and-perspective schematic side view showing a printer which incorporates a sheet feeder in accordance with the first embodiment.

FIG. 1 is a perspective view showing a sheet feeder in accordance with a first embodiment of the present invention; and FIG. 2 is a partially-omitted-and-perspective schematic side view showing the principal elements of a printer which incorporates a sheet feeder in accordance with the first embodiment.

As shown in FIG., 1, a sheet feeder SF comprises a frame 100, a sheet feed roller shaft 110 supported by the frame 100 in a rotatable manner, a pair of sheet feed roller units 120, 120' attached to the sheet feed roller shaft 110, and a hopper 130 attached to the frame 100 in a pivotable manner.

An edge guide 131 which is slidable in the widthwise direction of sheet is attached to the hopper 130. Of the pair of sheet feed roller units 120, 120', the sheet feed roller unit 120' is joined to the edge guide 131 and is slidable along the sheet feed roller shaft 110 together with the guide edge 131.

For example, the sheet feeder SF having such a configuration is built in a printer PR such as that shown in FIG. 2.

Figure 20:
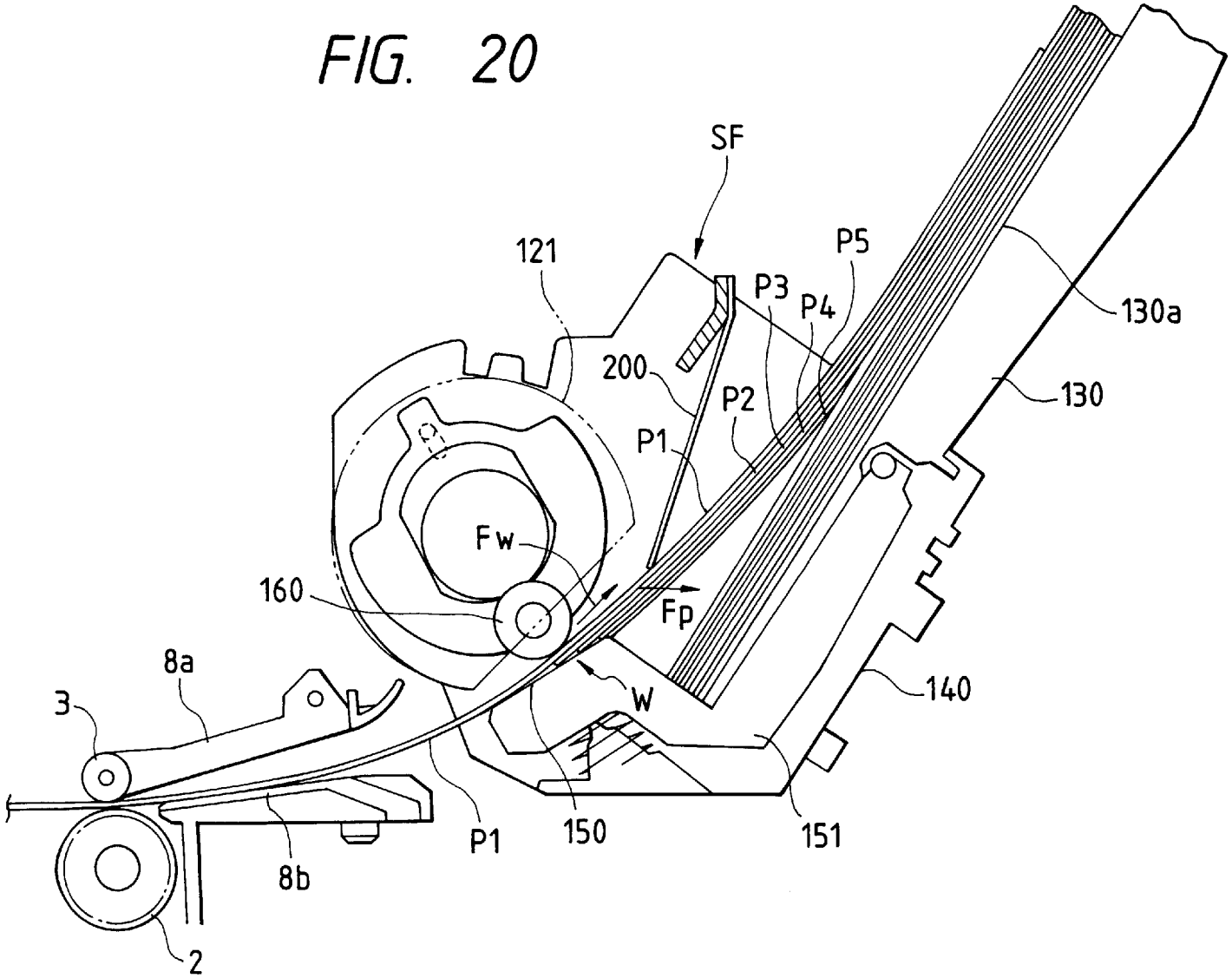

In FIG. 2, reference numerals 2, 3 designate a pair of conveyor rollers for carrying sheet; 4 designates a print head for printing an image on a sheet; 5, 6 designate a pair of discharge rollers for discharging printed sheet; and 8*a*, 8*b* designate sheet guides. Of the pair of conveyor rollers 2, 3, the roller 2 is a drive roller, and the roller 3 is a driven roller. As shown in FIG. 20, the driven roller 3 is attached to the front end of the upper sheet guide 8*a* in a rotatable manner. Of the pair of discharge rollers 5, 6, the roller 5 is a drive roller, and the roller 6 is a driven roller. The driven roller 6 is formed from a star wheel.

As shown in FIGS. 1 and 2, the hopper 130 is inclined (downwardly toward a clearance C1 formed between the sheet feed roller 121 and a separation pad 150, as viewed in the axial direction of the sheet feed roller 121 to be described later), and a plurality of sheets of sheet P are loaded on this hopper 130 in a stacked manner.

The user slides the edge guide 131 shown in FIG. 1 in accordance with the width of sheet to be loaded, and this edge guide 131 guides one side edge of the sheet to be fed. The other side of the sheet to be fed is guided by the side wall 101 of the frame 100. Accordingly, the sheet feed roller unit 120 is not slidable over the sheet feed roller shaft 110.

The pair of sheet feed roller units 120, 120' are symmetrical with respect to the direction in which sheet is fed and differ from each other merely in that one of them is slidable and the other is stationary. For these reasons, an explanation will be given solely of the sheet feed roller unit 120 of the sheet feed roller unit pair in the following description.

Figure 3:
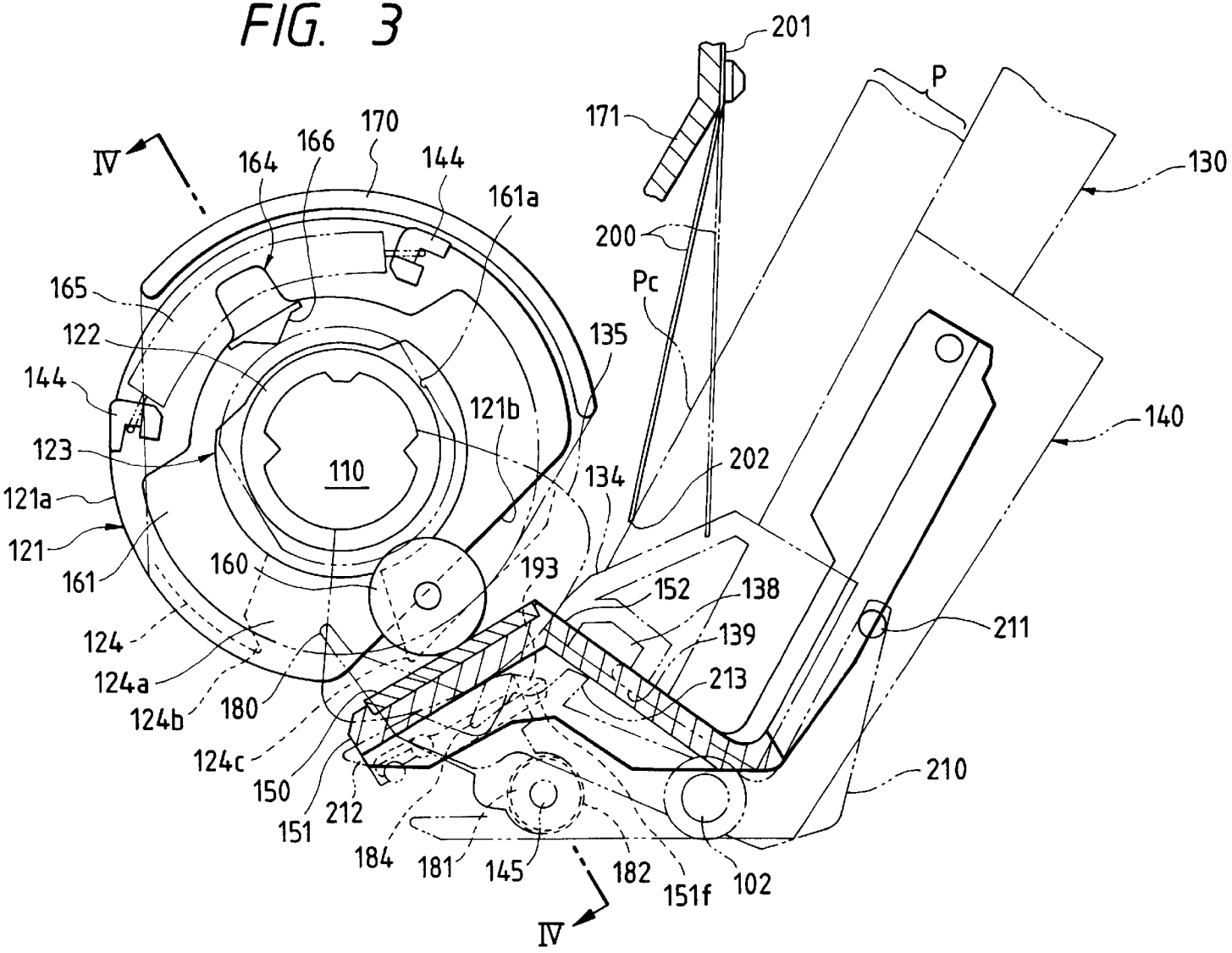
FIG. 3 is a partially sectional view of the sheet feeder or primarily a sheet feed roller unit.
Figure 4:
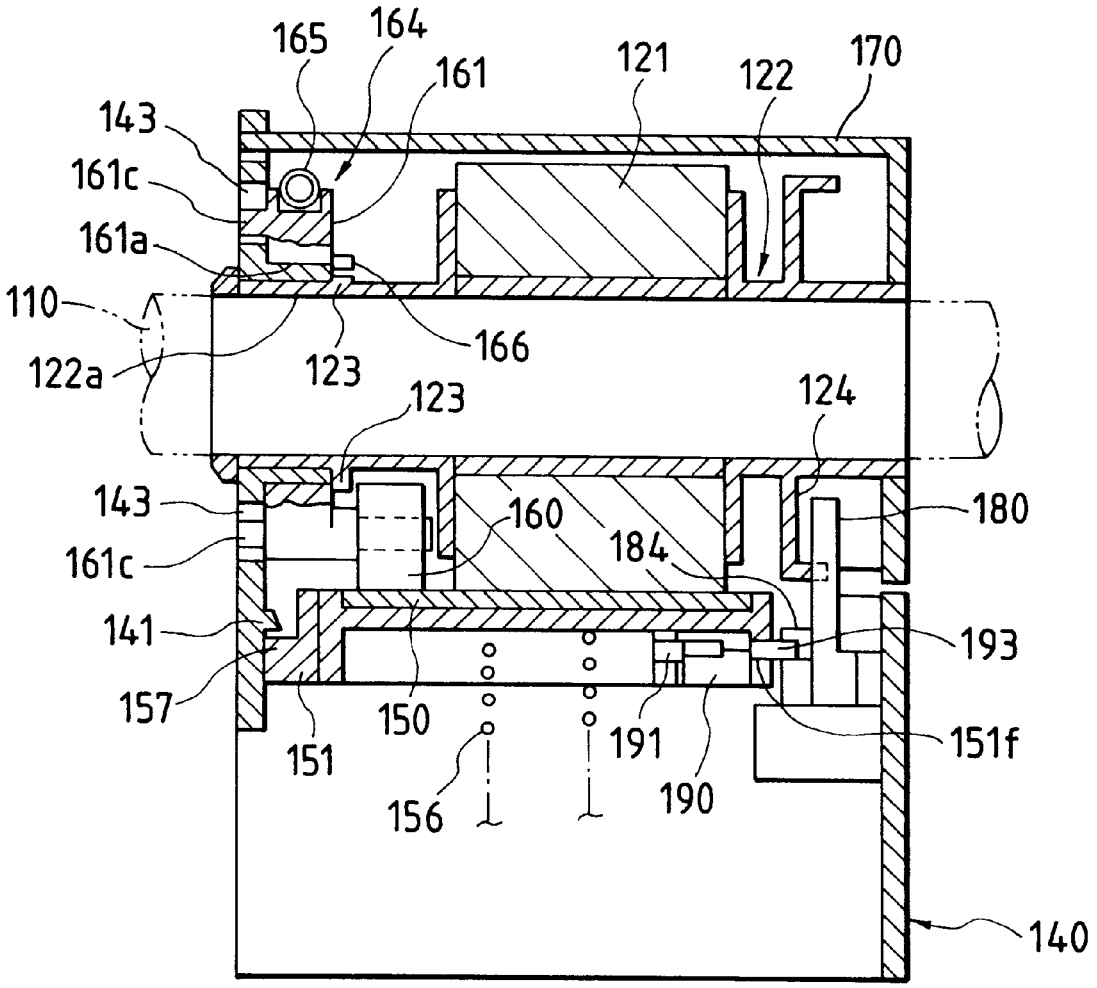
FIG. 4 is a partially-omitted cross sectional view taken across line IV—IV shown in FIG. 3.
Figure 5:
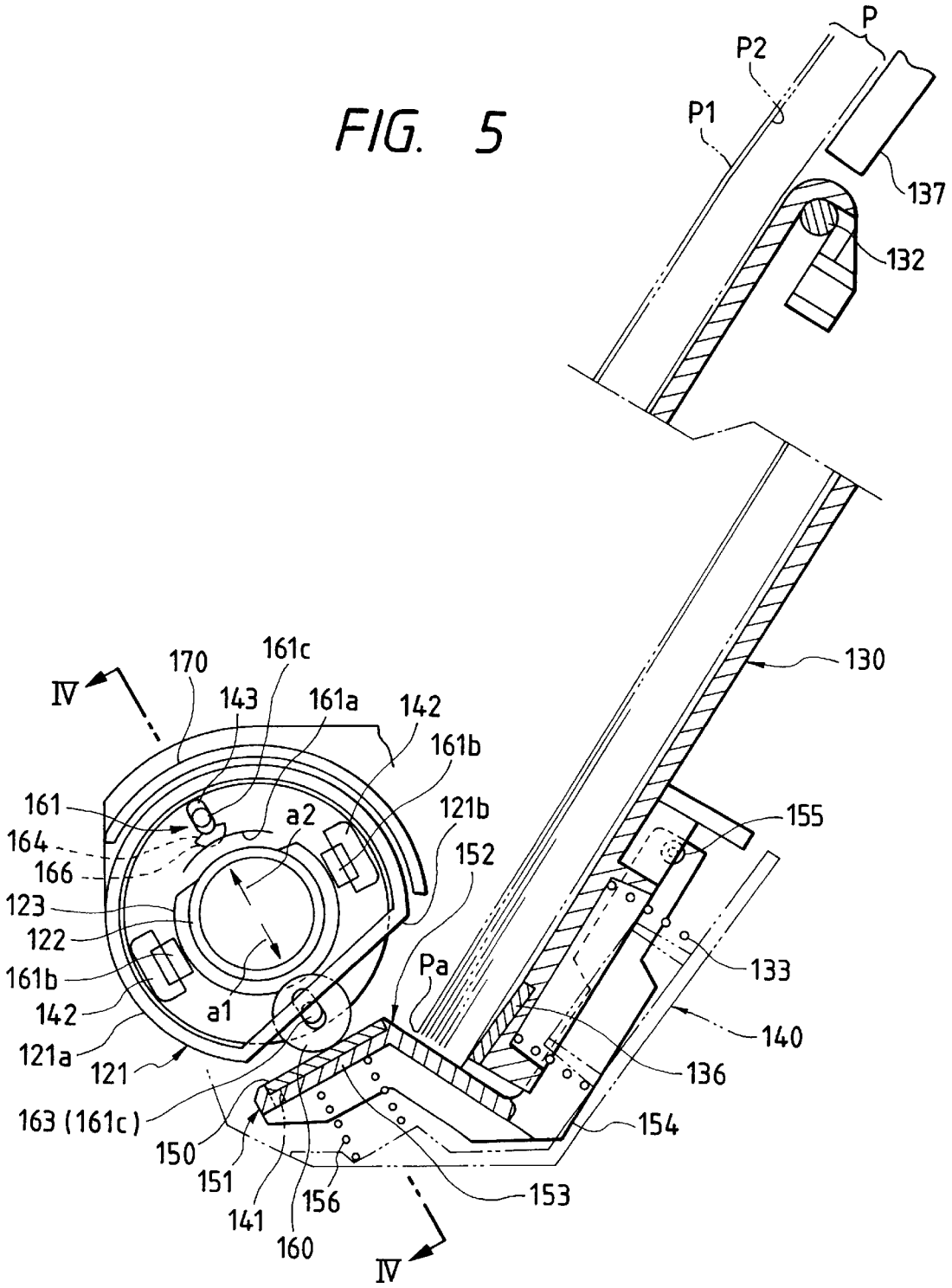
Figure 6:
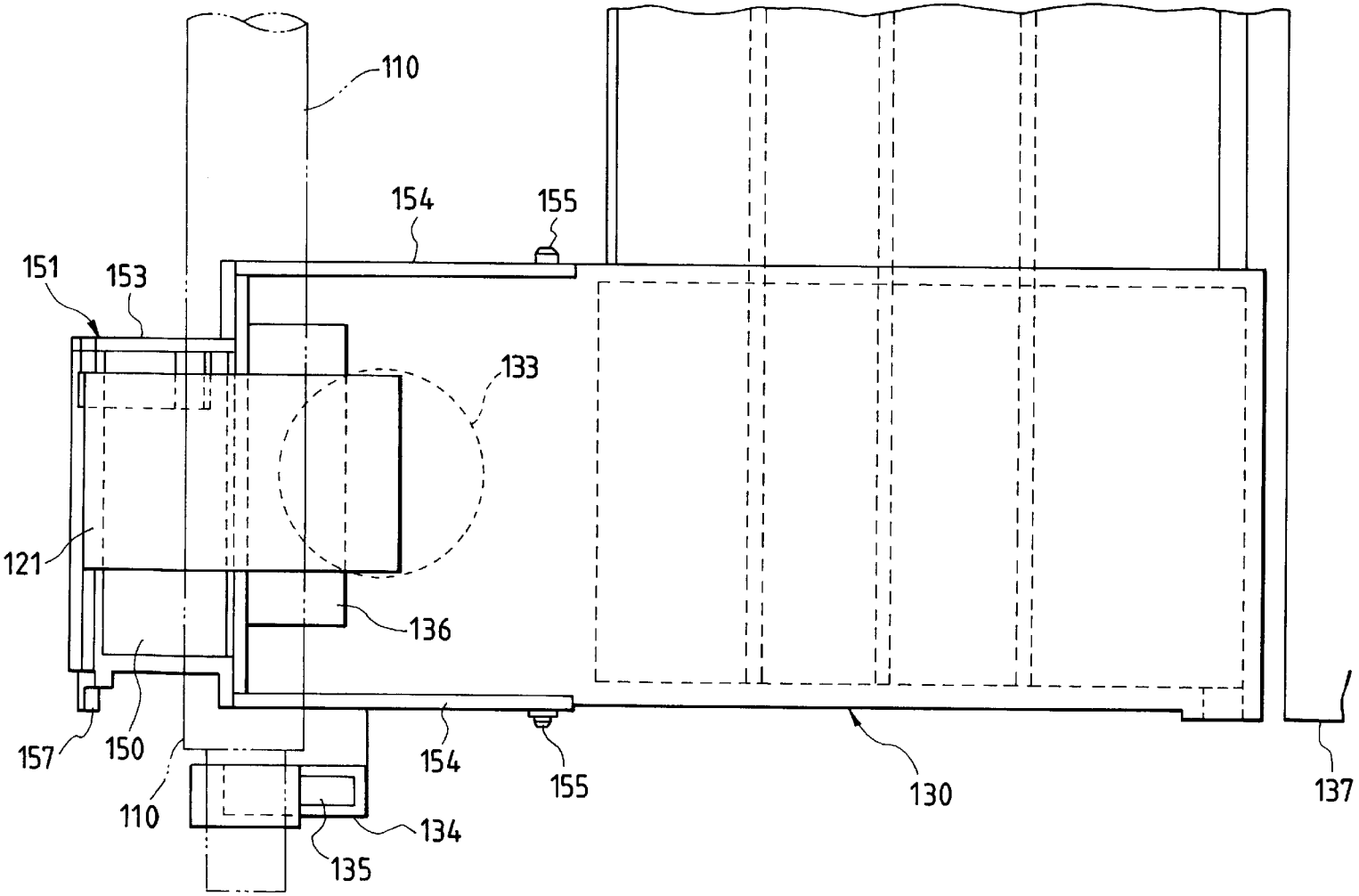
FIG. 6 is a partially-omitted plan view showing the sheet feed roller, the hopper, or the like, shown in FIG. 5.

FIG. 3 is a partially sectional view showing the principal elements of the sheet feeder or primarily a sheet feed roller unit; FIG. 4 is a partially-omitted cross sectional view taken across line IV—IV shown in FIG. 3; FIG. 5 is a cross sectional view primarily showing a sheet feed roller, a hopper, or the like; and FIG. 6 is a partially-omitted plan view showing the sheet feed roller, the hopper, or the like, shown in FIG. 5.

In these drawings, reference numeral 121 designates a sheet feed roller. The sheet feed roller 121 comprises a circular-arch portion 121*a* and a linear portion 121*b* and has a substantially D-shaped lateral cross section. Of this sheet feed roller 121, at least the surface (i.e., the circumferential surface) of the circular-arch portion 121*a* and the surface of the linear portion 121*b* are formed from highly-frictional material (e.g., rubber). As primarily shown in FIG. 4, the sheet feed roller 121 is fixed to the sheet feed roller shaft 110 via a bush 122. The sheet feed roller 121 and the bush 122 are not rotatable around the sheet feed roller shaft 110. The sheet feed roller shaft 110 is rotated only once at the time of sheet feeding operation by means of drive means (not shown) via a gear 111 (see FIG. 1) fitted to the end of the sheet feed roller shaft 110.

As shown in FIG. 5, the hopper 130 is attached to the frame 100 in a pivotable manner by means of a shaft 132. In this drawing, reference numeral 137 designates a sheet feed tray attached to the frame 100 or the printer. The plurality of sheets of sheet P are loaded on this hopper 130 and the sheet feed tray 137 in a stacked manner. The sheet P is loaded in an inclined state so as to be able to slide toward the area where the sheet feed roller 121 comes into contact with a separation pad 150 which will be described later. The sheet P is supported and aligned as a result of the front edge Pa of the sheet P coming into contact with a reverse surface (or a support surface) 152 of a separation pad holder 151 which will be described later.

Reference numeral 140 designates a frame (hereinafter referred to as a sub-frame) of the sheet feed roller unit 120. A hopper spring (compression spring) 133 is interposed between the sub-frame 140 and the front end of the hopper 130. In other words, the hopper 130 is constantly forced by means of the hopper spring 133 in a clockwise direction in FIG. 5 or in the direction in which the sheet P is brought into contact with the sheet feed roller 121. As shown in FIGS. 3 and 6, cam followers 134 are fitted to both sides of the hopper 130. A hopper cam 135 (see FIG. 1) fitted to each side of the sheet feed roller shaft 110 is prevented from pivoting on contact with the cam follower 134. As shown in FIGS. 5 and 6. a pad 136, similar to a separation pad which will be described later, is embedded in an upper surface of the front end of the hopper 130.

Reference numeral 150 designates a separation pad fixed to the separation pad holder 151. The separation pad 150 is formed from material which possesses a coefficient of friction with respect to the sheet P smaller than that of the sheet feed roller 121 with respect to the sheet P (e.g., urethane foam, cork, or the like). Both the separation pad 150 and the sheet feed roller 121 are formed from material possessing a coefficient of friction greater than a coefficient of friction between the sheets. More specifically, taking, a coefficient of friction between the sheet feed roller 121 and the sheet P as $\mu 1$, a coefficient of friction between the sheet P and the separation pad 150 as $\mu 2$, and a coefficient of friction between the sheets of sheet as $\mu 3$, a relationship of $\mu 1 > \mu 2 > \mu 3$ is established.

Figure 7:
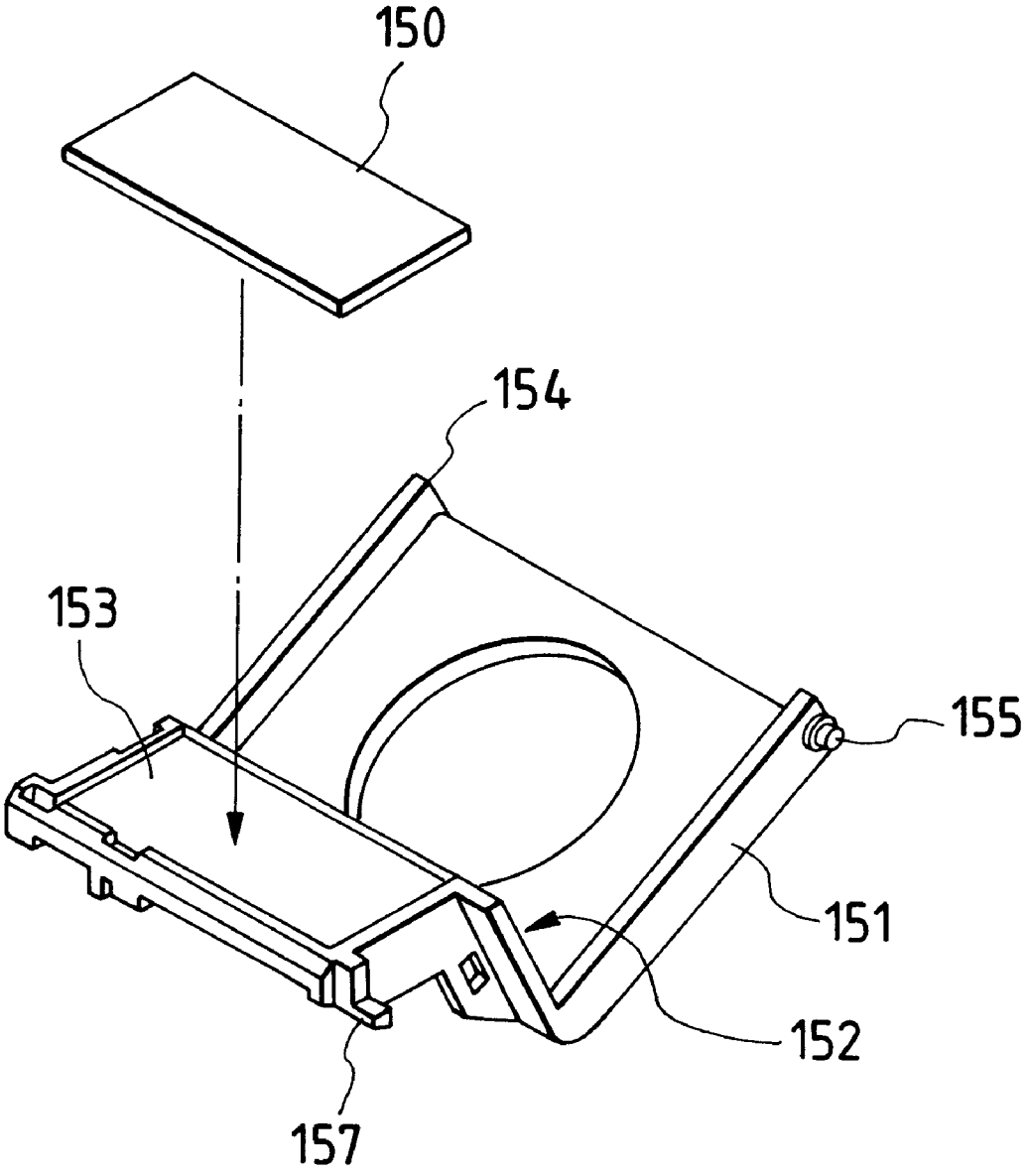
FIG. 7 is a perspective view showing a separation pad and a separation pad holder.
Figure 8:
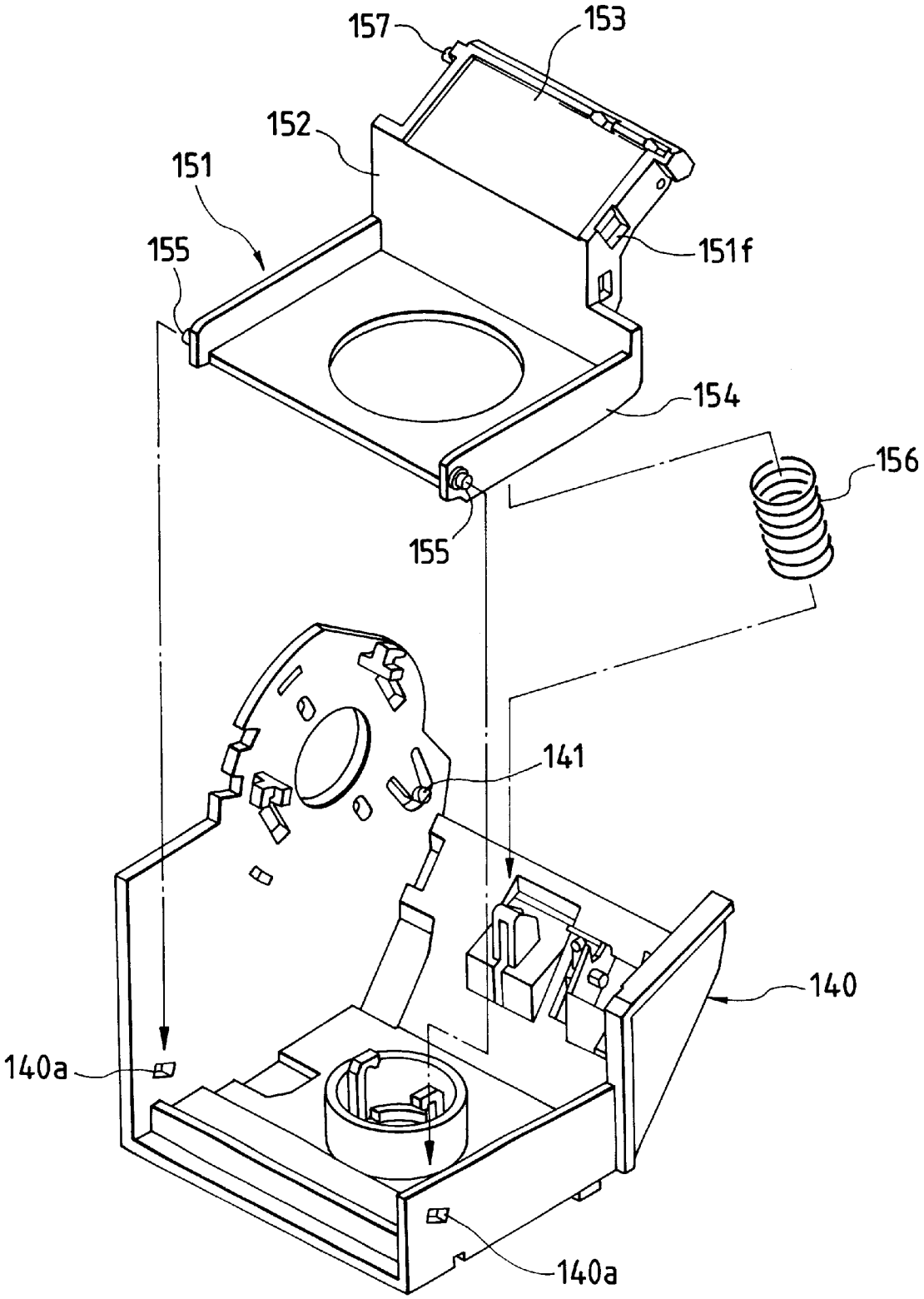
FIG. 8 is a perspective view showing the separation pad holder and a sub-frame.

As shown in FIGS. 7 and 8, the separation pad holder 151 comprises a pad support section 153 having the separation pad 150 mounted thereon, the foregoing support surface (or rear surface) 152 that is integrally formed with the pad support section 153 and supports the front edge of the sheet, and an arm section 154 integrally formed with the support surface 153. This separation pad holder 151 is attached to the sub-frame 140 in a pivotable manner by fitting a shaft 155 protruding from each side of the rear end of the arm section 154 into a corresponding track hole 140*a* formed on each side of the sub-frame 140.

A pad spring (compression spring) 156 serving as pad impelling means is sandwiched between a lower surface of the pad support section 153 and the sub-frame 140. Accordingly, the separation pad 151 is constantly forced in a clockwise direction in FIG. 5 or in the direction in which the separation pad 150 is brought into contact with the sheet feed roller 121. A protuberance 157 (see FIGS. 7 and 8) is formed on one side of the separation pad holder 151 and comes into contact with a pin 141 (see FIG. 8) which is formed on the sub-frame 140, as shown in FIG. 4, and forms pad regulation means, so that the pivotal movement of the protuberance 157 is prevented. In a state in which the protuberance 157 remains in contact with the pin 141, the separation pad 150 is on the course of rotation of the circular-arch section 121*a* of the sheet feed roller 121.

In FIGS. 3 to 5 and 9, reference numeral 160 designates an idle roller; and 161 designates an idle roller holder. Reference numeral 170 designates a cover of the sheet feed roller 121 attached to the sub-frame 140.

An idle roller holder 161 is formed into a substantially ring shape and has a hole 161*a* formed in its center. A shaft 163 is fixed in a lower position on one side surface of the idle roller holder 161, and the idle roller 160 is supported on this shaft 163 in a rotatable manner. Here, reference numeral 163*a* in FIG. 9 designates latching hooks.

Figure 9:
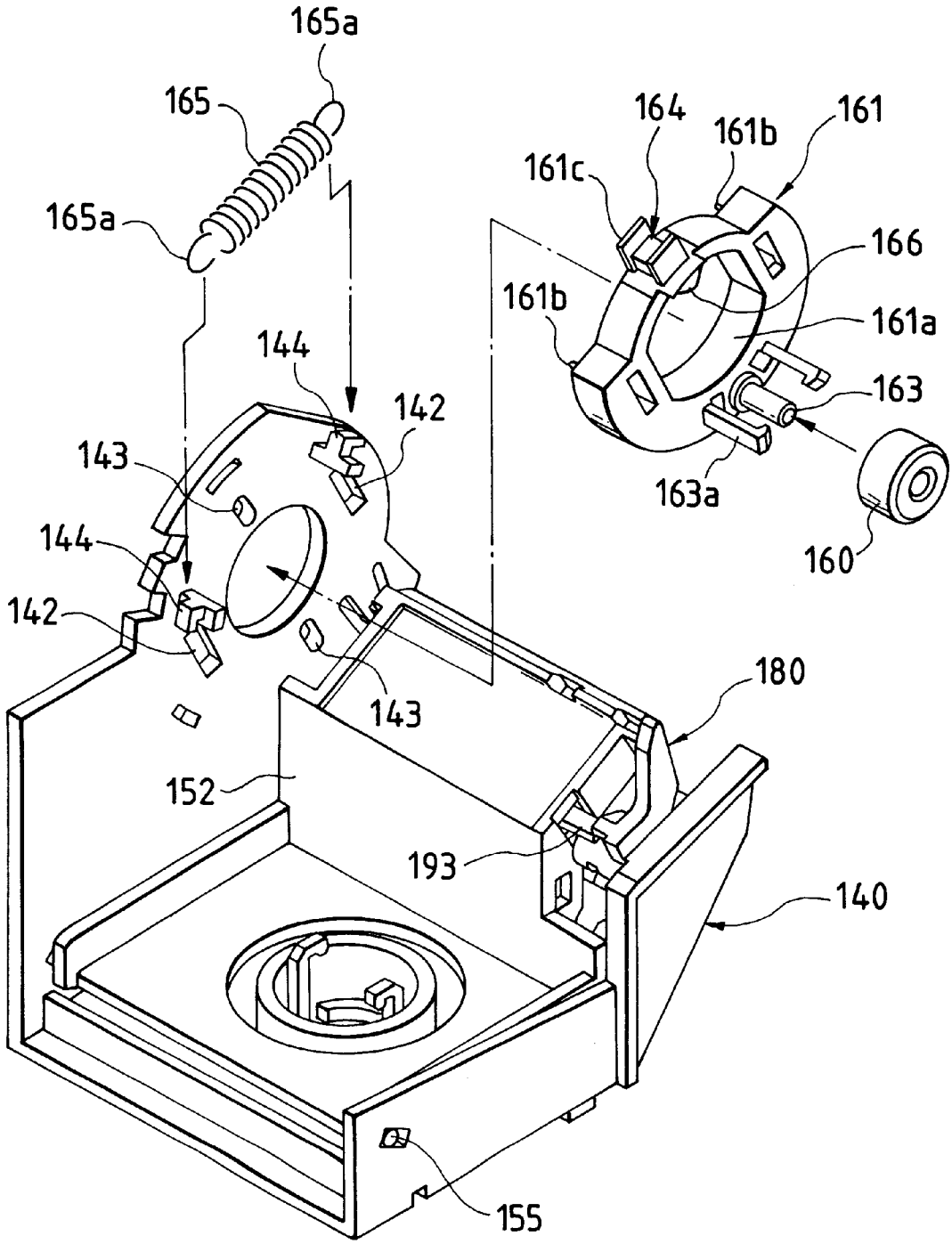
FIG. 9 is a perspective view primarily showing an idle roller and the sub-frame.

As shown in FIG. 9, a pair of pawls 161*b*, 161*b* are formed in the idle roller holder 161. These pawls 161*b*, 161*b* are loosely engaged with elongated holes 142, 142 provided on the sub-frame 140, and the idle roller 161 is attached to the sub-frame 140. Further, as shown in FIGS. 4 and 5, a pair of pins 161*c*, 161*c* are provided on the other side surface of the idle roller holder 161 and are aligned with the diameter of the idle roller holder 161. As shown in FIGS. 4 and 9, the pins 161*c*, 161*c* are fitted into track holes 143, 143 formed in the side frame 140 in a slidable manner. Further, as shown in FIG. 4, the sheet roller shaft 110 and the bush 122 are fitted into the hole 161*a* of the idle roller holder 161. The diameter of the hole 161*a* is formed so as to have a diameter which is greater than the outside diameter of a corresponding portion 122*a* of the bush 122.

Consequently, the idle holder 161 can slide in both directions designated by arrows a1 and a2 in FIG. 5 as a result of the pins 161*c*, 161*c* being guided by the track holes 143, 143, thereby also enabling the idle roller 160 to slide in both directions a1 and a2.

As shown in FIGS. 3, 4, and 9, a spring receiver 164 is provided in an upper position on the circumference of the idle roller holder 161. A roller spring being a tensile spring) 165 serving as roller forcing means is provided across the spring receiver 164. This roller spring 165 is engaged at both ends 165*a* with lugs 144, 144 (see FIG. 9) formed on the interior surface of the sub-frame 140 and is attached to the sub-frame 140. Although the idle roller holder 161 is constantly forced by means of the roller spring 165 in the direction designated by arrow a1 in FIG. 5, further movement of the idle roller holder 161 is prevented as a result of the idle roller 160 coming into contact with the separation pad 150 (or as a result of a cam follower 166, which will be described later, coming into contact with a cam 123 formed on the bush 122). The urging force of the roller spring 165 is set to become smaller than that of the pad spring 166. Accordingly, the idle roller 160 is prevented from pushing down the separation pad 160.

As described above, the cam follower 166 is formed in an upper position on one side surface of the idle roller holder 161. As a result of the cam follower 166 being engaged with, or disengaged from, the previously-described cam 123 formed on the bush 122 (see FIGS. 3 through 5), the idle roller holder 161 is moved in either the direction a1 or a2. For this reason, the idle roller 160 itself is moved in either the direction a1 or a2. More specifically, an idle roller retraction mechanism in the first embodiment is comprised of the idle roller holder 161 and the cam 123. As will be described later, the profile of the cam 123 is formed so as to bring the idle roller 160 out of contact with the separation pad 150 when the front edge of the sheet to be carried passes through a clearance between the idle roller 160 and the separation pad 150 as well as to bring the idle roller 160 into contact with the separation pad 160 after the passage of the front edge of the sheet through the clearance between the separation pad 150 and the idle roller 160 while the circular-portion 121*a* of the sheet feed roller 121 still remains in contact with the separation pad 150 with the sheet between them.

Reference numeral 180 shown in FIGS. 3, 4, 9, and 10 designates a sheet reset lever.

A base 181 of this sheet reset lever 180 is formed into a cylinder having a substantially C-shaped cross section. This cylindrical base 181 is fitted to shafts 145*a,* 145*a* formed on the sub-frame 140 by utilization of the elasticity of the bass 181. As a result, the cylindrical base 181 is attached to the sub-frame 140 in a pivotable manner. A smaller-diameter portion 181*a* is formed in the cylindrical base 181, and a torsion spring 182 is fitted around this small-diameter portion 181*a* (or the small-diameter portion 181*a* is inserted into a coil section 182*a* of the torsion spring 182). One arm 182*b* of the torsion spring 182 is inserted into a hole 183 formed in the sheet reset lever 180 and is fixed to the sheet reset lever 180. The torsion spring 182 is at its center fixedly held by a hook 147 and is supported at both ends by receiving grooves 146, 146 formed in the sub-frame 140, so that the other arm 182*c* is fixed to the sub-frame 140. When external force is not exerted on this sheet reset lever 180, the lever is positioned in a neutral position shown in FIGS. 3 and 9. In contrast, if external force (external force applied by a disk 124 of the bush 122 which acts as an operation member to be described later or external force applied by the sheet to be fed) acts on the sheet reset lever 180, the sheet reset lever 180 is pivoted clockwise or counterclockwise in FIG. 3 against the urging force of the spring 182. In contrast, if no external force acts on the sheet reset lever 180, the lever is returned to the neutral position under the urging force of the spring 182.

Figure 11:
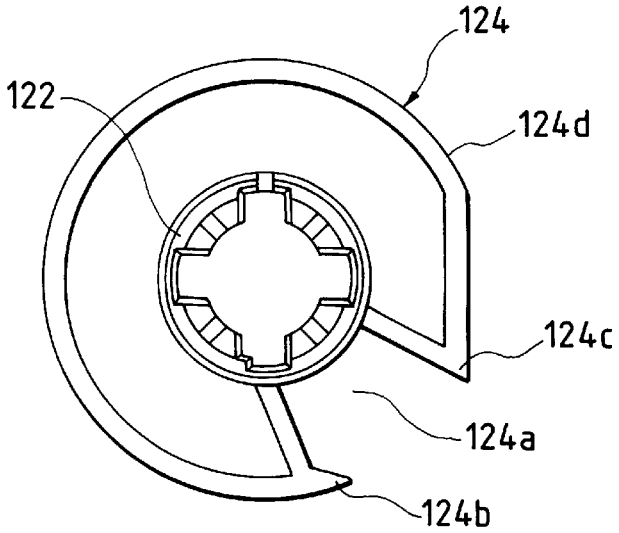
FIG. 11 is a side view showing a bush and a disk.

As shown in FIG. 4, the disk 124 which serves as an operation member is integrally formed with the bush 122 so as to correspond to the sheet reset lever 180. As shown in FIGS. 8 and 11, a recess 124*a* is formed in the disk 124, and the sheet reset lever 180 is engaged with this recess 124*a* when in the foregoing neutral position. When the bush 122 is rotated (i.e., the sheet feed roller shaft 110 is rotated), one of angular portions 124*b* and 124*c* of the disk 124 comes into contact with the sheet reset lever 180, thereby pivoting the sheet reset lever 180 clockwise or counterclockwise in FIG. 3. When the sheet reset lever 180 is rotated clockwise, sheet is forcibly reset, as will be described later. At this time, the separation pad 150 is separated from the idle roller 160 by means of a separation mechanism which will be described below.

This separation mechanism primarily comprises the sheet reset lever 180 and a separation lever 190 placed in the separation pad holder 151 below the pad support 153 (see FIGS. 12 and 12B).

Figure 12A:
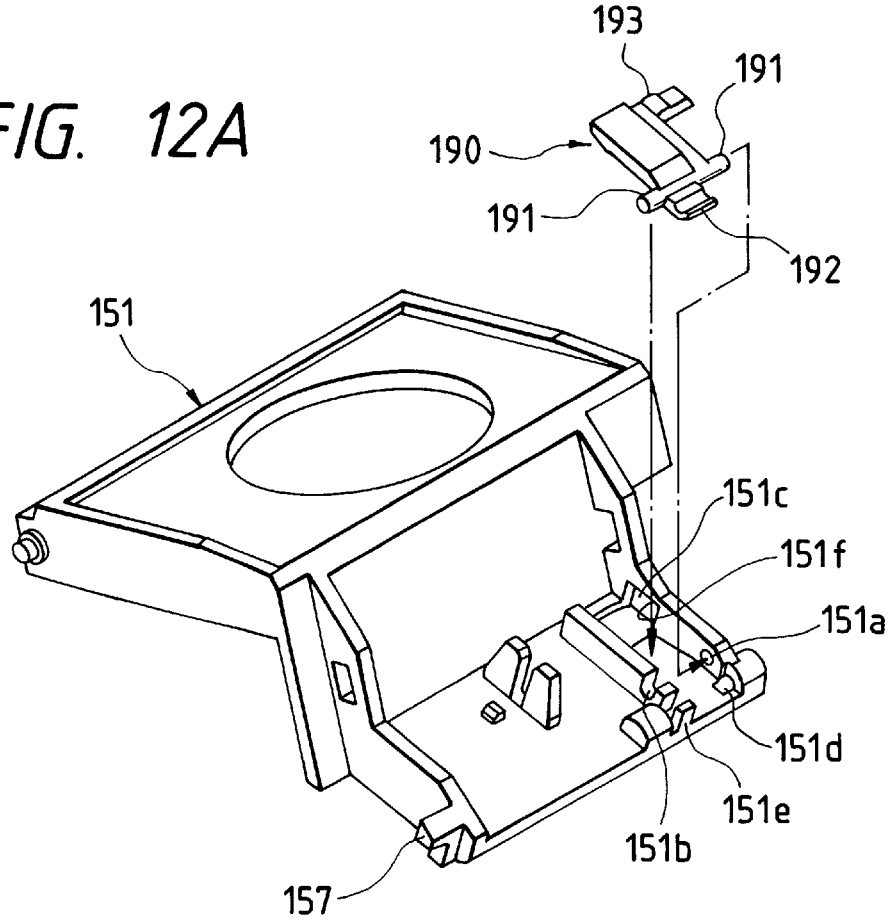
FIGS. 12A and 12B are perspective views showing the mounted state of a separation lever.
Figure 12B:
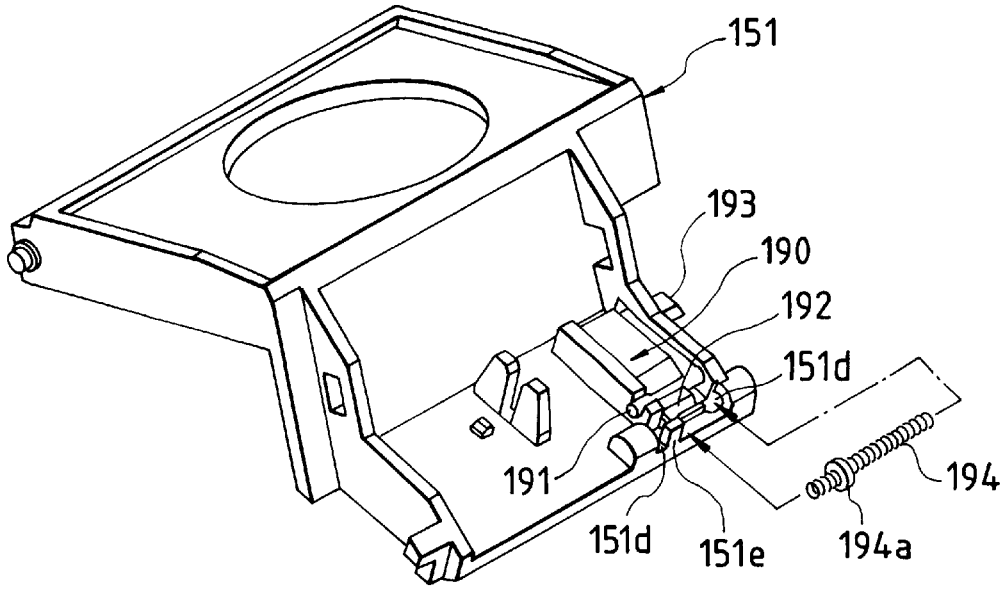

FIGS. 12A and 12B are perspective views showing the incorporation of the separation lever 190 into the separation pad holder 151. To make it easy to understand the state of the built-in separation lever, the separation pad holder is turned upside down in these drawings.

The separation lever 190 has a shaft 191, a spring receiver 192, and a lug 198.

In contrast, the separation pad holder 151 has a shaft bearing hole 151*a,* a shaft bearing groove 151*b,* a window 151*c,* and spring receiver holes 151*d,* 151*d.*

The lug 193 of the separation lever 190 is inserted into the window 151*c,* and the shaft 191 is fitted into the shaft bearing hole 151*a* and the shaft bearing groove 151*b.* As a result, the separation lever 190 is attached to the separation pad holder 151 in a pivotable manner.

In FIG. 12B, reference numeral 194 designates a coil spring, and a step portion 194*a* is formed by increasing the diameter of a part of the coil.

The coil spring 194 is attached to the separation pad holder 151 by being engaged at both ends with the spring receiver holes 151*d,* 151*d* and pushes the spring receiver 192 of the separation lever 190 in a downward direction in FIG. 12B. Accordingly, the separation lever 190 is forced by the coil spring 194 and is usually placed in contact with a lower edge 151*f* (see FIG. 8) of the window 151*c* of the separation pad holder 151 (see FIGS. 8 and 4). However, this separation lever 190 is pivotable within the extent in which the lug 193 can move within the window 151*c*. Reference numeral 151*e* designates a protruding catch for engaging with the step portion 194*a* and retaining the coil spring 194.

Figure 10:
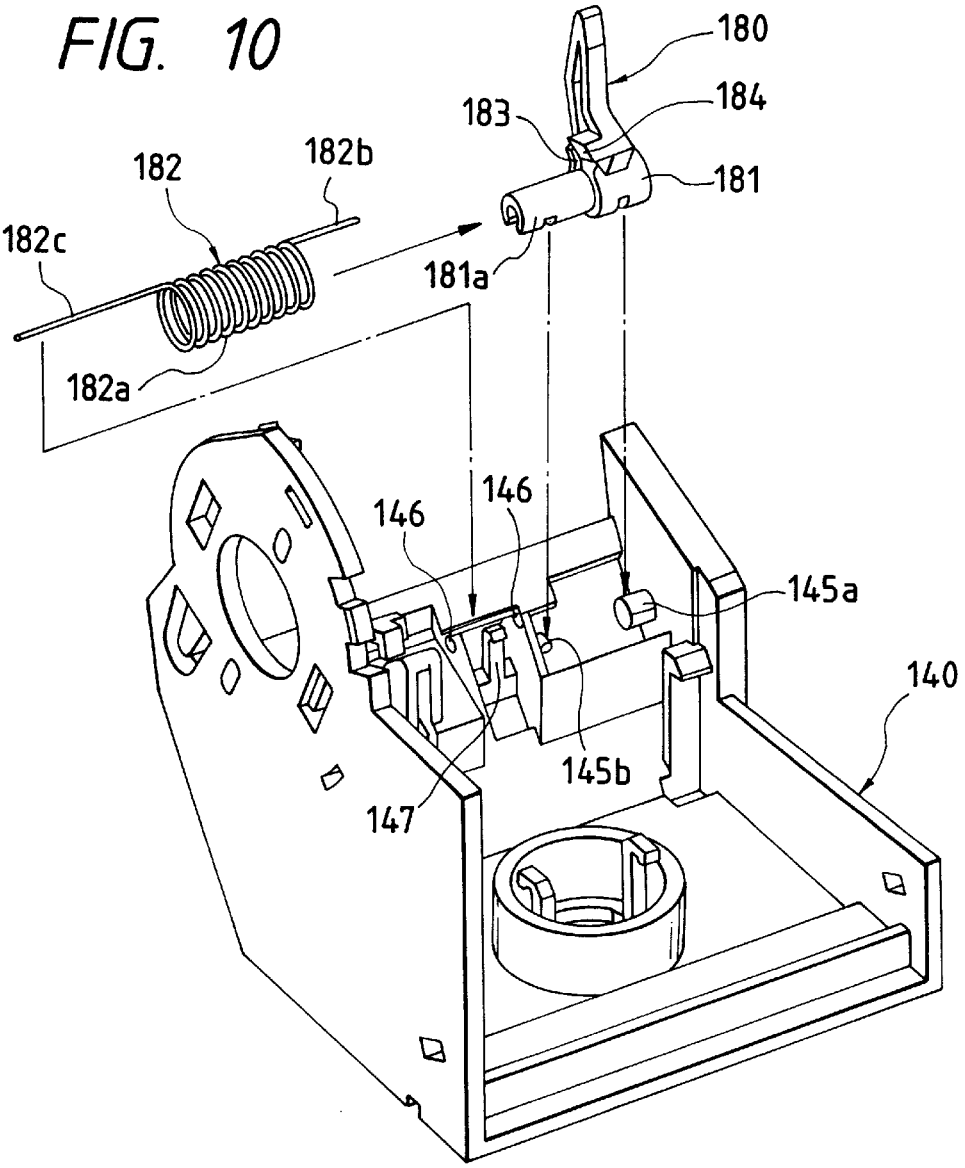
FIG. 10 is a perspective view primarily showing a sheet reset lever and the sub-frame.

As shown in FIG. 10, the foregoing sheet reset lever 180 comprises a protruding cam 184. As shown in FIGS. 8, 4, and 9, when the separation pad holder 151 is placed in the sub-fame 140, the lug 193 of the separation lever 190 is on the course of pivotal movement of the protruding cam 184. Accordingly, when the sheet reset lever 180 is pivoted clockwise in FIG. 8, as will be described later, the protruding cam 184 presses the lug 193, which in turn pushes down the separation pad holder 151 or the separation pad 150. As a result, the separation pad 150 is brought out of contact with the idle roller 160.

Reference numeral 200 in FIGS. 1 and 3 designates a sheet which is a forcing member and is made of synthetic resin. The upper edge 201 of the sheet 200 is attached to a guide 171 fixed to the cover 170 of the sheet feed roller. As designated by a two-dot chain line in FIG. 3, the sheet 200 is linear when in a free condition. When the lower edge 201 of the sheet 200 comes in to contact with an upper surface Pc of the sheet P loaded on the hopper 130, the sheet 200 is deflected, as designated by a solid line. Conversely, this sheet 200 forces the sheet P loaded on the hopper 130 toward the sheet support surface 130*a* of the hopper 130.

The sheet feeder in the first embodiment has a hopper retaining mechanism for regulating-the pivotal movement of the hopper 130, as well as the previously-described hopper cam 136 (see FIG. 1).

Figure 13:
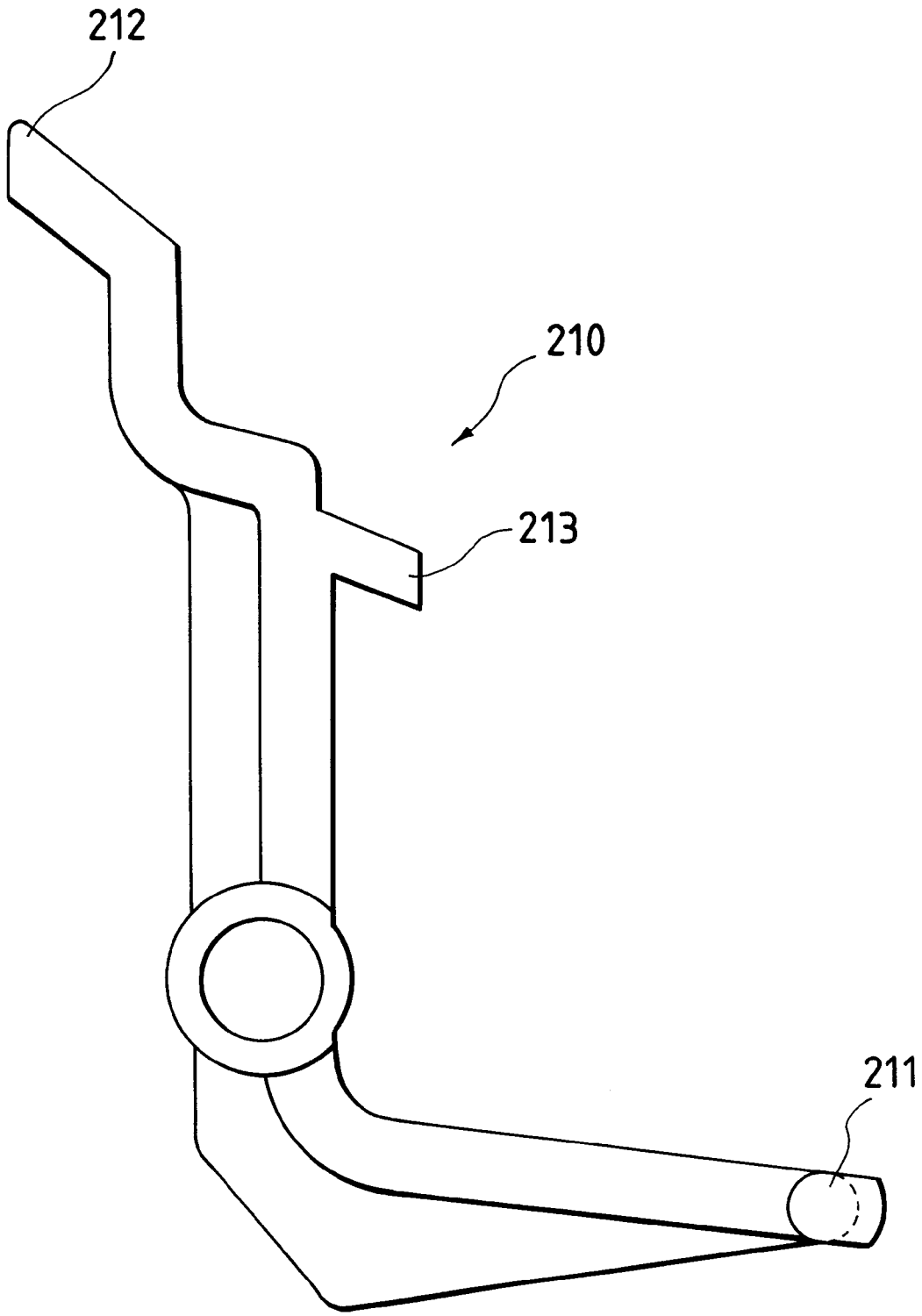
FIG. 13 is an illustrative view showing a retaining lever.

The hopper retaining mechanism is primarily made up of a retaining lever 210 (see FIGS. 3 and 13).

Reference numeral 102 in FIG. 3 designates a pin protruding from each side wall 101 (see FIG. 1) of the frame 100. The retaining lever 210 is attached to the side wall 101 in a pivotable manner by means of this pin 102. A tensile spring (nor shown) is provided between the rear end 211 of the retaining lever 210 and the side wall 101, and the retaining lever 210 is constantly forced clockwise in FIG. 3 by means of this tensile spring. As shown in FIG. 3, since the front end 212 of the retaining lever 210 is on the course of rotation of the hopper cam 135, the front end 212 is pivoted counterclockwise upon contact with the hopper cam 135. A protuberance 213 is formed in the middle of the retaining lever 210 and can be engaged with or disengaged from a recess 138 formed in the front end on one side of the hopper 130. When the retaining lever 210 is pivoted clockwise, the protuberance 213 is engaged with (or fitted into) the recess 138, thereby inhibiting the upward pivotal movement of the hopper 130 (i.e., the pivotal movement of the hopper 130 in a clockwise direction in FIG. 3). In contrast, if the retaining lever 210 is pivoted counterclockwise, the protuberance 213 is disengaged from the recess 138, thereby enabling the upward pivotal movement of the hopper 130. The hopper retaining mechanism is provided on each side of the hopper 130.

The operation of the foregoing sheet feeder and printer will now be described.

First, the sheet feeder and the printer while in a standby condition will be described.

As shown FIG. 3, when the sheet feeder and the printer are in a standby condition, the cam follower 134 of the hopper 130 stays in contact with the hopper cam 135, thereby holding the hopper 180 in a depressed state (see FIG. 5).

At this time, the linear portion 121*b* of the sheet feed roller 121 remains opposite to the sheet P, and the sheet feed roller 121 is kept out of contact with the sheet P.

Therefore, the sheet P can be readily loaded on the hopper 130 in this state.

Although the separation pad holder 151 (or the separation pad 150) is forced clockwise in FIG. 3 by means of the pad spring 156 (see FIG. 5), the separation pad holder 161 is inhibited from pivoting and kept standstill in the position shown in FIG. 5 as a result of the protuberance 157 coming into contact with the pin 141, as shown in FIG. 4. Accordingly, the urging force of the pad spring 156 does not affect the idle roller 160. Further, at this time, the separation pad 150 is on the course of rotation of the circular-arch portion 121*a* of the sheet feed roller 121.

The cam 123 of the bush 122 is out of contact with the cam follower 166 of the idle roller holder 161. Consequently, the idle roller 160 stays in contact with the separation pad 150 under the urging force of the roller spring 165 of the idle roller 160.

The sheet reset lever 180 is in a neutral position and engaged with the recess 124*a* of the bush 122. The protruding cam 184 of the sheet reset lever 180 is out of contact with or in slight contact with the lug 193 of the separation lever 190.

The lug 193 of the separation lever 190 is in contact with the lower edge 151*f* of the window 151*c* of the separation pad holder 151.

The front end 212 of the retaining lever 210 of the hopper retaining mechanism is in contact with the hopper cam 135. Hence, the protuberance 213 of the retaining lever 210 stays out of contact with the recess 138 of the hopper 130.

Next, an explanation will be given of sheet resetting operations, sheet feeding operations, and sheet carrying operations (including the forcible resetting of sheet to its original position).

(i) Sheet resetting operation will be first carried out in the first embodiment.

For convenience of explanation, the sheet resetting operation is more easily conceivable after the explanation of sheet feeding and sheet carrying operations, both of which will be described in (ii) or subsequent sections. Consequently, the sheet resetting operation will be described later.

(ii) In FIG. 3, the sheet feed roller shaft 110 starts to rotate clockwise, which in turn causes the sheet feed roller 121, the bush 122, and the hopper cam 135 to start to rotate. At this time, the pair of conveyor rollers 2, 3 also start to rotate in the direction in which sheet is fed (i.e., in a forward direction). To simply explanations, the pair of conveyor rollers 2, 8 will not be referred unless otherwise required.

Figure 14:
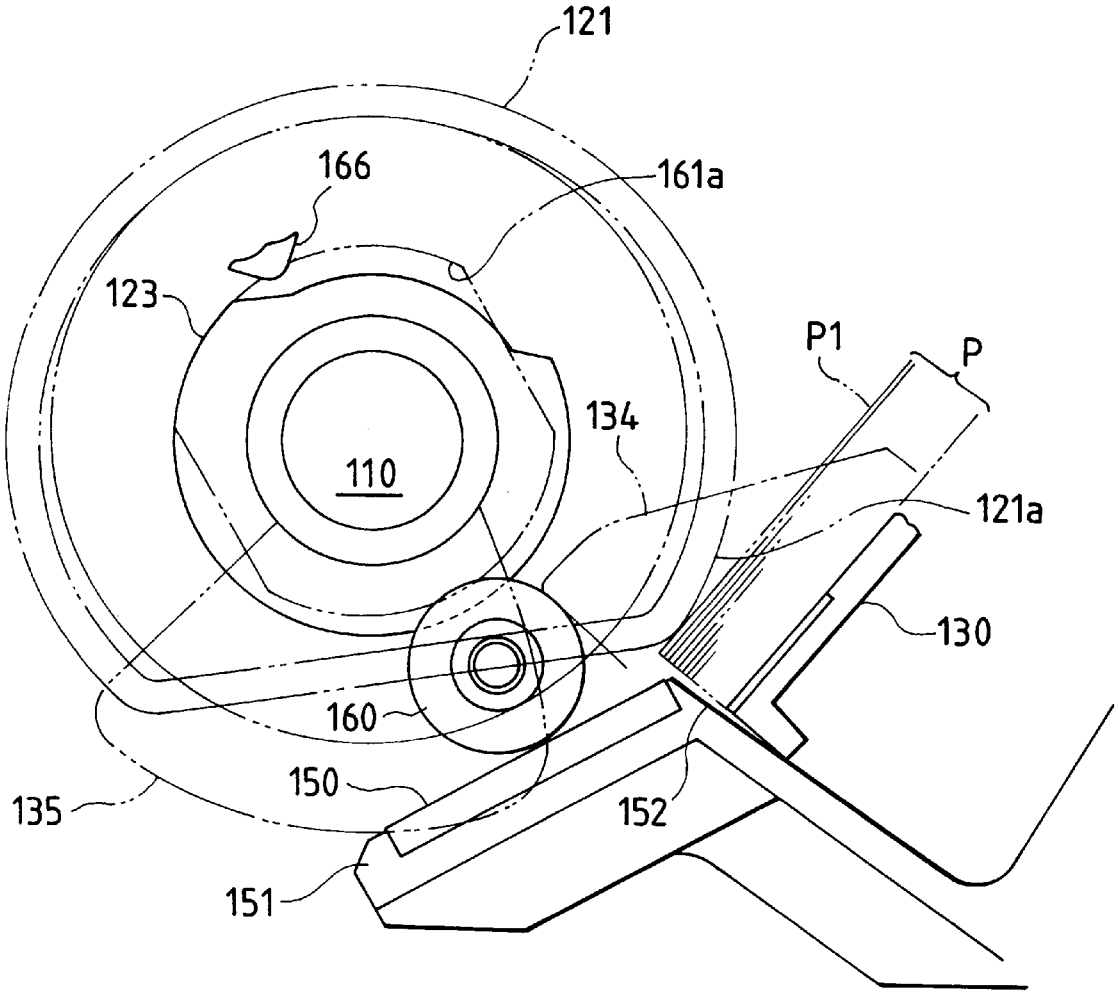
FIGS. 14 to 31 are schematic representations showing the operation of the sheet feeder.

(iii) As shown in FIG. 14, when the sheet feed roller 121, the bush 122, and the hopper cam 135 rotate through a predetermined angle together with the sheet feed roller shaft 110, thereby disengaging the hopper cam 135 from the cam follower 134 of the hopper 130. As a result, the hopper 130 is momentarily raised by the hopper spring 133 (see FIG. 5). Accordingly, the sheet P is also raised, thereby pressing the uppermost sheet P1 of the sheet P against the circular-arch portion 121*a* of the sheet feed roller 121. The hopper 130 and the sheet P are momentarily raised, and hence even if the uppermost sheet is disengaged from the support surface 152, it will be hardly lowered. Accordingly, as shown in FIG. 14, the uppermost sheet is sandwiched between the hopper 130 and the sheet feed roller 121.

Meanwhile, the separation pad holder 151 (or the separation pad 150) still remains in a standby condition, as previously described. The cam 123 of the bush 122 and the cam follower 166 of the idle roller holder 161 are not yet in contact with each other. The idle roller 160 is in contact with the separation pad 150 under the urging force of the roller spring 165. The sheet reset lever 180 is pressed by the angular portion 124*c* of the disk 124 (see FIG. 3) as a result of the rotation of the bush 122 to thereby pivot counterclockwise. The sheet reset lever 180 is then disengaged from the angular portion 124*a,* and the tip end of the sheet reset lever 180 is brought in alignment with a circumferential surface 124*d* of the disk 124. Although the protruding cam 184 of the sheet reset lever 180 is completely disengaged from the lug 193 of the separation lever 190, the separation lever 190 and the retaining lever 210 still remain in a standby condition.

Figure 15:
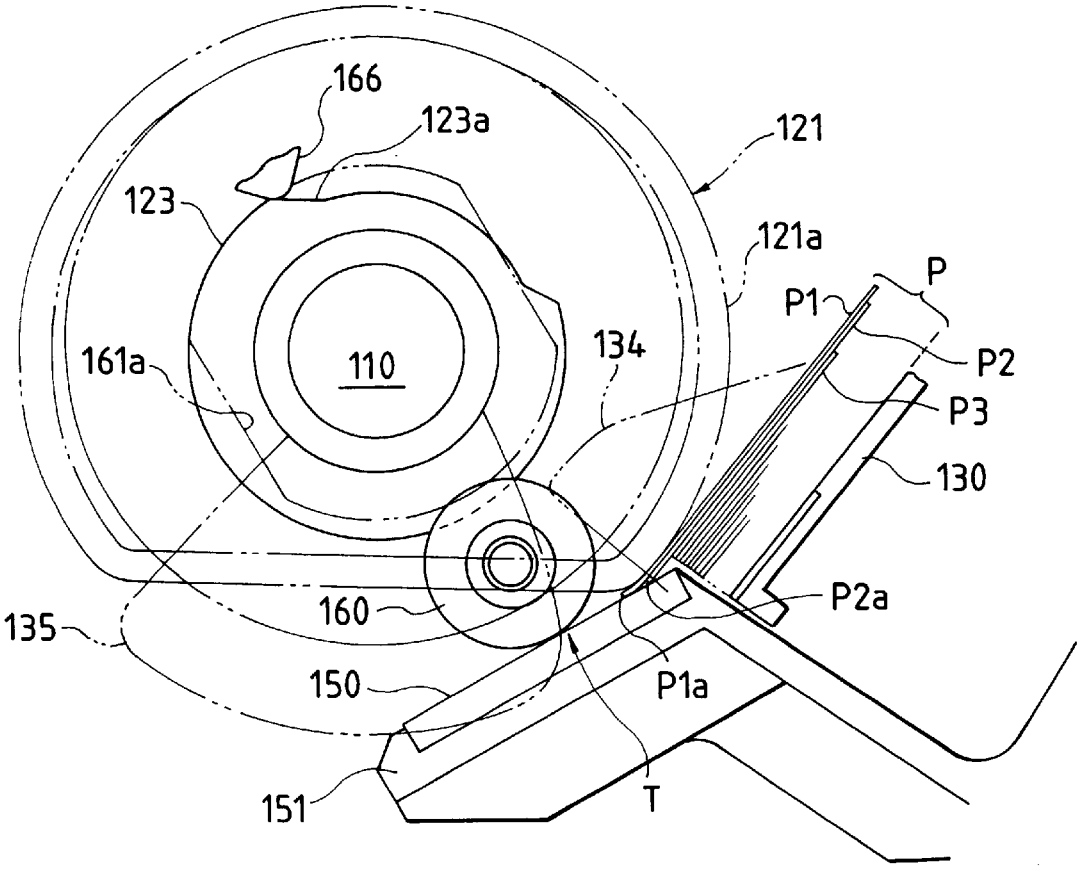

(iv) As shown in FIG. 15, since the circular-arch portion 121*a* of the sheet feed roller 121 is in contact with the uppermost sheet P1, the sheet feed roller shaft 110 continues rotating further to thereby feed the sheet P1 toward the separation pad 150. At this time, if the next sheet P2 is electrostatically attached to the sheet P1 or a frictional force acts between the sheets P1 and P2, the next sheet P2 may be fed in conjunction with the sheet P1. In this case, however, the front edge P2*a* of the sheet P2 comes into collision with the separation pad 150) so that the sheet P2 is prevented from moving further. As a result, the sheet P2 is temporarily separated from the sheet P1. Similarly, even if a sheet P3 below the sheet P2 is fed, it will be separated from upper sheets in an analogous manner. As is obvious from these descriptions, the term "next sheet" implies the sheet P3 or other sheets subsequent to the next sheet P2. In order to simplify an explanation, the term "next sheet" alone implies the "sheet P3 or other sheets" unless otherwise required.

At this point in time (i.e., at the point in time shown in FIG. 15), a slant face 123*a* of the cam 123 of the bush 122 comes into contact with the cam follower 166 of the idle roller holder 161. In contrast, the front edge P1*a* of the uppermost sheet P1 has not reached yet area T where the idle roller 160 comes into contact with the separation pad 150. This area T corresponds to the area where the circular-arch portion 121*a* of the sheet feed roller 121 comes into contact with the separation pad 160 (see FIG. 18).

Here, the other members of the sheet feeder still remain in the same state as that described in (iii).

Figure 16:
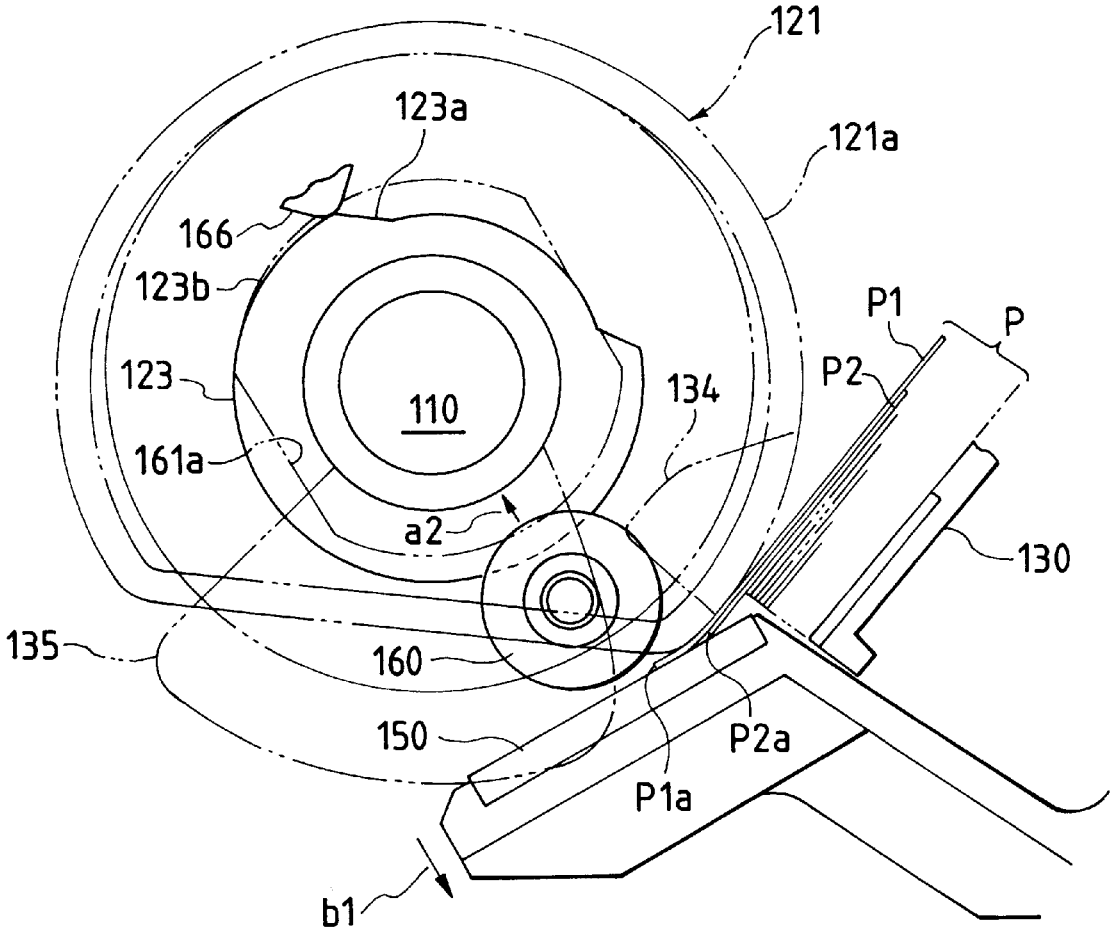

(v) As shown in FIG. 16, as a result of the Her continuous rotation of the sheet feed roller shaft 110, the circular-arch portion 121*a* of the sheet feed roller 121 presses the separation pad 150 via the uppermost sheet P1. As a result, the separation pad 150 is pushed down in the direction designated by arrow b1 against the urging force of the pad spring 156. At the same time, the uppermost sheet P1 is nipped between the circular-arch portion 121*a* of the sheet feed roller 121 and the separation pad 150 under the urging force of the pad spring 156. More specifically, the sheet P1 is fed while being nipped between the sheet feed roller 121 and the separation pad 150. As previously described, at this time, there may be a case where the next sheet P2 is fed together with the uppermost sheet P1. In this case, as previously described, the relationship of $\mu 1>\mu 2>\mu 3$ is satisfied, taking a coefficient of friction between the sheet feed roller 121 and the sheet P as $\mu 1$, a coefficient of friction between the sheet P and the separation pad 150 as $\mu 2$, and a coefficient of friction between the sheets of sheet as $\mu 3$. Therefore, even if the sheet P2 is nipped between the circular-arch portion 121*a* of the sheet feed roller 121 and the separation pad 150 together with the sheet P1 as the sheet feed roller 121 rotates, the sheet P2 is prevented from being fed by means of the frictional force developed between the sheet and the separation pad 150, thereby secondarily separating the sheet P2 from the sheet P1. As a result, the sheet P1 alone is fed.

Further, at this point in time (i.e., the point in time shown in FIG. 16), the cam follower 166 of the idle roller holder 161 is pushed up by the slant face 123*a* of the cam 123 and runs onto a circular-arch surface 122*b* of the cam 123. As a result, the idle roller 160 moves in the direction designated by arrow a2 and is brought out of contact with the separation pad 150. However, at this moment, the front edge P1*a* of the uppermost sheet P has not reached yet the area T where the idle roller 160 comes into contact with the separation pad 150 (see FIG. 15).

More specifically, when the front edge P1*a* of the sheet P1 to be fed passes through the space between the separation pad 150 and the idle roller 160, the idle roller 160 has already been brought out of contact with the separation pad 150.

The other members of the sheet feeder still remain in the same state as that described in (iii).

Figure 17:
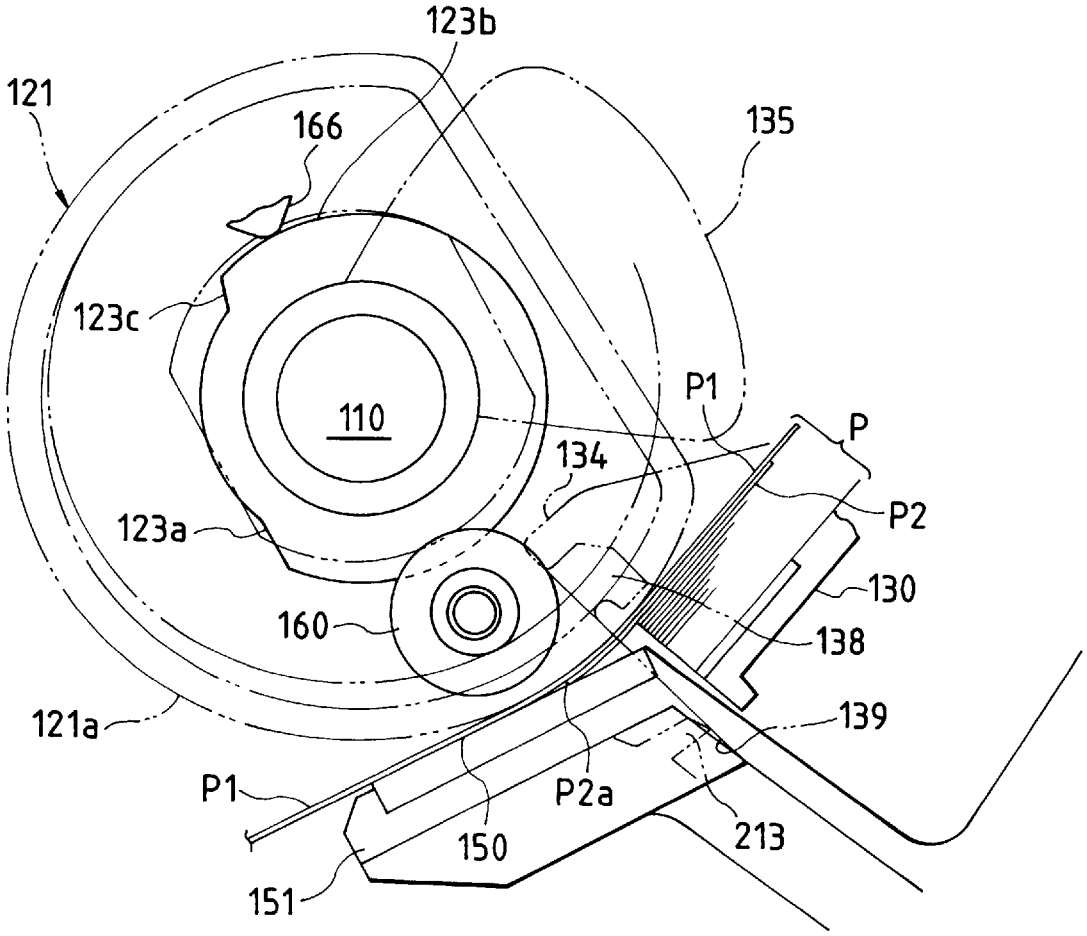

(vi) As shown in FIG. 17, as a result of the further continued rotation of the sheet feed roller shaft 110, the sheet P1 is fed further while being nipped between the sheet feed roller 121 and the separation pad 150. The sheet P1 is fed while the sheet reset lever 180 is pivoted counterclockwise, and the sheet reset lever 180 stays in a pivoted state in a counterclockwise direction until the rear edge of the sheet P1 passes through the nipping section between the sheet feed roller 121 and the separation pad 150.

At this point in time (i.e., the point in time shown in FIG. 17), the cam follower 166 of the idle roller holder 161 is positioned in the vicinity of the end of the circular-arch surface 128*b* of the cam 123.

Further, at this point in time, the sheet roller shaft 110 has performed substantially one rotation, and hence the hopper cam 135 has reached the position shown in FIG. 17. Accordingly, the front end 212 of the retaining lever 210 of the hopper retaining mechanism is disengaged from the hopper cam 135 and hence attempts to pivot in a clockwise direction in FIG. 3. However, the protuberance 213 of the front end 212 comes into contact with a front surface 189 of the hopper 130, so that the retaining lever 210 remains prohibited from pivoting clockwise (see a phantom line in FIG. 17).

The other members of the sheet feeder still remain in the same state as that described in (iii).

Figure 18:
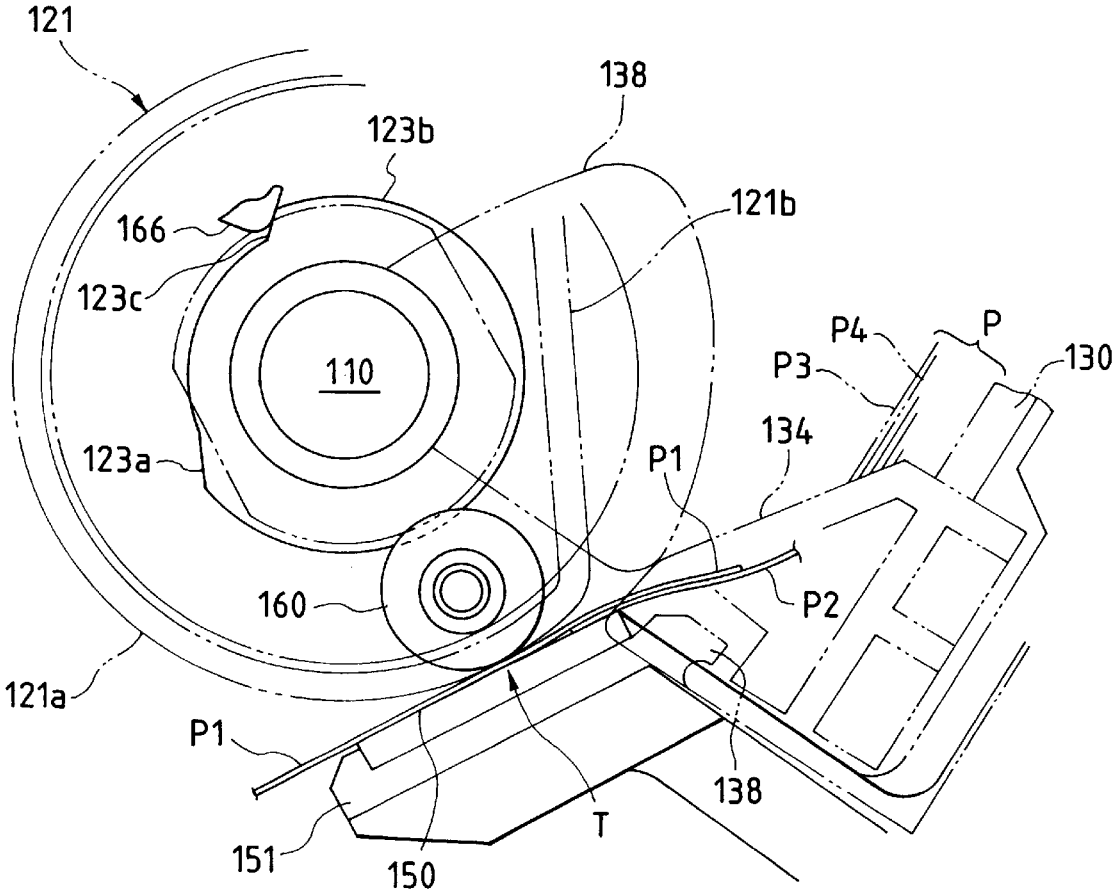

(vii) As shown in FIG. 18, as a result of the further continued rotation of the sheet feed roller shaft 110, the sheet P1 is fed further while being nipped between the sheet feed roller 121 and the separation pad 150.

At this point in time (i.e., the point in time shown in FIG. 18), the cam follower 166 of the idle roller holder 161 slides down the other slant surface 123*c* of the cam 123. The idle roller 160 is brought into contact with the separation pad 150 under the urging force of the roller spring 165. However, at this point in time, the circular-arch portion 121*a* of the sheet feed roller 121 still remains pressed against the separation pad 150 with the sheet P1 between them.

More specifically, the idle roller 160 is brought into contact with the separation pad 150 while the circular-arch portion 121*a* of the sheet feed roller 121 still remains in contact with the separation pad 150 with the sheet P1 between them Further, at this point in time, the front edge of the sheet P1 has reached a nipping section N (see FIG. 2) between the pair of conveyor rollers 2, 3 and has slightly passed through this nipping section N.

In the first embodiment, the sheet feed roller 121 is stopped at this point in time, and the pair of conveyor rollers 2, 3 that have continued rotating forwardly from the point in time in (ii) are temporarily rotated reversely, thereby reversely feeding the front edge of the sheet P1 to a position before the nipping section N (i.e., a position close to the sheet feed roller 121). The front edge P1 of the sheet P is brought line with the nipping section N between the pair of conveyor rollers 2, 3 by virtue of restoring force of the sheet resulting from its flexure caused when the sheet feed roller 121 is stationary, thereby correcting the position of the sheet P if the sheet P is obliquely fed.

Although the other members of the sheet feeder still remain in the same state as that described in (vi), the hopper 130 is pressed by the hopper cam 135.

(viii) The pair of conveyor rollers 2, 3 forwardly rotate, and the sheet feed roller 121 also rotates forwardly.

Figure 19:
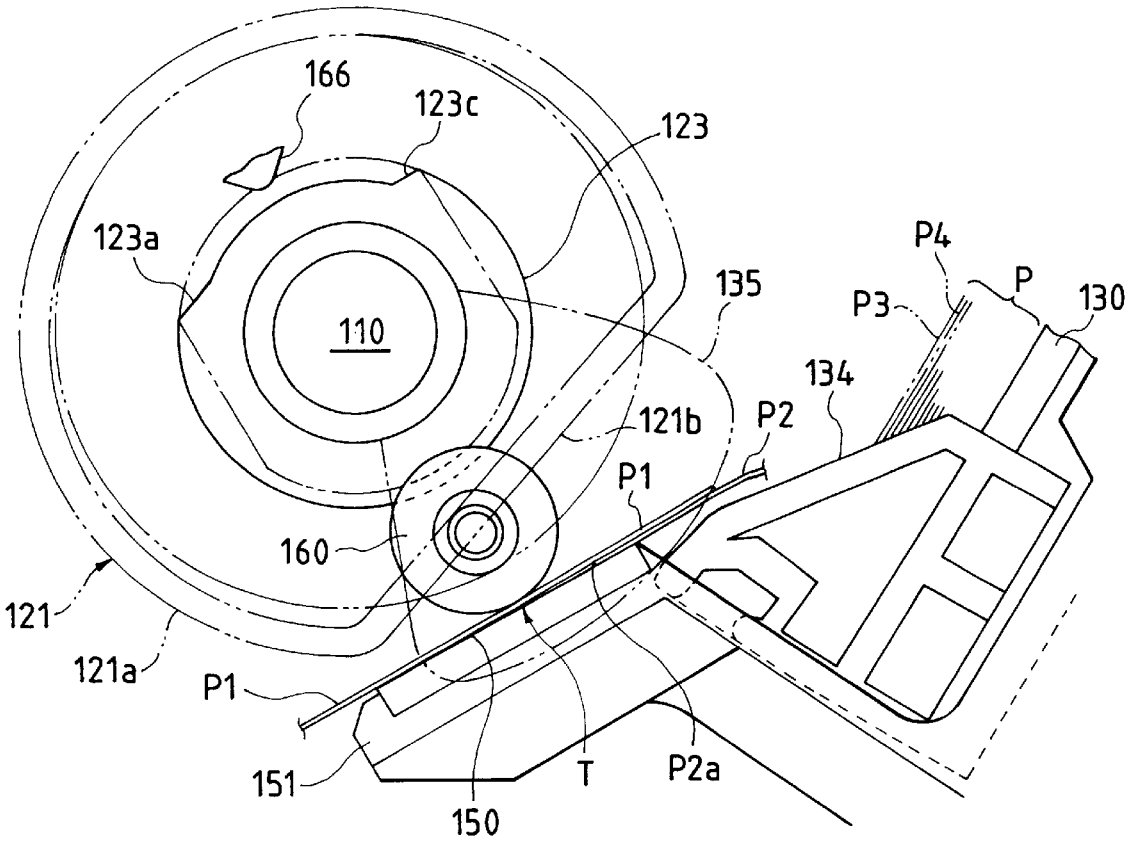

As shown in FIG. 19, if the sheet feed roller shaft 110 has finished performing one rotation exactly, it comes to rest. The sheet feeder SF then returns to a standby condition (or the state of the sheet feeder shown in FIG. 3). Here, the hopper 130 is placed in a pressed state.

In contrast, the pair of conveyor rollers 2, 3 continue rotating forwardly.

Since a part of the sheet P1 still remains in the sheet feeder SF at this point in time, the sheet P1 is conveyed by means of the conveyor rollers 2, 3 shown in FIG. 2 under the load exerted in the area T between the separation pad 150 and the idle roller 160 (or while the sheet P1 is pulled in a rearward direction) until the rear edge of the sheet P1 finishes passing through the area T.

In this case, the idle roller 160 is forced toward the separation pad 150 by means of the roller spring 166. Even if the next sheet P2 having already removed from the sheet P1 attempts to descend under its own weight or is electrostatically attached to and fed with the sheet P1 by means of the frictional force developed between the sheets P1 and P2, this will be prevented, for the sheet P1 being nipped between the idle roller 160 and the separation pad 150.

However, as shown in FIG. 20, if the sheet is comparatively slippery, subsequent sheets P2 to P5 cause a so-called avalanche during the course of rotation of the sheet feed roller 121 (i.e., the course during which the sheet feeder changes from the state shown in FIG. 14 to the state shown in FIG. 19), for a plurality of sheets of sheet being stacked on the hopper 130 inclined state. As a result, the thus-avalanched sheets may burrow into, or attempt to burrow into, the space between the idle roller 160 and the separation pad 150.

If the uppermost sheet P1 is continuously fed in this state, the subsequent sheets P2 to P5 take the form of a wedge W as if they were integrated, thereby imposing a risk of the uppermost sheet P1 being locked during the course of the conveyance process. Further, given that the sheet P1 is conveyed without being locked, if an attempt is made to feed another sheet in this state (or if the sheet P2 is fed), a subsequent sheet (the sheet P3 or subsequent sheets) may become apt to be fed together th the sheet P2 (or subsequent sheets may become apt to be fed in an overlapped manner).

Figure 21:
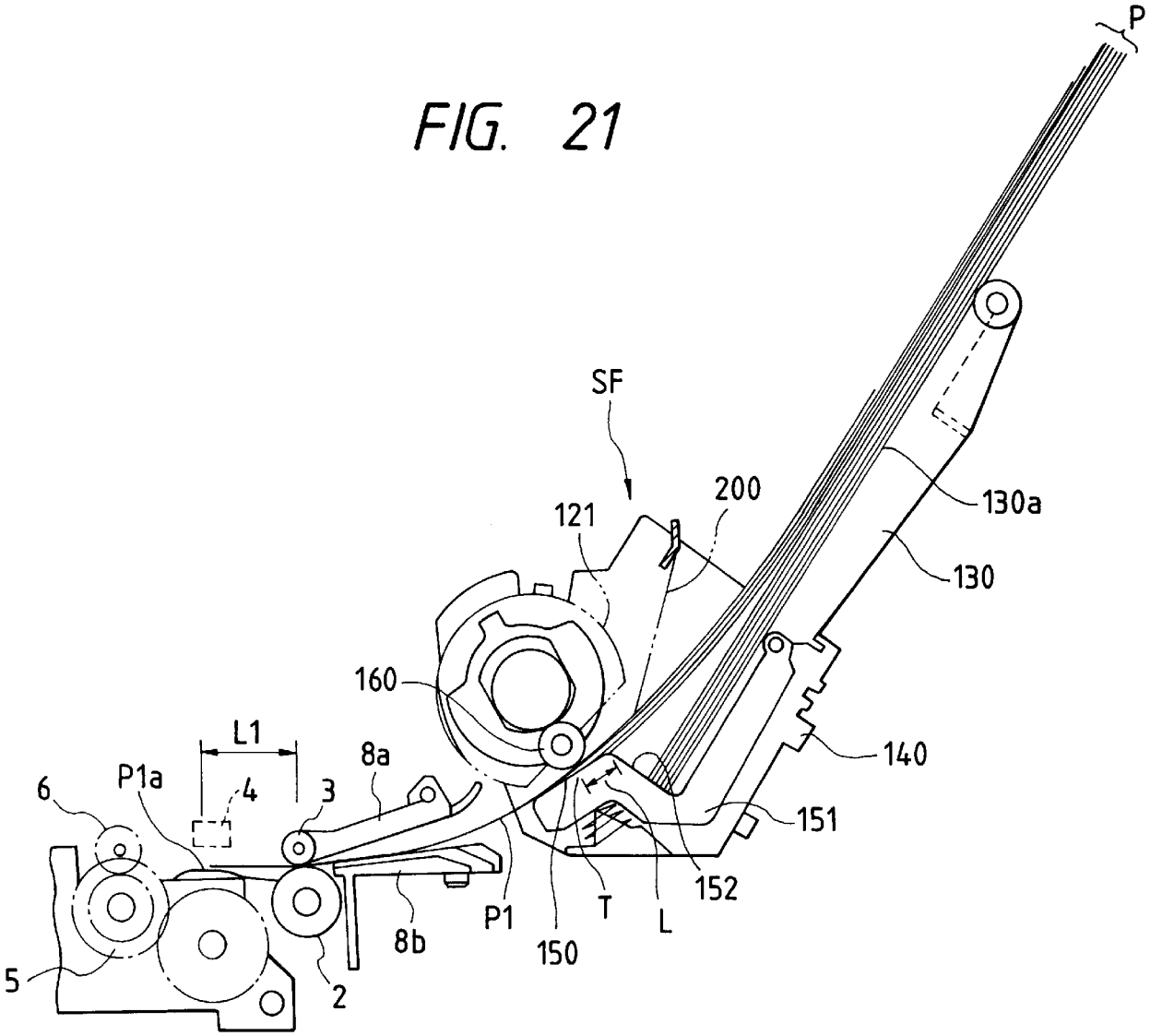
Figure 22:
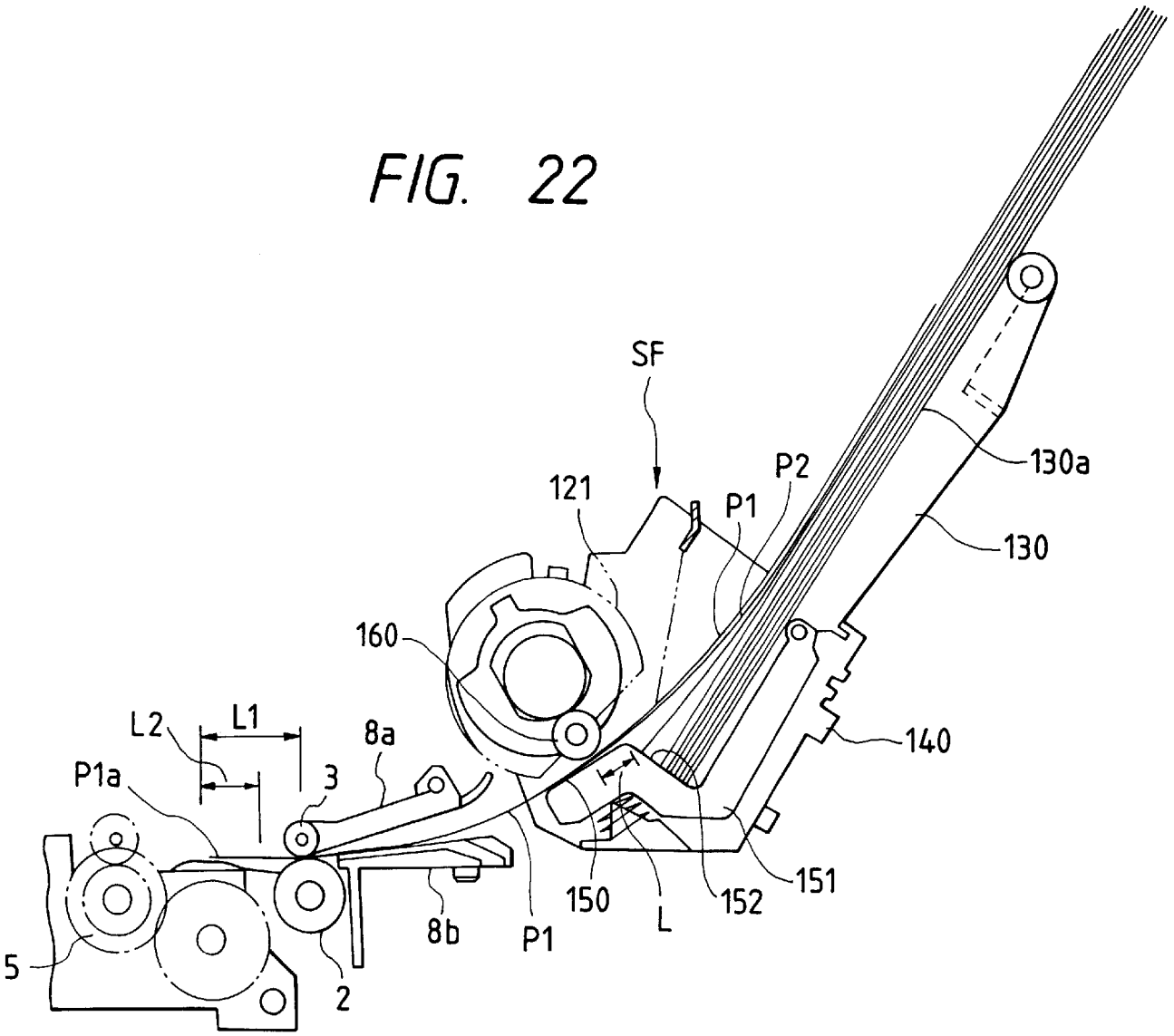

To prevent this problem, as shown in FIG. 21, the conveyor rollers 2,8 in the first embodiment carry the front edge P1*a* of the sheet P1 over a distance L or more between the support surface 152 in the feed path of sheet and the area T where the separation pad 150 comes into contact with the idle roller 160. Subsequently, as shown in FIG. 22, the conveyor rollers 2, 3 are temporarily rotated reversely to feed the sheet P1 over a length L2 alone. Although the length L2 over which the sheet P1 is reversely fed is set so as to become larger than the length L in the first embodiment, these lengths L and L2 may be set equally. In other words, it is only essential that the lengths be set so as to satisfy a relationship of L1≧L2≧L3.

Figure 23:
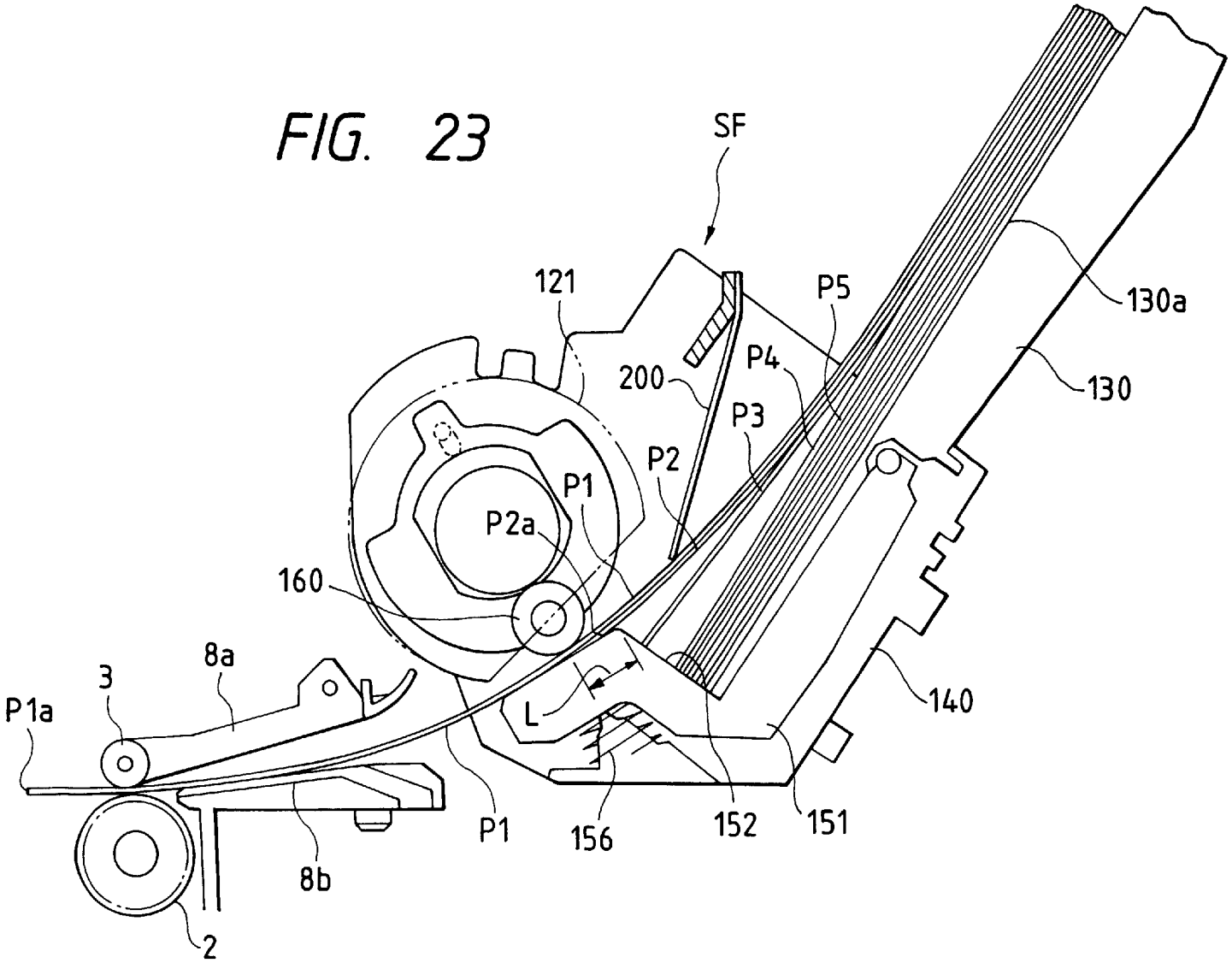

As shown in FIGS. 22 and 23 (wherein FIG. 23 is an enlarged view showing a part of components shown in FIG. 22), if the sheet P1 is reversely fed, the subsequent sheets P2 to P5 are forcibly reset by the uppermost sheet P1.

More specifically, frictional force Fw develops between the sheet P1 to be fed and the subsequent sheet P2 in the wedge-shaped area W shown in FIG. 20 (or between the sheets P2 and P3), and the hopper 130 is in an inclined state. Further, resetting force and frictional force (these forces are represented as composite Fp) develop in a flexure of the sheet P1 resulting from the reverse feeding of the sheet. By virtue of these factors, the subsequent sheets P2 to P5 are forcibly reset. At this time, the sheet 200 forces the sheet P loaded on the hopper 130 toward the support surface 130*a* of the hopper 130. Therefore, the composite force Fp that comprises the resetting force and the frictional force and develops in the flexure is increased, thereby rendering the subsequent sheets P2 to P5 easy to be reset forcibly.

The extent of resetting of the sheet, or the distance L2 over which the uppermost sheet P1 is reversely fed, is equal to or greater than the length L between the area T and the support surface 152. Of the plurality of sheets P2 to P5 burrowing into the area T, at least a part of the sheets (P3 to P5 shown in FIG. 28) are forcibly reset until their front edges are brought in alignment with the support surface 152.

Consequently, if the uppermost sheet P1 is again fed by forward rotation of the conveyor rollers 2, 3, the same number of sheets as those described above are prevented from burrowing in the form of a wedge W into the area T between the separation pad 150 and the idle roller 160.

After having been reversely rotated, tie conveyor rollers 2, 3 are forwardly rotated to feed the sheet P1.

A print is produced on the thus-conveyed sheet P1 by means of the head 4, and the printed sheet is discharged from the printer by means of the pair of discharge rollers 5, 6.

Figure 28:
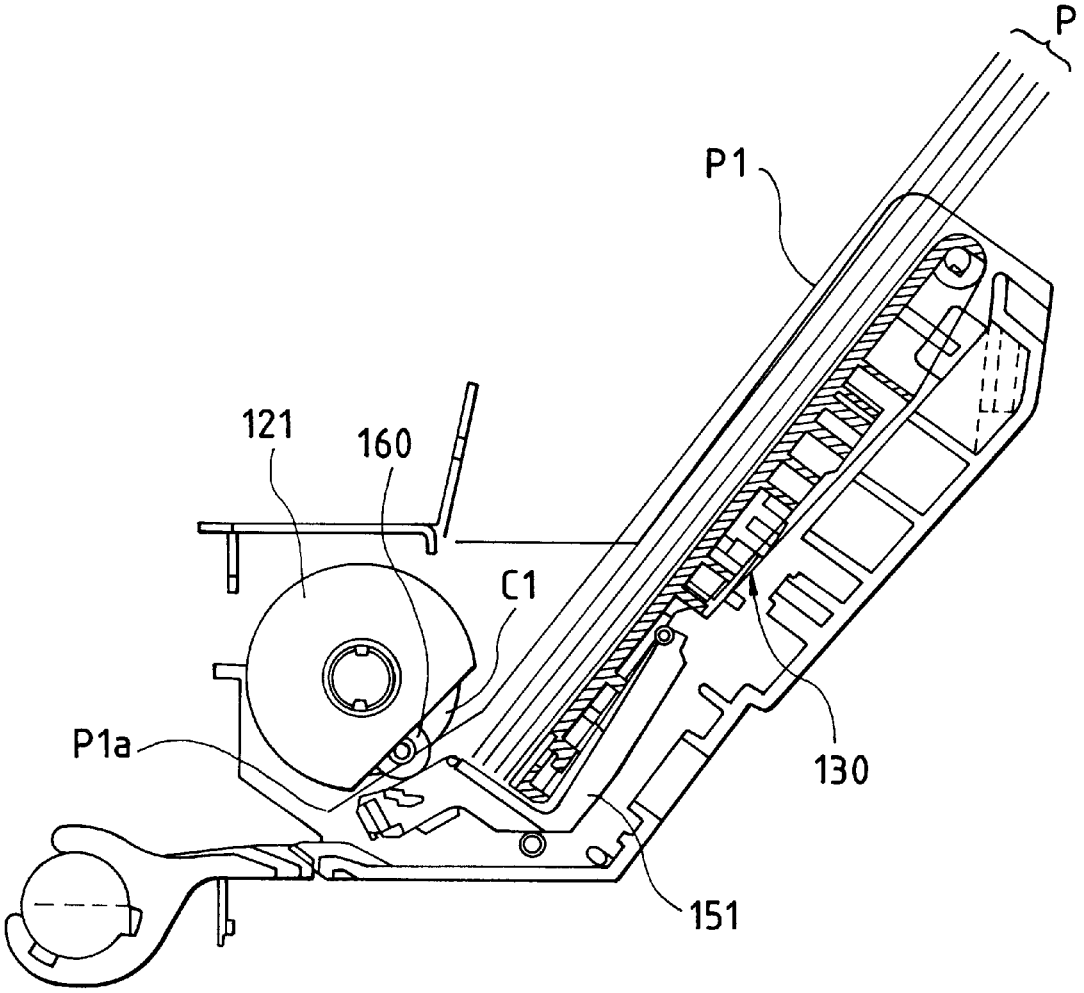

(ix) After the rear edge of the thus fed-and-conveyed sheet P1 has been fully discharged from the sheet feeder SF, sheet is fed again, as required. The hopper 130 of this sheet feeder is inclined, and the plurality of sheets P are stacked on the hopper 130. With this arrangement, once sheet feeding operation has been commenced, there may be a case where, even if the conveyor rollers 2, 3 has reset the subsequent sheets, as already described in (x), the front edge P2*a* of the incompletely-reset second sheet P2 may descend to a position in the vicinity of the area T between the separation pad 150 and the idle roller 160, as shown in FIG. 28. Further, if the sheet is a slippery film, or the like, it is difficult to deny the possibility of the front edge P2*a* passing through the area T. If the sheet feeding operation is repeated in this state, the sheet P3, or other subsequent sheets, burrows into the space between the sheet feed roller 121 and the separation pad 150, and the next sheet P4 burrows into the space. In this way, there arises cumulative entry of subsequent sheets. As a result, even if the sheet feeder is provided with the idle roller 160 and the conveyor rollers 2, 3 reset sheets, as previously described, sheets which are not intended to be fed pass through the area T between the idle roller 160 and the separation pad 160. Therefore, there may arise a case where thus-burrowed sheets are fed together with the uppermost sheet (or a plurality of sheets are conveyed in an overlapped manner).

To prevent such a problem, the printer in accordance with the first embodiment initially resets sheet in Step (i) before feeding the sheet, as previously described. Specifically, the sheet resetting operation is performed prior to the execution of the operation in Step (ii).

The sheet resetting operation is as follows:

(i-1) The sheet feed roller shaft 110 in the standby condition (shown in FIGS. 3 and 19) commences counter-clockwise rotation (i.e., reverse rotation). As a result, the sheet feed roller 121, the bush 122, and the hopper cam 135 also commence reverse rotation.

Figure 24:
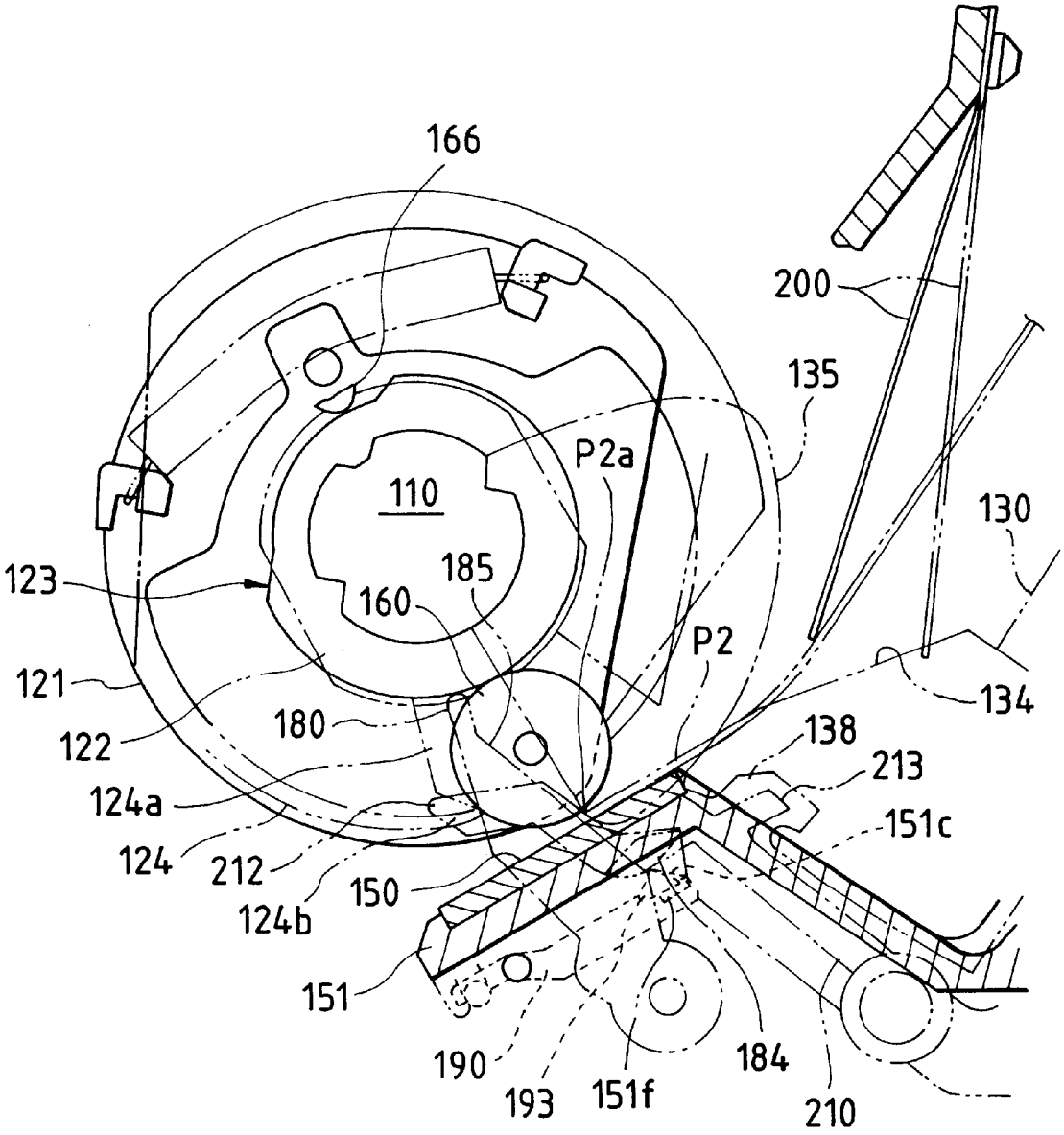

As shown in FIG. 24, after the sheet feed roller 121, the bush 122, and the hopper cam 135 have finished reversely rotating through a predetermined angle together with the sheet feed roller shaft 110, the sheet reset lever 180 is pushed by the angular portion 124*b* of the disk 124 of the bush 122 and pivots clockwise, so that the rear edge 185 of the sheet reset lever 180 forcibly resets the front edge P2*a* of the sheet P2 to its original position. The protruding cam 184 of the sheet reset lever 180 comes into contact with and pushes down the lug 193 of the separation lever 190. Since the lug 193 is in contact with the lower edge 151*f* of the window 151*c* of the separation pad holder 151, the separation pad 150 is eventually pushed down. As shown in the drawings, the separation pad 150 is brought out of contact with the sheet feed roller 121 and the idle roller 160. The reason for the separation of the separation pad 150 from the sheet feed roller 121 and the idle roller 160 is as follows: As previously described, if the sheet is a slippery film, or the like, there may be a case where the front edge P2*a* of the next sheet P2 has already passed through the area T. In such a case, even if an attempt is made to forcibly reset the sheet P2 to its original position by means of the sheet reset lever 180 without separating the separation pad 150 from the sheet feed roller 121 and the idle roller 160, the sheet P2 cannot be smoothly reset.

The downward movement of the idle roller 160 is inhibited by means of the cam follower 166 of the idle roller holder 161 remaining in contact with the cam 123.

At this point in time (or the point in time shown in FIG. 24), the cam follower 134 of the hopper 180 stays in contact with the hopper cam 186, and hence the hopper 130 is in a pressed state. The front edge 212 of the retaining lever 210 of the hopper retaining mechanism is disengaged from the hopper cam 135 and pivots clockwise. The protuberance 218 is engaged with the recess 138 of the hopper 130.

Figure 25:
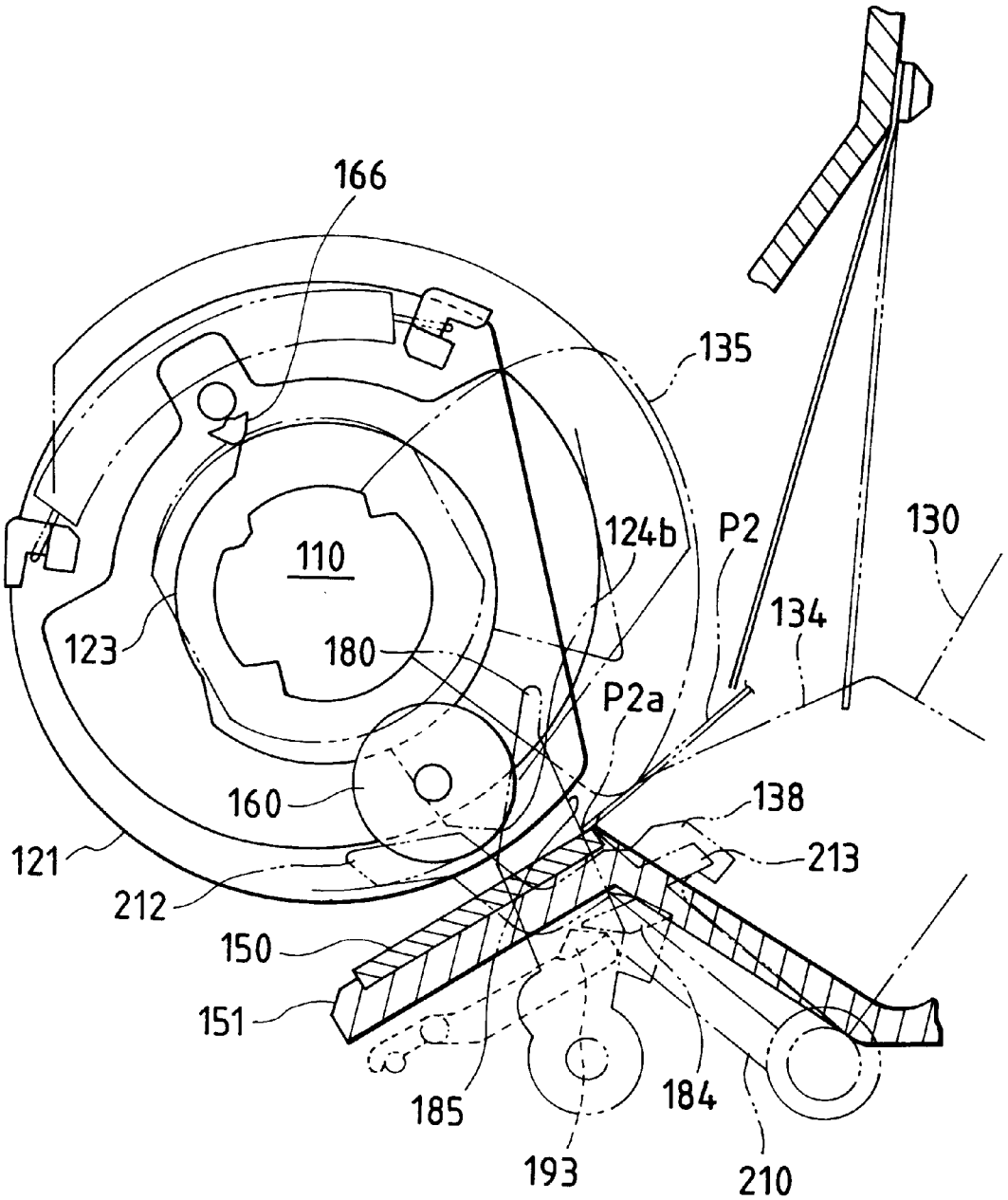

(i-2) As shown in FIG. 25, as a result of the further continued reverse rotation of the sheet feed roller shaft 110, the sheet reset lever 180 pivots clockwise further. The rear edge 185 of the sheet reset lever 180 forcibly resets the sheet P2 to its original position The protruding cam 184 of the sheet reset lever 180 stays in contact with and keeps pressing the lug 193 of the separation lever 190. Consequently, the separation pad 160 is kept out of contact with the sheet feed roller 121 and the idle roller 160.

The cam follower 134 of the hopper 130 is in contact with the hopper cam 135, and hence the hopper 130 remains in a pressed state. Further, the protuberance 213 of the retaining lever 210 also remains engaged with the recess 138 of the hopper 130.

Figure 26:
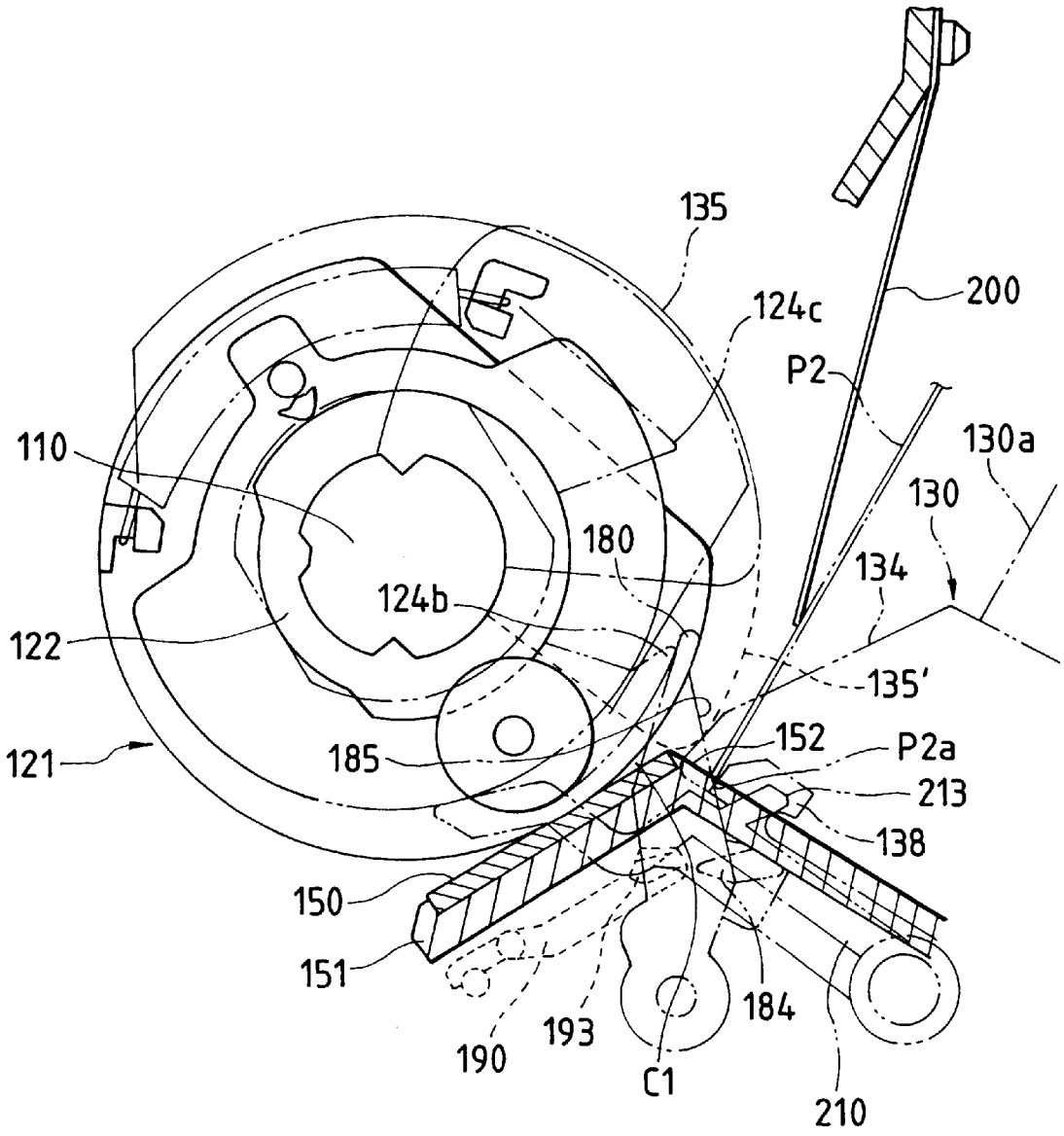

(i-3) As shown in FIG. 26, as a result of the further continued reverse rotation of the sheet feed roller 110, the sheet reset lever 180 pivots clockwise further, and the rear edge 185 of the sheet reset lever 180 completely resets the sheet P2 to its original position. More specifically, the sheet reset lever 180 forcibly resets the sheet P2 in such a way that the front edge P2*a* of the sheet P2 reaches a position behind the support surface 152. As a result, the sheet P2 is completely reset on (or placed on) the hopper 130 under its own weight, as well as by means of the sheet 200 forcing the sheet P (i.e., the sheet P2) toward the sheet support surface 130*a* of the hopper 130.

During the course of the operation up to this point in time, the hopper cam 185 is disengaged from the cam follower 134 of the hopper 130, and the hopper 180 attempts to move upward. Since the protuberance 211 of the retaining lever 210 is engaged with the recess 138 of the hopper 130, the hopper 130 cannot move upward and hence still remains in a pressed state (or the state of the sheet feeder shown in FIG. 26). Consequently, the sheet is reliably reset on the hopper. Such retaining action of the hopper 130 is ensured even if the profile of the hopper 130 is changed; namely, if the shape of the hopper is changed to another shape (designated by a phantom line 135) which enables the hopper 130 to come into contact with the cam follower 184 even when the sheet feed roller shaft 110 reversely rotates, as shown in FIG. 26. However, if the shape of the hopper 130 is changed to such a shape, the hopper 130 is immediately pressed at the time of the foregoing sheet feeding operation (i.e., the hopper is pressed before changing to the state of the sheet feeder shown in FIG. 17). The period of time during which a sheet is brought into contact with the sheet feed roller 121 under the raising force of the hopper 130 becomes insufficient, thereby resulting in a risk of unreliable sheet feeding operation.

As a result of the sheet reset lever 180 having completely finished pivoting clockwise, the protruding cam 184 is disengaged from the lug 193 of the separation lever 190. Consequently, although the separation pad 150 becomes possible to move upwardly, the upward movement of the separation pad 150 is inhibited at this point in time, for the separation pad coming into contact with the sheet feed roller 121.

As described above, although the sheet P2 is completely reset to its original position on the hopper 130 in the first embodiment, the foregoing cumulative entry of subsequent sheets is prevented by forcibly resetting at least the front edge P2*a* of the next sheet P2 to a position behind the area T between the idle roller 160 and the separation pad 150.

After the completion of the foregoing sheet resetting operation, the sheet feed roller shaft 110 rotates forwardly, and the sheet feeding operation related to Step (ii) or subsequent steps is performed by way of the aforementioned standby condition. If the sheet feed roller shaft 110 forwardly rotates after the sheet resetting operation, the sheet reset lever 180 pivots counterclockwise under the urging force of the torsion spring 182, as well as by being pushed by the angular portion 124*c* of the disk 124 of the bush 122. At this time, the protruding cam 184 of the sheet reset lever 180 comes into contact with and raises a lower surface of the lug 193 of the separation lever 190 (or pivots the separation lever 190 counterclockwise). After that, the protruding cam 184 passes by the lug 193.

The following advantageous results will be obtained as a result of the operation of the sheet feeder and/or printer having the foregoing construction (a) The sheet feeder comprises the sheet feed roller 121 that has the circular-arch portion 121*a* and the linear portion 121*b* and performs one forward rotation at the time of the sheet feeding operation, and which sheet feed roller 121 has a substantially D-shaped lateral cross section; the hopper 130 which supports a plurality of sheet P to be fed on contact with the circular-arch portion 121*a* of the sheet feed roller 121 and brings a sheet into pressed contact with the sheet feed roller 121 at the time of forward rotation of the sheet feed roller 121; the separation pad 150 which is on the course of rotation of the circular-arch portion 121*a* of the sheet feed roller 121 and is forced toward the sheet feed roller 121 by means of the pad forcing means 156, and which pad separates a sheet P1 to be fed by the sheet feed roller 121 from the next sheet P2 by nipping the sheet P1 between the separation pad 150 and the circular-arch portion 121*a;* and the conveyor rollers 2, 3 for conveying the sheet P1 fed by the sheet feed roller 121. With this arrangement, the uppermost sheet P1 alone is fed at the time of the sheet feeding operation, and the thus-fed sheet P1 is conveyed by means of the conveyor rollers 2, 3.

(b) Since the sheet P is stacked on the hopper 130 in an inclined state, the footprint required for this sheet feeder or printer is reduced.

Since the sheet P is stacked on the hopper 130 in an inclined state, the next sheet P2 also slides toward the sheet feed roller 121 when the uppermost sheet P1 is fed. However, the downward movement of the next sheet P2 is inhibited by a nipping section when the circular-arch portion 121*a* of the sheet feed roller 121 is in pressed contact with the separation pad 150 (see FIG. 15 or the like).

Since the sheet feed roller 121 comprises the circular-arch portion 121*a* and the linear portion 121*b* and has a substantially D-shaped lateral cross section, the circular-arch portion 121*a* is brought out of contact with the separation pad 150 during the course of one rotation of the sheet feed roller 121. The linear portion 121*b* is opposite to the separation pad 150. More specifically, if the nipping section is obviated, the next sheet P2 attempts to descend. However, the idle roller 160 comes into contact with the separation pad 150 at this time, thereby hindering the downward movement of the next sheet P2. As a result, the downward movement of the next sheet P2 is inhibited (see FIG. 19).

The sheet feeder has the support surface 152 for supporting the front edge Pa of the sheet P stacked on the hopper 130. Further, after having conveyed the front edge P1*a* of the sheet P1 over the distance L or more between the support surface 152 in the path of transfer of the sheet and the area T between the separation pad 150 and the idle roller 160, the conveyor rollers 2, 3 temporarily rotates reversely to convey the sheet at least over the distance L between the support surface 162 and the area T between the separation pad T and the idle roller 160. Therefore, even if a plurality of sheets (P2 through P5) attempt to enter in the form of a wedge the area T between the idle roller 160 and the separation pad 150 at the point in time when the sheet feeding operation is completed, the sheets (P2 through P5) will be forcibly reset to their original positions as a result of reverse rotation of the uppermost sheet P1. In this case, frictional force Fw develops between the sheet P1 to be fed and the subsequent sheet P2 in the wedge-shaped area W, and the hopper 130 is in an inclined state. Further, composite force Fp which consists of resetting force and frictional force developed in a flexure of the sheet P1 resulting from the reverse feeding of the sheet. By virtue of these factors, the subsequent sheets (i.e., the plurality of sheets) are forcibly reset.

The extent over which the sheets are forcibly reset; namely, the extent over which the uppermost sheet is reversely fed, is set equal to at least the distance between the support surface 152 and the area T between the separation pad 150 and the idle roller 160 ($L2 \geqq L1$). Of the plurality of sheets attempting to burrow into the area T, at least a part of them are forcibly reset until the front edges of the sheets are placed on the support surface 152.

Consequently, even if the conveyor rollers 2, 3 resume forward rotation and feed the uppermost sheet P1, the same number of the sheets as those previously described are prevented from entering in the form of a wedge the area T between the separation pad 150 and the idle roller 160 at one time.

As a result, the need for increasing the nipping force exerted between the separation pad 150 and the sheet feed roller 121 or the idle roller 160 is eliminated.

More specifically, in spite of the fact that the sheet feed roller 121 has a D-shaped cross section and the sheet P is stacked in an inclined state, the printer prevents the next sheet P2 from entering in the form of a wedge the area T between the sheet feed roller 121 and the separation pad 150, thereby ensuring separation of sheet.

As described above, the sheet feeder or printer in accordance with the first embodiment enables sheets of the sheet P stacked in an inclined state to be thoroughly fed one by one without increasing a drive force and load (i.e., a back tension) through use of a separation pad method.

(c) Further, this sheet feeder has the pin 141 that serves as pad control means and differs from the idle roller 160 in order to inhibit the movement of the separation pad 150 toward the sheet feed roller 121 when a sheet is not nipped between the separation pad 150 and the circular-arch portion 121*a* of the sheet feed roller 121. As a result, this pad regulation means 141 receives the urging force of the pad forcing means 156.

Accordingly, the roller forcing means 165 obtains the contact pressure developed between the idle roller 160 and the separation pad 150. Since the urging force produced by the roller forcing means 165 is smaller than that produced by the pad forcing means 166, the nipping force exerted on the sheet can be reduced in comparison with that employed in the existing sheet feeder.

Figure 36:
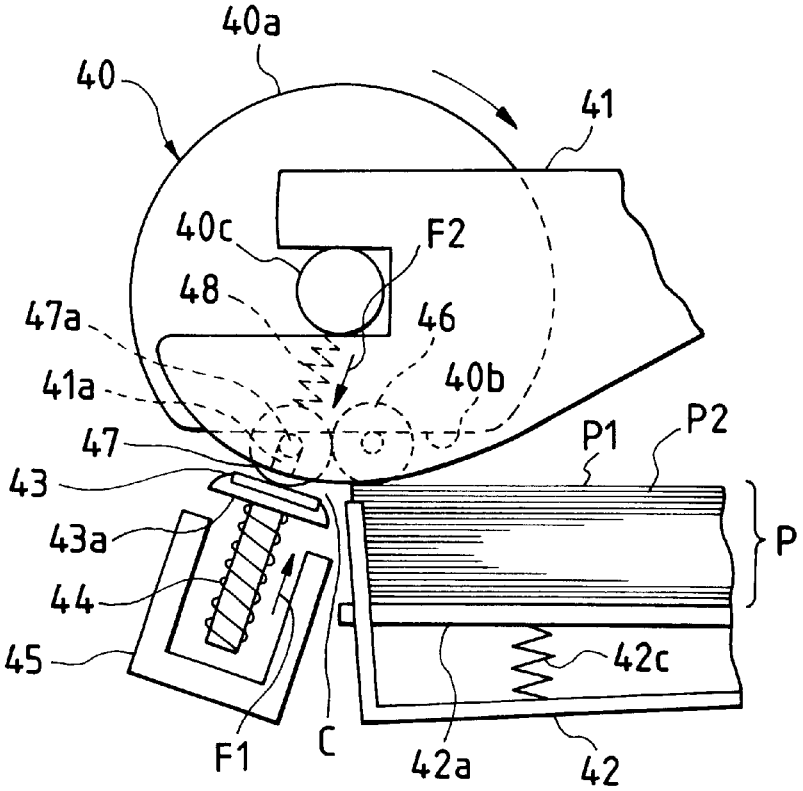
Figure 35A:
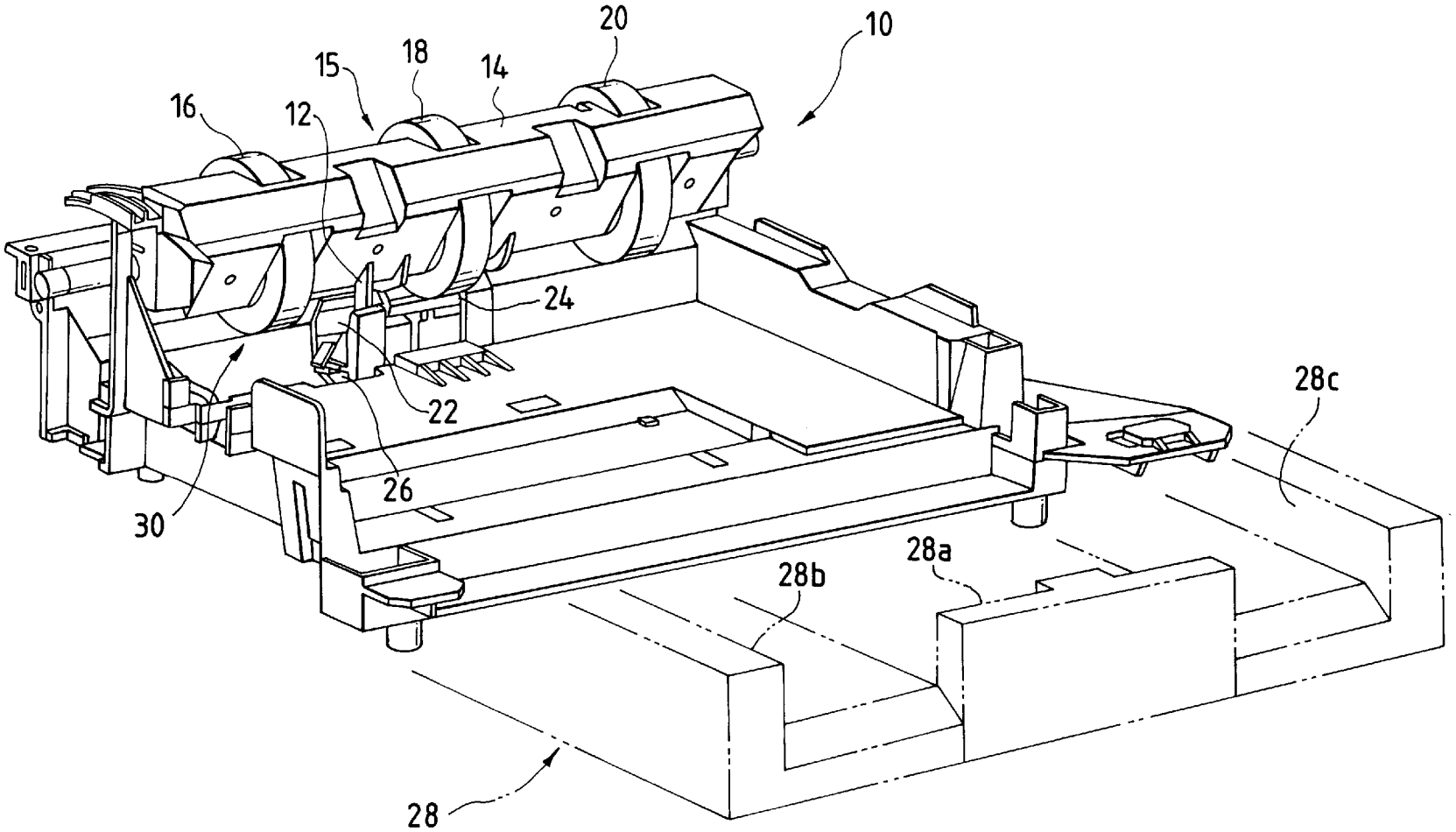
Figure 35C:
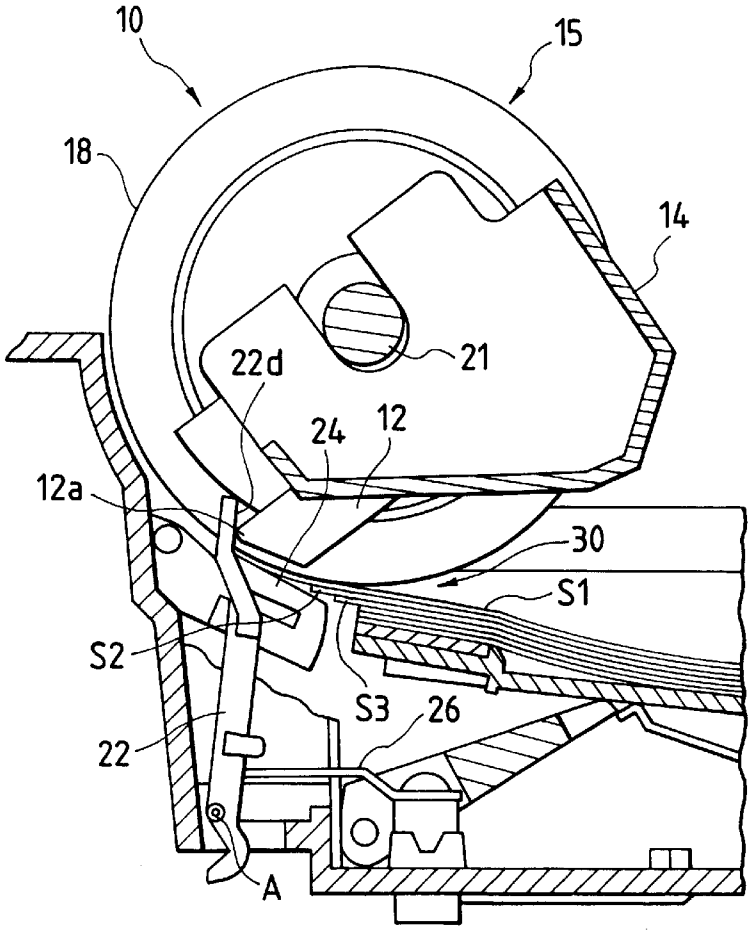
Figure 35B:
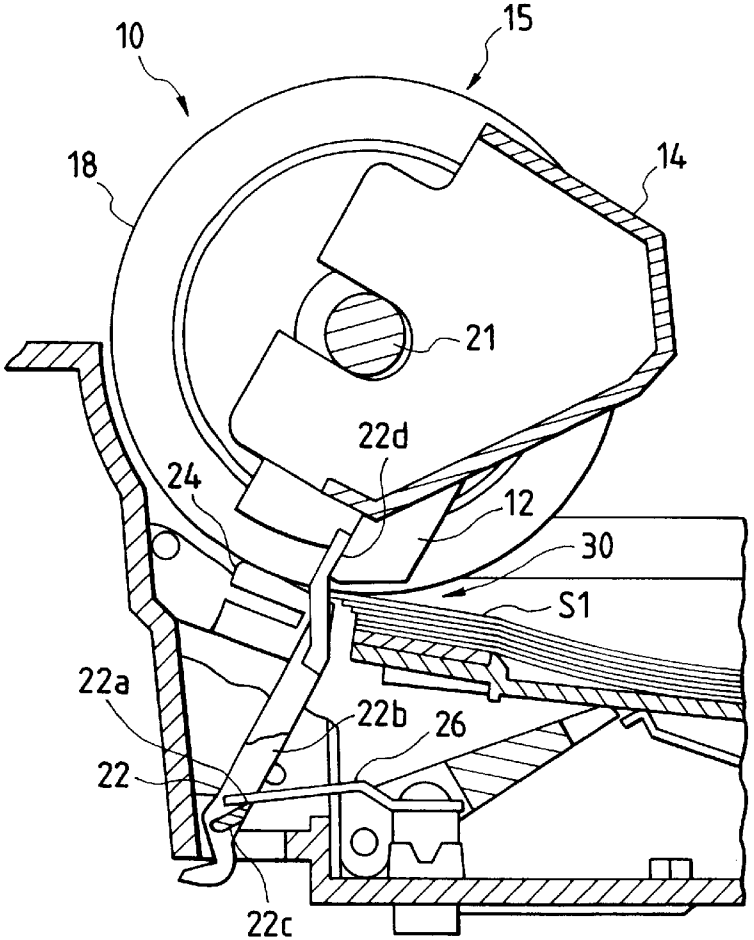
Figure 35E:
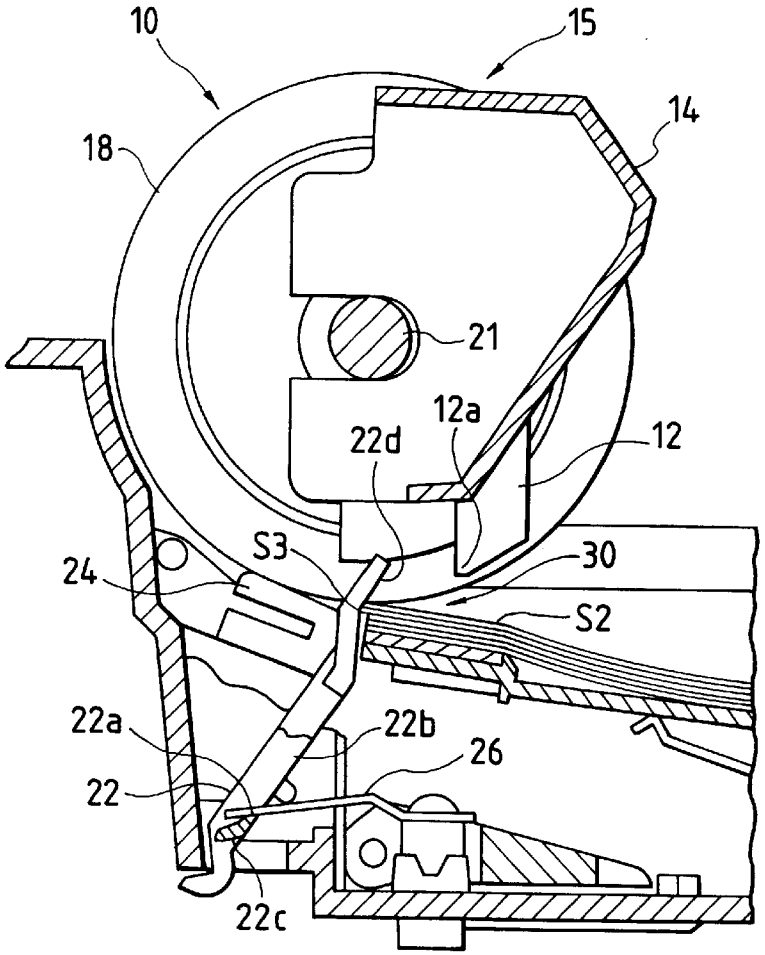
Figure 35D:
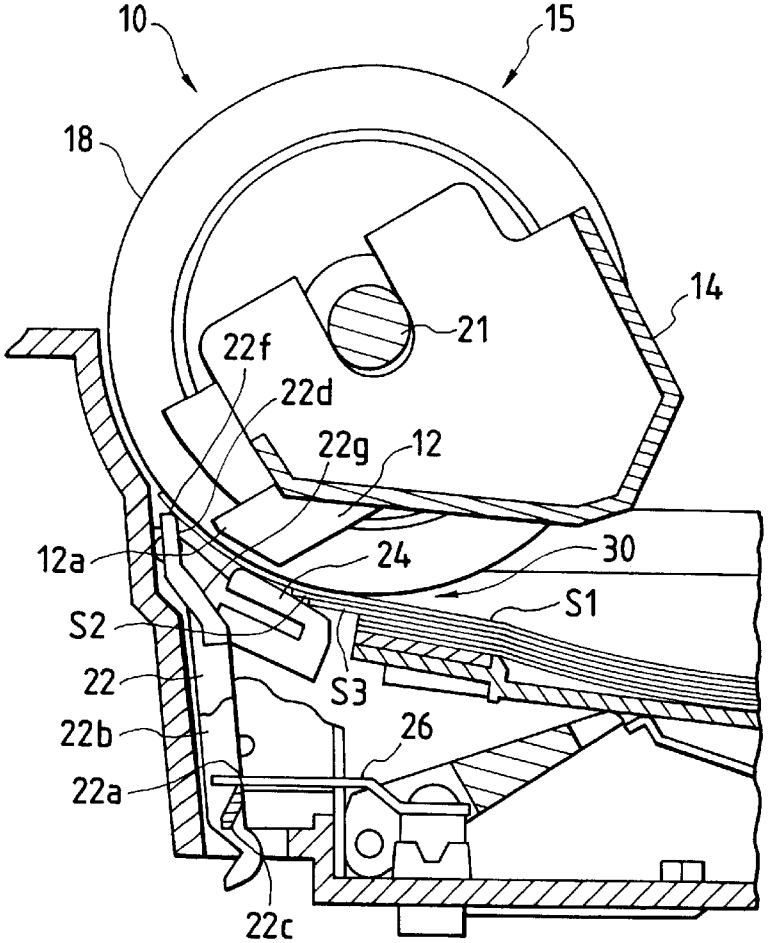

More specifically, as previously described, the urging force F1 of the spring 44 of the separation pad 43 is set so as to become greater than the urging force F2 of the spring 48 of the movable idle roller 47 in the conventional sheet feeder shown in FIG. 36. The sheet feed roller 40 performs one rotation at the time of the sheet feeding operation and changes to the state of the roller shown in FIG. 36 (i.e., the circular-arch portion 40*a* is out of pressed contact with the separation pad 43). The separation pad 43 comes rest while the shaft 47*a* of the movable idle roller 47 holds the movable idle roller 47 in a raised position, where it comes into contact with the upper edge of the elongated groove 41*a*.

Figure 34:
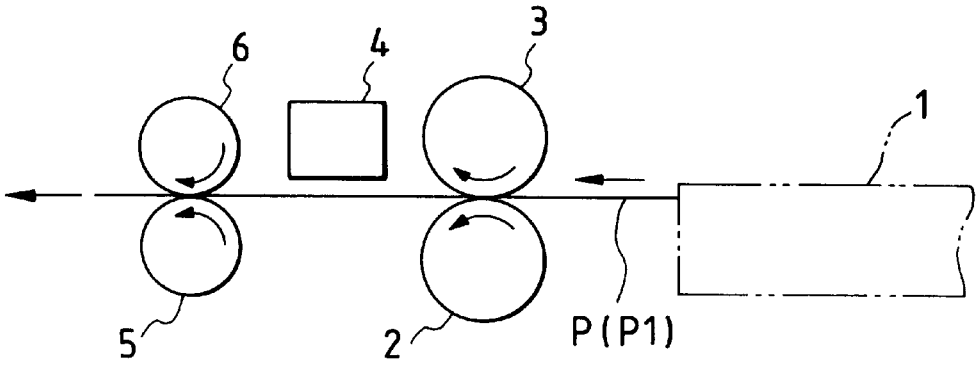
FIGS. 34, 35A–35E and 36 are schematic representations showing an existing sheet feeder.

In other words, the conventional sheet feeder is designed to convey the sheet P1 by means of; e.g., the conveyor rollers 2, 3 shown in FIG. 34, while a rear portion of the sheet P1 is nipped between the separation pad 43 and the movable idle roller 47 under the urging force F1 of the spring 44 of the separation pad 43.

As previously described, the separation pad 43 is intended to prevent two or more sheets from being fed when one sheet is nipped between the circular-arch portion 40*a* of the sheet feed roller 40 and the separation pad 43. For this reason, the urging force F1 of the separation pad 43 must be set comparatively great (so as to become greater than at least the urging force F2 of the movable idle roller 47, as previously described).

Since the conventional sheet feeder has a construction in which a rear portion of the sheet P1 is nipped under this comparatively greater urging force F, greater load is exerted on the nipping section. Further, if an attempt is made to prevent the aforementioned cumulative entry of subsequent sheets by means of the movable idle roller 47, there is no alternative way but to increase the urging force F2 of the movable idle roller 42.

In contrast, the sheet feeder SF in accordance with the first embodiment has the pad regulation means 141 that is different from the idle roller 160 and inhibits the movement of the separation pad 150 toward the sheet feed roller 121 when the sheet P1 is not nipped between the separation pad 150 and the circular-arch portion 121*a* of the sheet feed roller 121. As a result, this pad regulation means 141 receives the urging force of the pad forcing means 156.

Accordingly, the roller forcing means 165 obtains the contact pressure developed between the idle roller 160 and the separation pad 150. The urging force produced by the roller forcing means 165 is smaller than that produced by the pad forcing means 156. In short, the urging force of the roller forcing means 165 can be set to comparatively small urging force which inhibits the movement of the next sheet P2 in such a way that the next sheet P2 fails to reach the position to which the next sheet P2 cannot be forcibly reset by the pivotal movement of the sheet reset lever 180. Therefore, the nipping force exerted on the sheet between the idler roller 160 and the separation pad 150 can be reduced in comparison with that employed in the existing sheet feeder. As a result, the load exerted on the sheet P1 after the feeding of the uppermost sheet P1 can be reduced.

(d) The sheet feeder has the sheet reset lever 180 that is rearwardly pivoted so as to forcibly reset the next sheet P2 in a rearward direction in such a way that the front edge P2*a* of the next sheet P2 is placed in a location in a rearward direction in relation to the area T where the sheet feed roller 160 comes into contact with the separation pad 150, after the passage of the rear edge of the uppermost sheet P1 fed by the sheet feed roller 121. Provided that there is a sheet incompletely reset to its original position by means of the conveyor rollers 2, 3, the front edge (i.e., the front edge P2*a*) of the sheet (i.e., the next sheet P2) is forcibly reset in a rearward direction to a position behind the area T between the idle roller 160 and the separation pad 150 as a result of reverse pivotal movement of the sheet reset lever 180, after the passage of the rear edge of the uppermost sheet P1 fed by the sheet feed roller 121.

Consequently, the next sheet P2 is prevented from burrowing into the nipping section between the sheet feed roller 121 and the separation pad 150 without fail, thereby ensuring the separation of sheet.

(e) At this time, since the sheet reset lever 180 is reversely pivoted by reverse rotation of the sheet feed roller 121, the next sheet P2 is reliably, forcibly reset to its original position.

(f) The sheet feeder has the separation mechanism to bring the separation pad 150 out of contact with the idle roller 160 when the sheet reset lever 180 rearwardly pivots and forcibly resets the next sheet P2 to its original position in a rearward direction. Accordingly, the next sheet P2 can be smoothly, forcibly reset to its original position.

(g) The sheet reset lever 180 is designed to forcibly reset the next sheet P2 in such a way that the front edge P2*a* of the next sheet P2 reaches a position behind the support surface 152. Consequently, the front edge P2*a* of the next sheet P2 is supported by the support surface 152.

(h) The sheet feeder has the forcing means 200 that forces the sheet stacked on the hopper 180 toward the sheet support surface 130*a* of the hopper 130. By virtue of this means, the previously-described frictional force Fp developed in the flexure of the sheet P1 as a result of reverse feeding of the sheet P1 is increased, thereby rendering the next sheet (or a plurality of subsequent sheets) easy to be forcibly reset.

Further, if the next sheet P2 is completely reset to its original position, the thus-reset sheet P2 is placed on the hopper 130 by means of the forcing member 200. Accordingly, the front edge P2*a* of the next sheet P2 is definitely supported by the support surface 152.

Consequently, the entry of the next sheet P2 is prevented to a much greater extent without fail.

(i) The sheet feed roller 121 is designed to reversely rotate before performing one forward rotation, thereby rearwardly pivoting the sheet reset lever 180. Even if a sheet enters the nipping area between the sheet feed roller 121 and the separation pad 150 for any reasons before commencement of the sheet feeding operation, the thus-entered sheet can be returned to its original position without fail.

It is possible to prevent failures (such as failure to find the start of a sheet) which would otherwise be caused by performing the sheet feeding operation while a sheet is burrowed into the nipping area between the sheet feed roller 121 and the separation pad 150 for any reasons.

(j) The sheet feeder has the idle roller retraction mechanism which separates the idle roller 160 from the separation pad 150 when the front edge of the sheet P1 to be fed passes through the area between the separation pad 150 and the idle roller 160 (see FIG. 16), and which mechanism brings the idle roller 160 into contact with the separation pad 150 after the front edge of the sheet P1 has passed through the area while the circular-arch portion 121*a* of the sheet feed roller 121 still remains in contact with the separation pad 160 with the sheet between them (see FIG. 18). By virtue of this mechanism, the following advantageous results are obtained as a result of the operation of the sheet feeder.

Namely, if the idle roller 160 is forced toward and stays in contact with the separation pad 150 when the uppermost sheet P1 is fed by rotation of the sheet feed roller 121 at the time of the sheet feeding operation and the front edge of the sheet P1 passes through the nipping area between the circular-arch portion 121*a* of the sheet feed roller 121 and the separation pad 160, the idle roller 160 causes resistance to the sheet P1 that is in the course of passing.

In contrast, in accordance with the first embodiment, the sheet feeder is provided with the retraction mechanism to bring the idle roller 160 out of contact with the separation pad 150 when the front edge P1*a* of the sheet P1 to be fed passes through the area between the separation pad 150 and the idle roller 160. Therefore, the idle roller 160 is prevented from causing resistance to the sheet that is in the course of passing.

This retraction mechanism brings the idle roller 160 into contact with the separation pad 150 after the front edge of the sheet P1 has passed through the area between the separation pad 150 and the idle roller 160 while the circular-arch portion 121*a* of the sheet feed roller 121 still remains in contact with the separation pad 160 with the sheet between them. As a result, the next sheet P2 is prevented from being fed together with the uppermost sheet P1 after the circular-arch portion 121*a* of the sheet feed roller 121 has been disengaged from the separation pad 150.

(k) Since the idle roller retraction mechanism is fitted around the shaft 110 of the sheet feed roller 121 and is designed to be actuated by means of the cam 123 which rotates together with the shaft 110, the construction of this mechanism can be simplified. For example, in comparison with an idle roller retraction mechanism which is actuated by means of a solenoid, or the like, the mechanism can be simply built.

(1)The hopper 130 separates the sheet P stacked on the hopper 130 from the sheet feed roller 121 when the sheet reset lever 180 is rearwardly pivoted. The support surface 152 for supporting the front edge of the sheet stacked on the hopper 130 is provided on the front end of the hopper 130 in the direction in which a sheet is fed. The sheet reset lever 180 is designed so as to forcibly reset the second sheet P2 in such a way that the front edge P2*a* of the next sheet P2 is placed in a position behind the support surface 152. With such an arrangement, the front edge P2*a* of the thus-reset sheet P2 is supported by the support surface 152.

Consequently, the cumulative entry of subsequent sheets is prevented without fail (m) The sheet feeder has the forcing member 200 which serves as means for forcing the sheet P stacked on the hopper 130 toward the sheet support surface 130*a* of the hopper 180. Therefore, the thus-reset next sheet P2 is placed on the hopper 130 by means of the forcing member 200. As a result, the front edge of the thus-reset next sheet P2 is reliably supported by the support surface 152.

Consequently, the foregoing cumulative entry of the next sheet P2 is prevented without fail.

<Second Embodiment>

In terms of characteristics, the second embodiment is different from the first embodiment in that the sheet reset lever 180 is actuated in another way.

Figure 31:
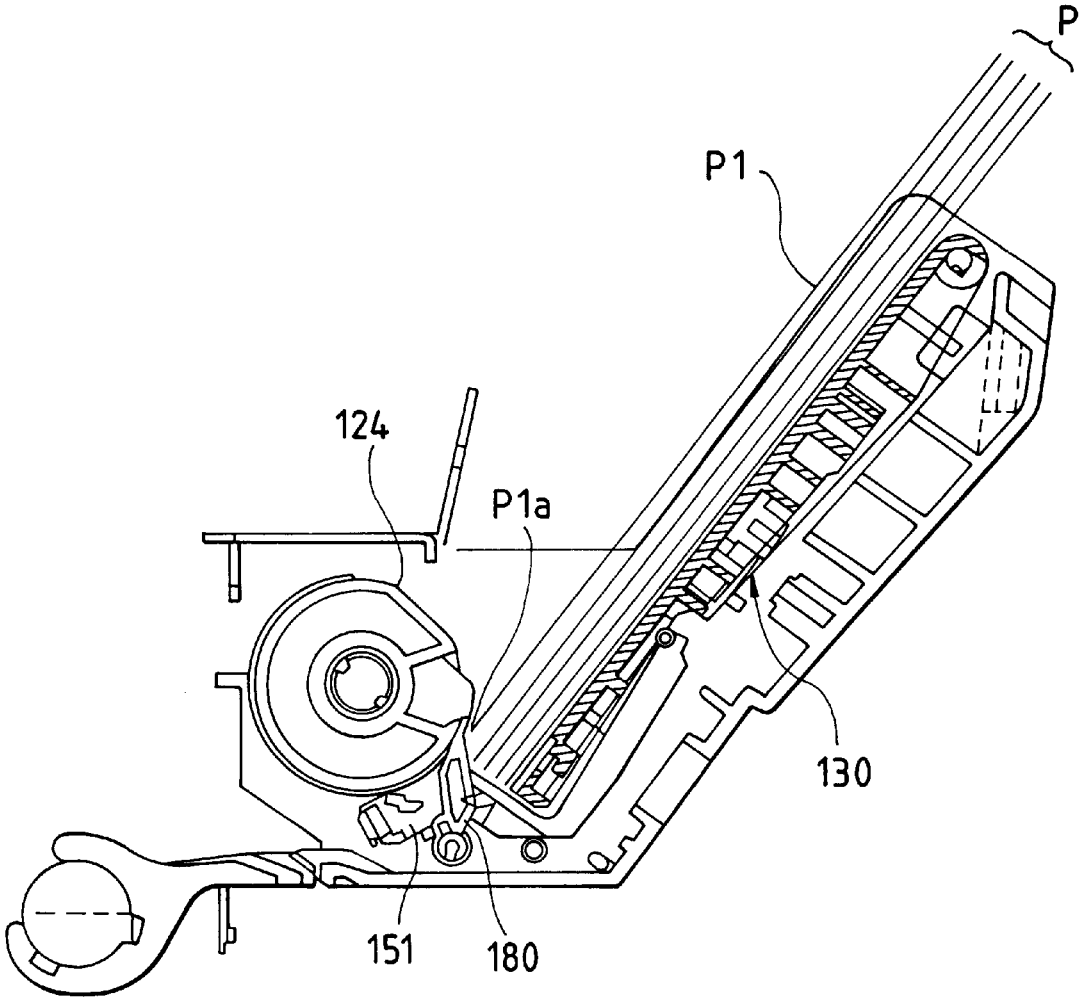

In accordance with the second embodiment, the sheet reset lever 180 is placed in the position where it closes clearance C1 (see FIGS. 8 and 31) formed between the sheet feed roller 121 and the separation pad 150 at the time of non-sheet-feeding operation, as viewed in the axial direction of the sheet feed roller 121. The disk 124 serving as the operation member is used to constitute pivotal-movement prevention means, and the forward pivotal movement of the sheet reset lever 180 is prevented by means of this disk 124.

More specifically, in accordance with the second embodiments taking the state of the sheet feeder shown in FIG. 3 (the standby condition in the first embodiment) as the reference state (i.e., the reference position for each member used as the reference for the execution of one sheet feeding operation), the state of the sheet feeder shown in FIG. 26 is taken as a standby condition (or a wait condition) of the sheet feeder. In other respects, the sheet reset lever performs in an analogous manner, as in the first embodiment, and hence its detailed explanations will be omitted. For precautionary purposes and the sake of clarity, an explanation will be primarily given of the difference in operation between the sheet feeder of the first embodiment and the sheet feeder of the second embodiment.

The state of the sheet feeder shown FIG. 3 is taken as the reference state.

In this reference state, the members are placed in their positions, as previously described.

As shown in FIG. 26, the standby condition of the sheet feeder is a state in which the sheet feed roller shaft 110 is rotated counterclockwise through a predetermined angle with reference to the reference state (see FIG. 3). In the course during which the sheet feeder changes from the reference state to the wait state, the members perform the same operations as those performed at the time of the foregoing sheet resetting operation, and hence the operations will be briefly explained.

As the sheet feed shaft 110 rotates counterclockwise (or reversely) with reference to the reference state (FIG. 3), the sheet feed roller 121, the bush 122, the hopper cam 185 are also reversely rotated.

As a result of the reverse rotation of the disk 124 integrally formed with the bush 122, the sheet reset lever 180 is forced by means of the angular portion 124*b* and pivots clockwise (or in a rearward direction). In this state (or the standby condition shown in FIG. 26), the sheet reset lever 180 is in the position where it closes the clearance C formed between the sheet feed roller 121 and the separation pad 150 (see FIG. 2), when viewed in the axial direction of the sheet feed roller 121. The sheet feed roller shaft 110 comes rest, and hence the rotation of the disk 124 is also stopped, thereby bringing the sheet reset lever 180 into contact with the disk 124. As a result, the forward (or counterclockwise in the drawing) pivotal movement of the sheet reset lever 180 is prevented In short, in accordance with the second embodiment, the disk 124 forms the pivotal-movement prevention means.

During the course of the reverse rotation of the sheet feed roller shaft 110, or the course of the counterclockwise rotation of the hopper cam 135, the hopper cam 135 is disengaged from the cam follower 134 of the hopper 130. Consequently, although the hopper 180 attempts to move upwardly at this point in time, the retaining lever 210 is pivoted clockwise as a result of the hopper cam 135 having been disengaged from the retaining lever 210 of the hopper retaining mechanism, so that the protuberance 213 of the retaining lever 210 is engaged with the recess 138 of the hopper 180. Therefore, the upward movement of the hopper 130 is inhibited, and the hopper 130 stays in a pressed state and in a position away from the sheet feed roller 121.

Accordingly, the sheet P can be readily loaded on the hopper 130 in the standby condition.

Provided that the sheet feeder is not provided with the sheet reset lever 180 or the sheet reset lever 180 is placed in another position differing from the position where the clearance C1 is closed, e.g., in a neutral position as shown in FIG. 3, when the sheet P is loaded, the following risk may arise.

For example, provided that sheet (e.g., A4-size sheet) having a comparatively large width is loaded on the hopper 130 and other sheet (e.g., B5-size sheet) having a comparatively narrower width is loaded in place of that sheet, there may be a case where the user loads the sheet after having adjusting the interval between the pair of sheet feed rollers 121, or the sheet feed roller units 120, 120' (see FIG. 1), by actuating the edge guide 131 in advance. There may also be a case where the sheet P is first loaded on the hopper 130, and the edge guide 131 (i.e., the sheet feed roller 121) is slid so as to adjust the interval between the sheet feed rollers 121 in accordance with the width of the sheet.

Figure 27:
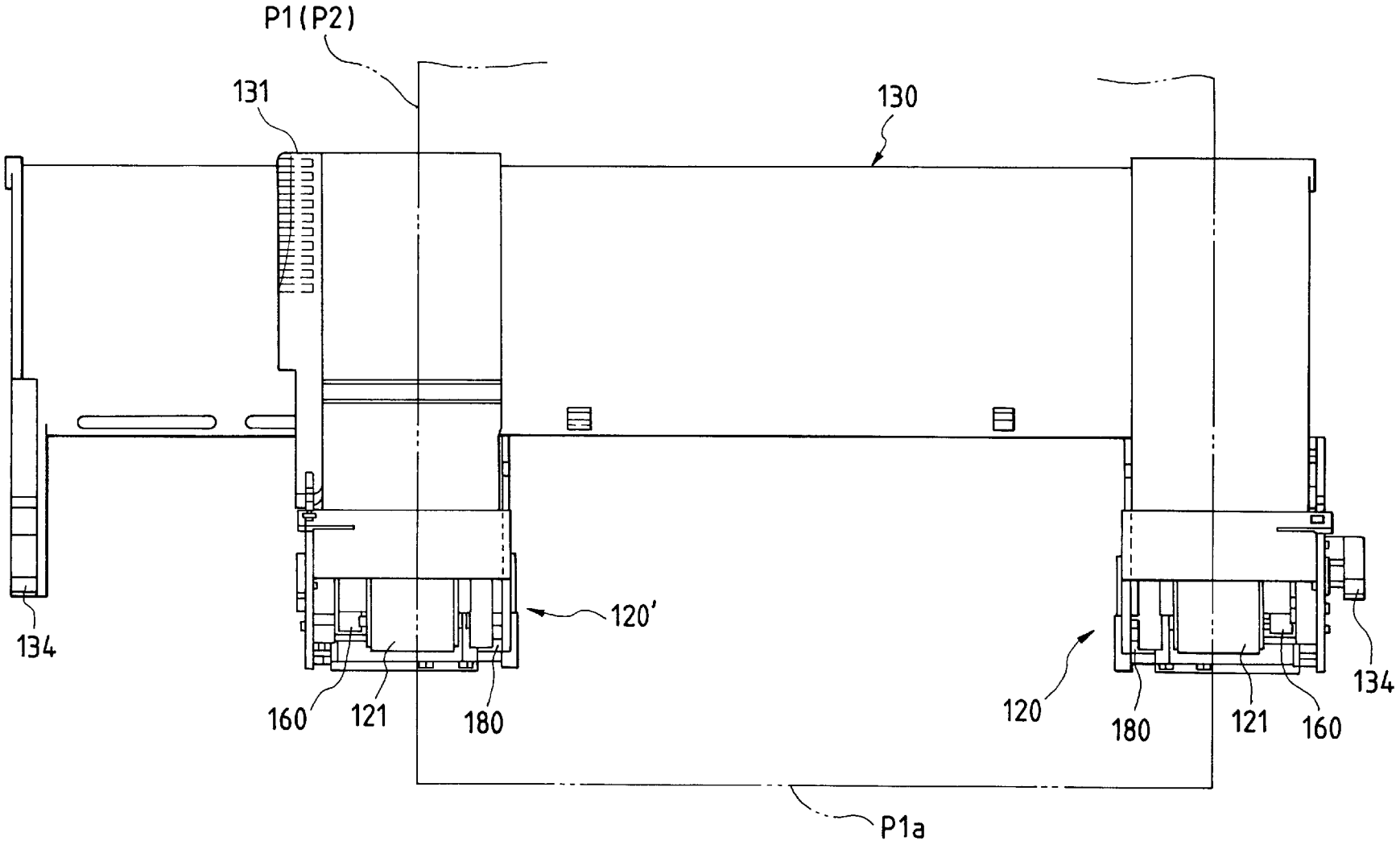

In the case where the user initially loads the sheet P on the hopper, the hopper 130 is kept away from the sheet feed roller 121, as previously described, and hence a risk may arise of the front edge of the uppermost sheet (e.g., the sheet P1, or the like, shown in FIG. 2) of the sheet P to be loaded burrowing into, e.g., the clearance C1, as shown in FIGS. 27 and 28. A reference numeral P1*a* shown in the drawings represents the front edge of the sheet.

If an attempt is made to slide the edge guide 131 and the sheet feed roller 121 in a rightward direction in FIG. 27 (or toward the counterpart sheet feed roller 121) in accordance with the width of the sheet, the front edge of the sheet P1 burrowed in the clearance C1 comes into contact with the side surface of the idle roller 160, thereby obstructing smooth sliding action of the edge guide 131 and the sheet feed roller 121. As a result, the sheet feed roller 121 may fail to slide to an optimum position. Alternatively, if the edge guide 131 and the sheet feed roller 121 are slid forcibly, the front edge of the sheet burrowed in the clearance C1 may be nipped between the pair of idle rollers 160, thereby rendering the sheet concertinated.

Figure 29:
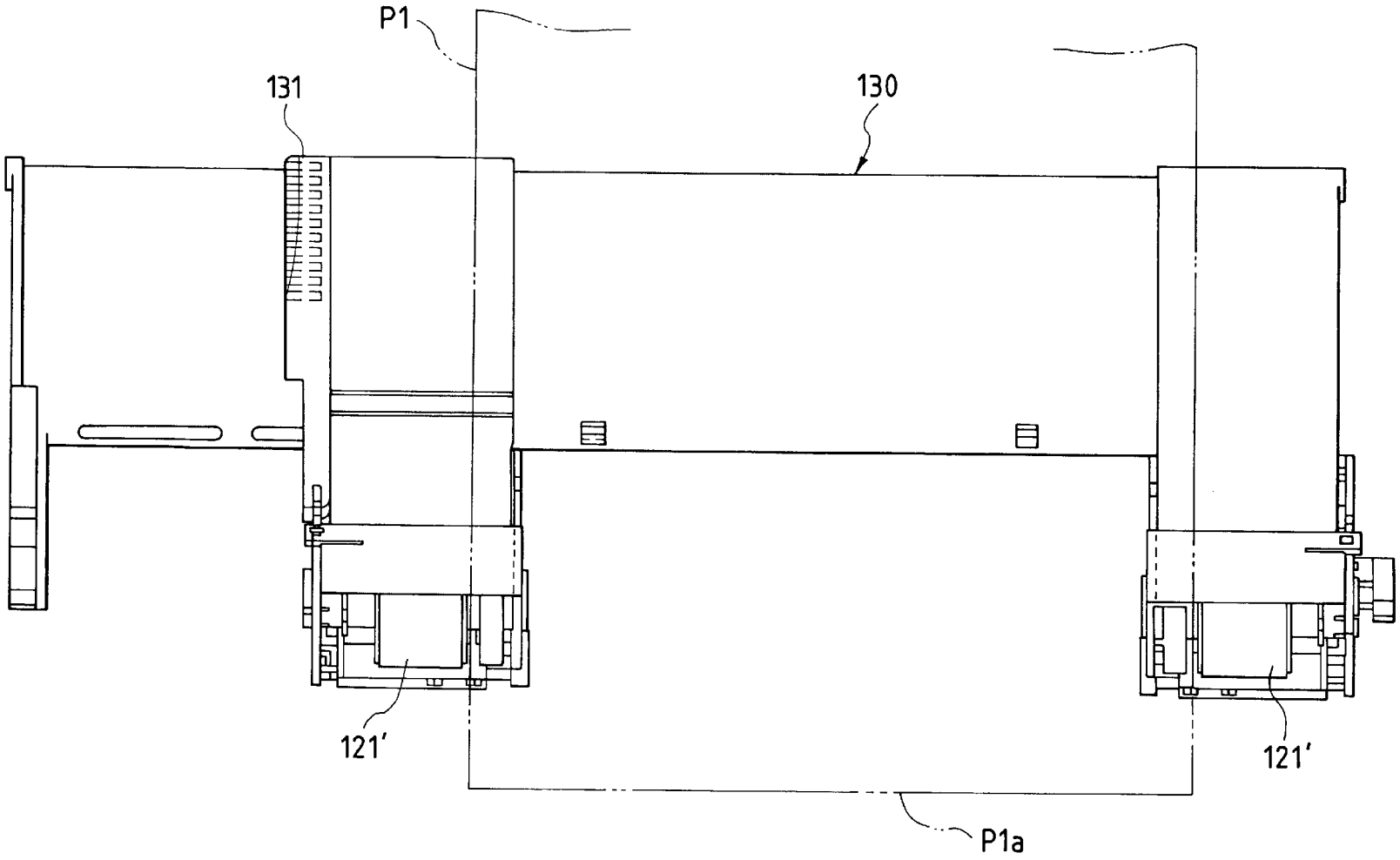
Figure 30:
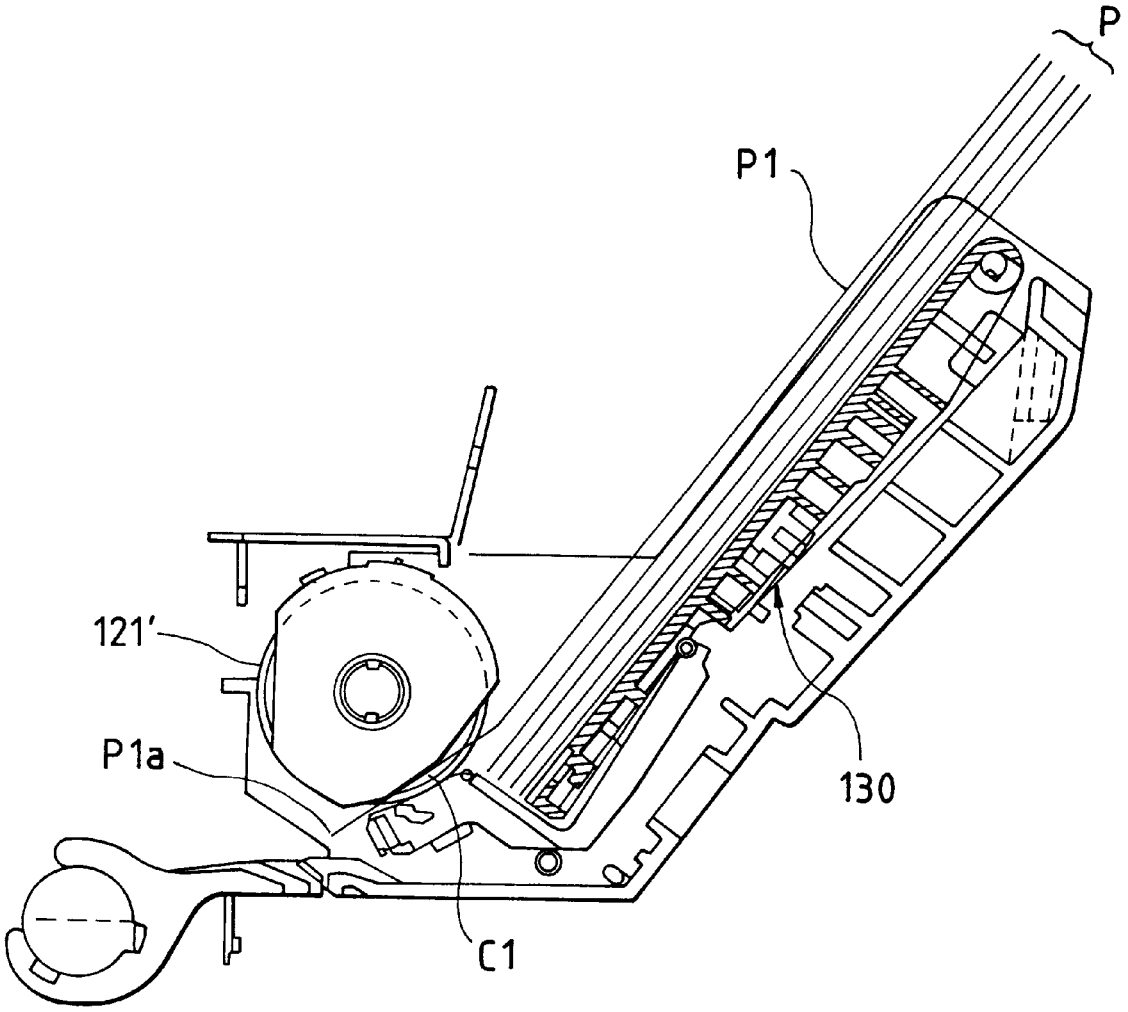

For example, as shown in FIGS. 29 and 30, a similar problem arises even in a case where the sheet feeder do not comprise the sheet feed rollers 121 having a lateral D-shaped cross section but sheet feed rollers 121' having a circular lateral cross section. In this case, if an attempt is made to slide the edge guide 131 and the sheet feed roller 121' in a rightward direction (or toward the counterpart sheet feed roller 121') in FIG. 29 in accordance with the width of the sheet, the front edge of the sheet P1 burrowed in the clearance C1 comes into contact with the side surface of the sheet feed roller 121', thereby obstructing the smooth sliding action of the edge guide 131 and the sheet feed roller 121'. As a result, the sheet feed roller 121' may fail to slide to an optimum position. Alternatively, if the edge guide 131 and the sheet feed roller 121' are slid forcibly, the front edge of the sheet burrowed in the clearance C1 may be nipped between the pair of sheet feed rollers 121', thereby rendering the sheet concertinated.

If the sheet feeding action is carried out in this state, sheet jams or oblique transfer of the sheet may arise.

In contrast, as previously described, the sheet reset lever 180 is placed in the position where it closes the clearance C1, and the disk 124 prevents the forward pivotal movement of the sheet reset lever 180 in the sheet feeder in accordance with the second embodiment. Therefore, the front edge of a sheet (e.g., P1) is prevented from burrowing into the clearance C1 without fail when the sheet P is loaded on the hopper (see FIG. 31).

The power of the printer or sheet feeder is first turned on, and it is placed in the foregoing standby condition by reversely rotating the sheet feed roller shaft 110 through a predetermined angle after having checked the reference state (or the reference position). Position detection means (not shown) provided at the end of the sheet feed roller shaft 110 can check the reference position. If the position detection means is in an ON state when the power is turned on, it means that the sheet feeder is in the reference position. If the position detection means is not in an ON state, the sheet feed roller shaft 110 is rotated until the position detection means is turned on, whereby the reference position is checked.

Even when the power of the printer or sheet feeder is turned off, the reference position is chewed in an analogous manner by actuation of the printer or sheet feeder for a given period of time by means of a delay circuit.

Further, the printer or sheet feeder is also placed into the standby condition by performing the sheet resetting operation which will be described later.

(i) If a print instruction sign is input to the printer from a host computer (not shown) in the previously-described standby condition (the state shown in FIG. 26), the sheet feed roller shaft 110 commences clockwise rotation (or forward rotation).

(ii) As a result of the forward rotation of the sheet feed roller shaft 110, the sheet feeder or printer enters the reference state shown in FIG. 3. The phase of the sheet feed roller shaft 110; i.e., the reference position, is then checked, and the sheet feed roller shaft 110 continues rotated clockwise further. Accordingly, the sheet feed roller 121, the bush 122, and the hopper cam 135 also continue rotating clockwise.

(iii) An operation similar to the operation in Step (iii) in the first embodiment is performed.

(iv) An operation similar to the operation in Step (iv) in the first embodiment is performed.

(v) An operation similar to the operation in Step (v) in the first embodiment is performed.

(vi) An operation similar to the operation in Step (vi) in the first embodiment is performed.

(vii) An operation similar to the operation in Step (vii) in the first embodiment is performed.

(ix) Sheet resetting operation is performed.

The sheet resetting operation is performed in the following manner.

(x-1) The sheet feed roller shaft 110 commences counterclockwise (reverse) rotation with reference to the previously-described reference position (see FIGS. 3 and 19). An operation similar to the operation in step (i-1) in the first embodiment will be performed.

(x-2) An operation similar to the operation in step (i-2) in the first embodiment will be performed.

(x-3) An operation similar to the operation in step (i-3) in the first embodiment will be performed. As a result, the sheet P2 is completely reset on (or placed on) the hopper 130. Here, at this time, the position to which the sheet reset lever 180 is pivoted (in a rearward direction) is the same position where the sheet reset lever 180 is placed in the foregoing standby condition (or the position shown in FIG. 26).

After the completion of the foregoing sheet resetting operation, the sheet feed roller shaft 110 forwardly rotates if there is still a print instruction signal. The sheet feeding operation defined in Step (ii) or subsequent steps is performed by way of the foregoing reference state (the state of the sheet feeder or printer shown in FIG. 3).

The following advantageous results will be obtained as a result of the operation of the foregoing sheet feeder.

(a) The sheet feeder comprises a pair of sheet feed rollers 121, 121 which forwardly rotate at the time of sheet feeding operation and feed a sheet P on contact with both side portions of the sheet; a hopper 130 which holds in a stacked manner a plurality of sheets P to be fed on contact with the circumferential surface 121*a* of each of the sheet feed rollers 121, which hopper 130 brings a sheet into pressed contact with the sheet feed rollers 121 when the sheet feed rollers 121 forwardly rotate; and separation pads 150 for separating the sheet P to be fed by the sheet feed rollers 121 from the next sheet by nipping the sheet P between the circumferential surfaces 121*a* of the sheet feed rollers 121 and the separation pads 150. With this configuration, the uppermost sheet P1 alone is fed at the time of the sheet feeding operation.

After passage of the rear edge of the uppermost sheet P1 fed by the sheet feed rollers 121, the sheet reset lever 180 rearwardly pivots, whereby the next sheet P2 is forcibly reset in such a way that the front edge of the next sheet P2*a* is placed in a position in a rearward direction in relation to the area where the circumferential surface of each of the sheet feed rollers comes into contact with the separation pad or the area (T) where they are to come into contact with each other. As a result, the subsequent sheet P2 is prevented from gradually (or cumulatively) entering the area (T) where the sheet feed roller 121 comes into contact with the separation pad 150, thereby ensuring the separation of sheet.

Further, since the hopper 130 is brought out of contact with the sheet feed roller 121 at least at the time of non-sheet-feeding operation, the sheet P can be readily loaded on the hopper 130 at the time of the non-sheet-feeding operation (e.g., in a standby condition). At least one of the pair of the sheet feed rollers 121, 121 (e.g., the sheet feed roller of the sheet feed roller at 120) is slidable in accordance with the width of the sheet P, enabling correct feeding of sheet of various sizes.

At the time of the non-sheet-feeding operation, the sheet reset lever 180 is placed in the position where it closes the clearance C formed between the sheet feed roller 121 and the separation pad 150, as viewed in the anal direction of the sheet feed roller 121, and the pivotal-movement prevention means 124 prevents the forward pivotal movement of the sheet reset lever 180. The front edge of a sheet is prevented from burrowing into the clearance C1 without fail when the sheet P is loaded.

The sheet feeder in accordance with the second embodiment enables the sheets of sheet to be reliably fed one by gone. Further, at least one of the sheet feed rollers is slidable in accordance with the width of the sheet, and the hopper 130 is brought out of contact with the sheet feed roller 121 at the time of the non-sheet-feeding operation (or in the standby condition). In spite of such a configuration, the sheet feeder prevents sheet jams or oblique transfer of sheet.

Since the front edge of the sheet P is prevented from burrowing into the clearance C1 without fail when the sheet P is loaded, failures (such as failure to find the start of a sheet) which would otherwise be caused by performing the sheet feeding operation while a sheet is burrowed into the nipping area between the sheet feed roller 121 and the separation pad 150 for any reasons.

(b) The sheet feed roller 121 comprises the circular-arch portion 121*a* and the linear portion 121*b* and has a substantially D-shaped lateral cross section. At the time of non-separation-operation, the separation pad 150 is positioned so as to become opposite to the linear portion 121*b* of the sheet feed roller 121 with an interval between the separation pad 150 and the sheet feed roller 121. The idle roller 160 that comes into contact with the separation pad 150 is provided outside the pair of sheet feed rollers 121, thereby preventing the sheet feed roller 121 from being constantly held in pressed contact with the separation pad 150 (see FIG. 3). Further, the degree of abrasion of the sheet feed roller 121 and the separation pad 150 is reduced, and the idle roller 160 prevents the next sheet P2 from burrowing into the area T together with the uppermost sheet P1 to a certain extent (see FIG. 19).

With the foregoing configuration, the clearance (see C1 shown in FIG. 2) is formed between the separation pad 150 and the sheet feed roller 121 at the time of non-sheet-feeding operation. Therefore, if no means are taken, the front edge of the sheet P can easily burrow into the interval or the clearance C1. In contrast, in the sheet feeder in accordance with the second embodiment, the sheet reset lever 180 is placed in the position where it closes the clearance C1 at the time of the non-sheet-feeding operation, and the pivotal-movement prevention means 124 prevents the forward pivotal movement of the sheet reset lever 180. As a result, when the sheet is loaded on the hopper, the front edge of a sheet is prevented from burrowing into the clearance C1 without fail If the pivotal movement of the sheet reset lever 180 is performed by means of one mechanism and the pivotal movement of the sheet feed roller 121 are performed by means of another mechanism, the sheet reset lever 180 can be placed in the position where it closes the clearance C1, and the pivotal-movement prevention means 124 can prevent the forward pivotal movement of the sheet reset lever 180 in the state where the linear portion 121*b* of the sheet feed roller 121 is opposite to the separation pad 150 (see FIG. 2).

(c) The hopper 130 supports the sheet P in an inclined state so is to slide toward the clearance C1. The footprint of the sheet feeder can be reduced by the area corresponding to the region occupied by the inclined hopper 180.

Thus, in a case where the sheet P is supported in such a way as to slide toward the clearance C1, if no means is taken, the front edge of the sheet can easily burrow into the clearance C1. In contrast, in the sheet feeder in accordance with the second embodiment, the sheet reset lever 180 is placed in the position where it closes the clearance C1 at the time of non-sheet-feeding operation, and the pivotal-movement prevention means 124 prevents the forward pivotal movement of the sheet reset lever 180. Therefore, when sheet is loaded on the hopper, the front edge of a sheet is prevented from burrowing into the clearance C1 without fail.

More specifically, the sheet feeder in accordance with the second embodiment have the advantage of reducing the required footprint.

(d) The sheet reset lever 180 is actuated by the disk 124 that rotates together with the sheet feed roller 121 and also serves as an operation member, and this disk 124 constitutes the pivotal-movement prevention means. Consequently, in comparison with a case where the pivotal-movement prevention means is provided separately from the operation member, the simplification of constitution of the sheet feeder and a reduction in the number of components can be accomplished.

(e) The position to which the sheet reset lever 180 is rearwardly pivoted (or the position to which the sheet reset lever 180 has finished pivoting) is the location where the sheet reset lever 180 closes the clearance C1. In comparison with a case where the rearward pivotal position and the closure position are individually set, the operation of the sheet reset lever 180 can be readily controlled.

There are obtained all the advantageous results resulting from the operation of the sheet feeder or printer in accordance with the first embodiment, as well as the foregoing advantageous results (a) to (e).

<Third Embodiment>

Figure 32:
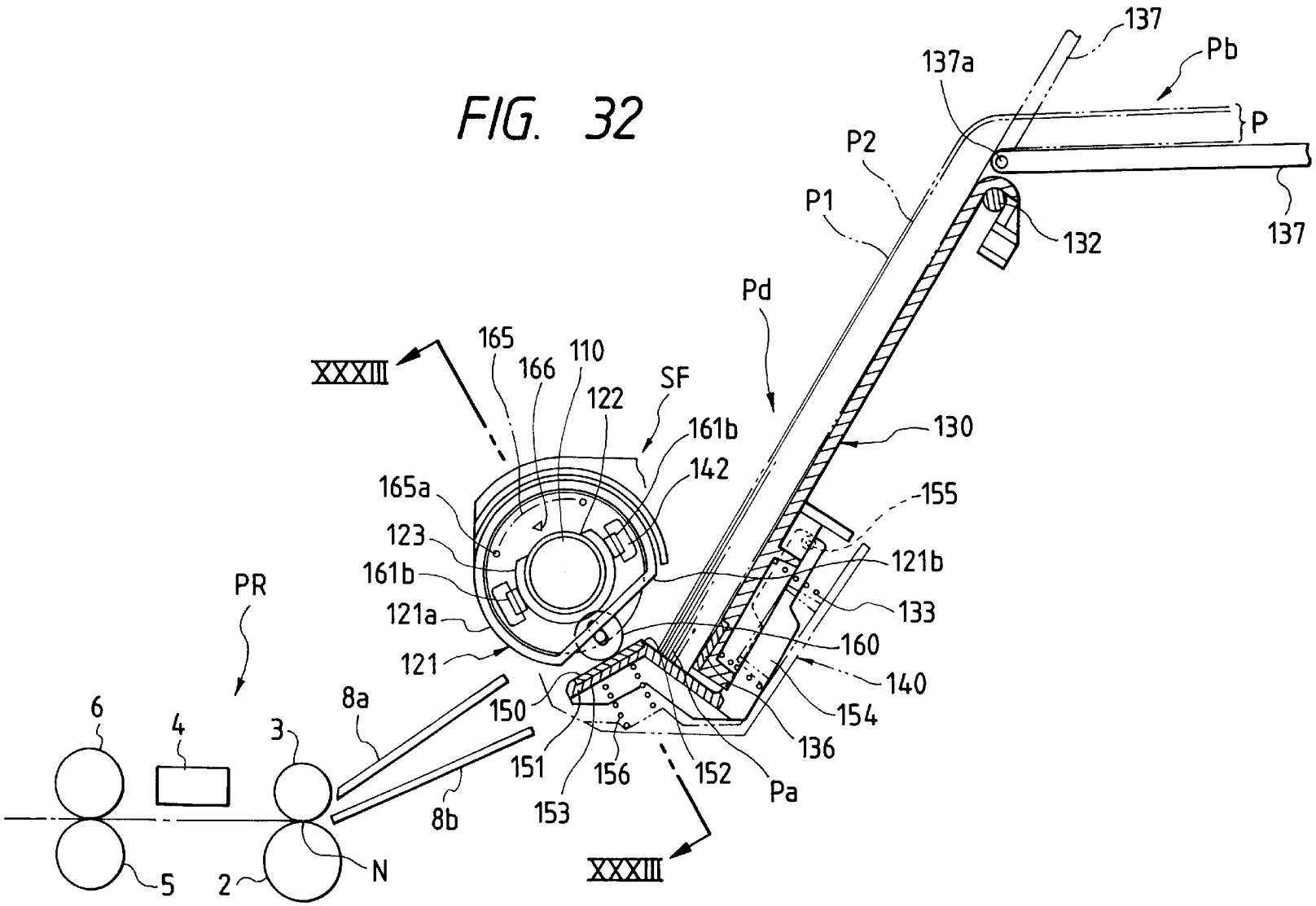
FIG. 32 is a partially cross sectional side view showing a printer which incorporates a sheet feeder in accordance with a third embodiment of the present invention.
Figure 33:
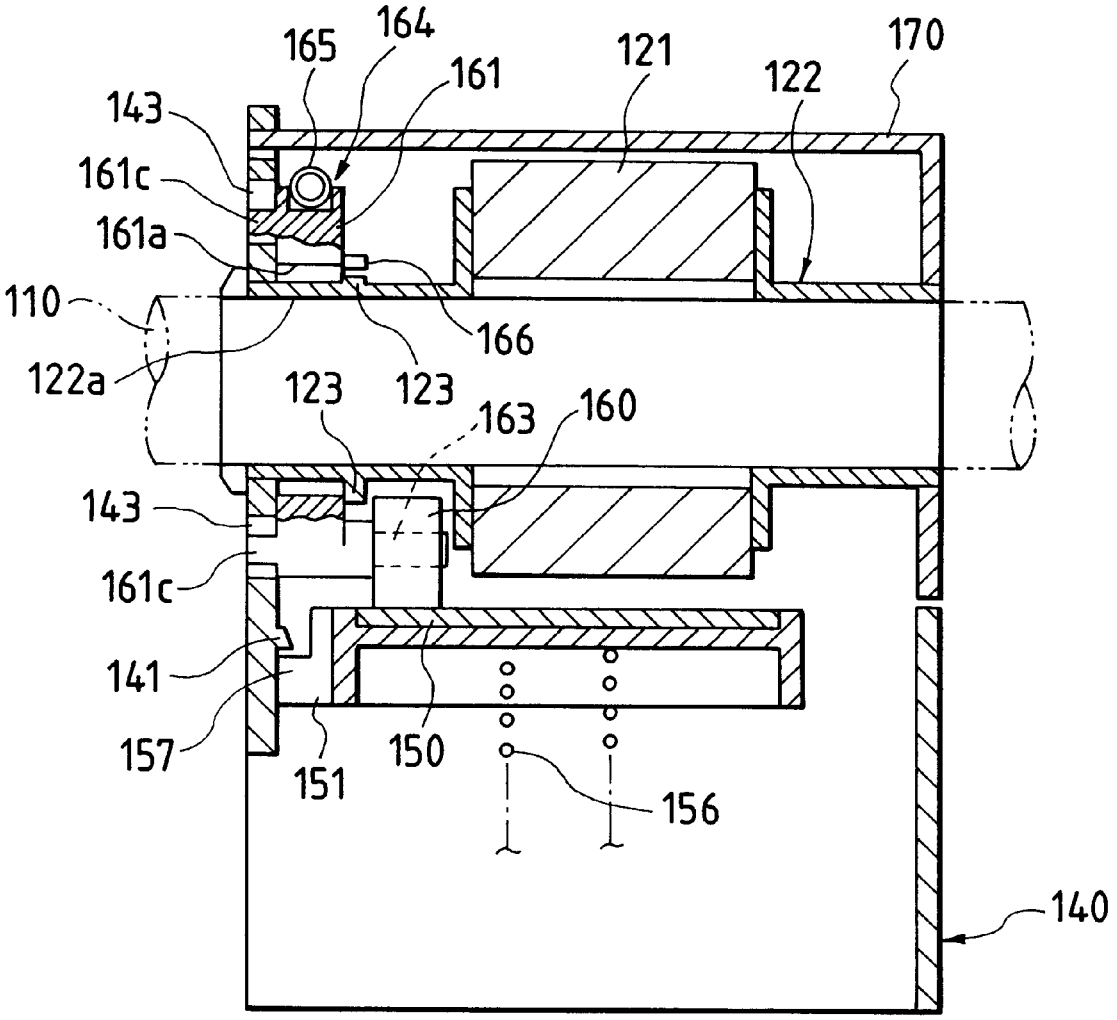
FIG. 33 is a cross sectional view of the sheet feeder taken across line XXXIII—XXXIII shown in FIG. 32.

FIG. 32 is a partially cross sectional side view showing a printer which incorporates a sheet feeder in accordance with a third embodiment of the present invention, and FIG. 33 is a cross sectional view of the sheet feeder taken across line XXXIII—XXXIII shown in FIG. 32.

In FIG. 32, reference symbol SF designates a sheet feeder, and PR designates a printer.

As shown in FIG. 32, the sheet feeder in accordance with the third embodiment has a support member 137 which is attached to a rear portion of the hopper 180 and is capable of supporting a rear portion Pb of the sheet P in a substantially horizontal position.

As apparent from FIG. 33, the sheet feeder in accordance with the third embodiment is different from that in the first embodiment in that the sheet feeder is not provided with the sheet reset lever 180. Accordingly, neither the disk 124 nor the separation lever 190 is provided on the bush 122. In other respects, the sheet feeder in the present embodiment is the same as that in the first embodiment. However, the sheet reset lever 180, the disk 124 of the bush 122, and the separation lever 190 can be or may be provided for the sheet feeder.

The support member 137 is attached to the unillustrated frame 100 (see FIG. 1) in a pivotable manner by means of the shaft 137*a*. This support member 137 can be switched between a substantially horizontal position designated by a solid line and an inclined position designated by a phantom line.

A plurality of sheets P are stacked on the hopper 130 and the support member 137. If the support member 137 is in the substantially horizontal position, as designated by the solid line shown in FIG. 32, a front portion Pd of the thus-loaded sheet P is supported in an inclined condition by means of the hopper 130, whereas a rear portion Pb of the same is supported in a substantially horizontal condition by means of the support member 137. The front edge Pa of the sheet is supported and aligned upon contact with the reverse surface (or the support source) of the separation pad holder 151.

The sheet feeder in accordance with the third embodiment performs principally the same operations as those performed by the sheet feeder in accordance with the first embodiment, except for the lack of the operation of the sheet reset lever 180, or the sheet resetting operation. The sheet feeder in accordance with the third embodiment is characterized by the act that the support member 137 provided on the rear portion of the hopper 130 is capable of supporting the rear portion Pb of the sheet P in a substantially horizontal condition. An explanation will be chiefly given of the operation of the support member 137.

The sheet P can be readily loaded on the hopper 130 and the support member 137 in a standby condition. As shown in FIG. 32, in a case where the support member 137 is in a horizontal position, the front portion Pd of the sheet P is supported in an inclined manner, and the rear portion Pb is supported in a substantially horizontal position.

The principal points of the sheet feeding operation are as follows:

As shown in FIG. 32, the sheet feed roller shaft 110 commences clockwise rotation. As shown in FIG. 14, when the hopper cam 135 is disengaged from the cam follower 134 of the hopper 130 as a result of the sheet feed roller shaft 110 rotating through a predetermined angle, the hopper 130 is momentarily raised, thereby bringing the uppermost sheet P1 into pressed contact with the circular-arch portion 121*a* of the sheet feed roller 121.

At this time, provided that the support member 137 is placed in an inclined position, as designated by a phantom line shown in FIG. 32, and the whole sheet is supported in an inclined condition, if the sheet P is slippery; e.g., a sheet for OHP purposes, a risk will arise of the sheet P sliding under its own weight. In contrast, as shown in FIG. 32, if the support member 137 is placed in a substantially horizontal position, the rear portion Pb of the sheet is supported in a substantially horizontal condition by means of the support member 137. Even if the sheet P is slippery, the sheet is prevented from sliding (or becomes difficult to slide) under its own weight.

The sheet feed roller shaft 110 continues rotating further. As shown in FIGS. 15 through 19, as a result of accurate one rotation of the sheet feed roller shaft 110, the uppermost sheet P1 alone is fed.

Provided that the support member 137 is placed in the inclined position as designated by the phantom line shown in FIG. 32 and the whole sheet is supported in an inclined condition, and that the sheet P is slippery; e.g., a sheet for OHP purposes, or the like, the sheet P is apt to cause an avalanche under its own weight in the course during which the sheet feeder changes from the state shown in FIG. 14 to the state shown in FIG. 19 and hence is apt to burrow into the nipping area between the sheet feed roller 121 and the separation pad 160. In contrast, as shown in FIG. 32, if the support member 137 stays in the substantially horizontal position, the rear portion Pb of the sheet is supported in a substantially horizontal condition. Accordingly, even if the sheet P is slippery, the sheet will not slide (or is difficult to slide) under its own weight.

Therefore, the sheet feeder in accordance with the third embodiment yields the following advantageous results.

(a) The sheet feeder comprises the sheet feed roller 121 which rotates at the time of sheet feeding operation; the hopper 130 which brings the sheet P against the sheet feed roller 121 when the sheet feed roller 121 is in rotation; and the separation pad 150 which is forced toward the sheet feed roller 121 by means of the pad forcing means 156 and separates from the next sheet P2 the uppermost sheet P1 to be fed by means of the sheet feed roller 121 by nipping the sheet between the sheet feed roller 121 and the separation pad 150. With this arrangement, the uppermost sheet P1 alone is fed at the time of the sheet feeding operation.

Since the hopper 180 supports the front portion Pd of the sheet P in an inclined state, the footprint can be reduced by the area corresponding to the region occupied by the inclined hopper can be reduced.

Provided that the overall sheet is supported in an inclined state and the sheet P is slippery; e.g., a sheet for OHP purposes, or the like, the sheet is apt to slide under its own weight. As shown in FIGS. 14 to 19, the sheet is easy to cause an avalanche in the course during which the sheet feeder changes from the state shown in FIG. 14 to the state shown in FIG. 19. As a result, the sheet becomes very likely to burrow into the nipping section between the sheet feed roller 121 and the separation pad 150. However, in the sheet feeder in accordance with the third embodiment, since the support member 137 provided in the rear portion of the hopper supports the rear portion Pb of the sheet P in a substantially horizontal state, the sheet P is prevented from sliding or becomes less likely to slide under its own weight.

Consequently, in accordance with the sheet feeder, the need for increasing the urging force of the separation pad 160 (or the compressing force of the spring 156) in order to prevent an avalanche is eliminated. For these reasons, it is possible to prevent an increase in the drive force required for the sheet feed roller 121 and the pair of conveyor rollers 2, 3, or the like, as well as an increase in the previously-described load (or back tension) exerted on the sheet during the course of transfer.

More specifically, the sheet feeder enables sheets of the sheet P to be reliably fed one by one without increasing the drive force or load through use of a separation pad method, and the footprint required for the sheet feeder can be reduced.

(b) The support member 137 is pivotable and capable of supporting the rear portion of the sheet in an inclined state as designated by the phantom line shown in FIG. 32. In a case where the sheet P is less slippery; e.g., plain sheet, or the like, the support member 137 is pivoted so as to support the rear portion of the sheet in an inclined position. In other words, the whole sheet is supported in an inclined position, thereby enabling a reduction in the footprint of the sheet feeder to a much greater extent.

(c) The sheet feed roller 121 comprises the circular-arch portion 121*a* and the linear portion 121*b* and has a substantially D-shaped lateral cross section. Further, the support member 137 is placed in an inclined position as designated by the phantom line shown in FIG. 32. Consequently, in a case where the overall sheet is supported in an inclined state, the circular-arch portion 121*a* is brought out of pressed contact with the separation pad 150 during the course of one rotation of the sheet feed roller 121, and the linear portion 121*b* is opposite to the separation pad 150. In short, if the nipping section disappears, the next sheet P2 may move downwardly. However, in such a case, the idle roller 160 comes into contact with the separation pad 150, thereby inhibiting the downward movement of the next sheet P2. As a result, the downward movement of the next sheet P2 is prevented (see FIG. 19).

Further, the advantageous results (c) and (j) yielded by the sheet feeder in accordance with the first embodiment are also obtained.

Although the present invention has been described with reference to its embodiments, the invention is not limited to them. Various modifications of the present invention are conceivable, as required, within the scope of the invention.

For instance, although the support member 137 is pivotable in the third embodiment, this support member may be formed from two individual members which can be attached to or detached from a frame or a hopper; namely, a support member which supports the rear portion Pb of the sheet in a substantially horizontal position, and another support member which supports the rear portion Pb of the sheet in an inclined position. One of these two support members may be attached to the frame or hopper.

What is claimed is:

1. A sheet feeder comprising:

a sheet feed roller which is forwardly rotatable at time of a sheet feeding operation and feeds an uppermost sheet retained in a stacked state in contact with said sheet feed roller;

a separation pad which separates the uppermost sheet to be sent by the sheet feed roller from a next sheet by nipping the uppermost sheet between the sheet feed roller and the separation pad; and a forcing mechanism for forcing said separation pad toward said sheet roller;

a sheet reset lever which is rearwardly pivotable so as to forcibly reset the next sheet in a rearward direction such that the front edge of the next sheet is placed in a location in a rearward direction in relation to the area where the sheet feed rollers come into contact with the separation pads, after the passage of the rear edge of the uppermost sheet fed by the sheet feed roller, wherein the sheet feed roller rearwardly pivots the sheet reset lever as a result of reverse rotation of the sheet feed roller.

2. The sheet feeder according to claim 1, wherein the sheet feed roller is arranged so that when the sheet feed roller is temporarily rotated reversely before being forwardly rotated, the sheet reset lever is rearwardly pivoted by the sheet feed roller.

3. The sheet feeder according to claim 1, further including a hopper for holding a plurality of sheets in an inclined, stacked state so as to be able to slide toward an area where the sheet feed roller is in contact with the separation pad.

4. A sheet feeder comprising:

a sheet feed rollers having a circular-arch portion, a linear portion, and a substantially D-shaped lateral cross section;

a hopper which holds in a stacked manner a plurality of sheets to be fed on contact with the circular-arch portions of the sheet feed roller, and which hopper brings a sheet into pressed contact with the sheet feed roller when the sheet feed roller forwardly rotates;

a separation pad is positioned on a rotation locus of the circular-arch portion of the sheet feed roller and forced toward the sheet feed roller by pad forcing means, and which separation pad separates the sheet to be fed by the sheet feed roller from the next sheet by nipping the sheet between the circular-arch portions and the separation pad;

an idle roller which is forced toward the separation pad by roller forcing means for producing an urging force smaller than that produced by the pad forcing means, and comes into contact with the separation pad so as to prevent lowering of the next sheet from the hopper at least when the sheet is not nipped between the separation pad and the circular-arch portions of the sheet feed roller;

pad regulation means which differ from the idle roller and regulate the movement of the separation pad toward the sheet feed roller when the sheet is not nipped between the separation pad and the circular-arch portion of the sheet feed roller; and a sheet reset lever which is rearwardly pivoted so as to forcibly reset the next sheet in a rearward direction such that the front edge of the next sheet is placed in a position in relation to the area where the sheet feed roller comes into contact with the separation pad, after the passage of the rear edge of the uppermost sheet fed by the sheet feed roller.

5. The sheet feeder according to claim 4, further comprising:

a separation mechanism for separating the separation pads from the idle roller when the sheet reset lever is rearwardly pivoted so as to forcibly reset the next sheet in a rearward direction.

6. The sheet feeder according to claim 4, wherein the hopper separates the sheet stacked on the hopper from the sheet feed roller when the sheet reset lever is rearwardly pivoted; a support surface for supporting the front edge of the sheet stacked on the hopper is provided at the front end of the hopper in the sheet-feeding direction; and the sheet reset lever forcibly resets the next sheet such that the front edge of the next sheet reaches a position behind the support surface.

7. The sheet feeder according to claim 6, further comprising:

a forcing member for forcing the sheet stacked on the hopper toward the support surface of the hopper.

8. The sheet feeder according to claim 4, wherein the sheet feed roller is temporarily rotated reversely before performing one forward rotation, thereby rearwardly pivoting the sheet reset lever.

9. The sheet feeder according to claim 4 further comprising:

an idle roller retraction mechanism which separates the idle roller from the separation pad when the front edge of the sheet to be fed passes through a clearance between the separation pad and the idle roller, and which mechanism brings the idle roller into contact with the separation pads after the front edge of the sheet has passed through the clearance while the circular-arch portion of the sheet feed roller still remains in contact with the separation pad with the sheet between them.

10. The sheet feeder according to claim 9, wherein the idle roller retraction mechanism is actuated by a cam which is fitted around a shaft of the sheet feed roller and rotate together with the shaft.

11. A sheet feeder comprising:

a pair of sheet feed rollers which are forwardly rotatable at time of a sheet feeding operation and feed a sheet on contact with both side portions of the sheet, wherein at least one of the pair of sheet feed rollers being slidable in accordance with the width of the sheet;

a hopper which holds in a stacked manner a plurality of sheets to be fed on contact with the circumferential surface of each of the sheet feed rollers, brings a sheet into pressed contact with the sheet feed rollers when the sheet feed rollers forwardly rotate, and is separated from the sheet feed rollers at least at time of a non-sheet-feeding operation;

separation pads for separating the sheet to be fed by the sheet feed rollers from the next sheet by nipping the sheet between the circumferential surfaces of the sheet feed rollers and the separation pads;

a sheet reset lever which is rearwardly pivoted so as to forcibly reset the next sheet in a rearward direction in such a way that the front edge of the next sheet is placed in a position in a rearward direction in relation to the area where the circumferential surface of each of the sheet feed rollers comes into contact with the separation pad or the area where they are to come into contact with each other, after the passage of the rear edge of the uppermost sheet fed by the sheet feed rollers; and pivotal-movement prevention means which places the sheet reset lever in a location where the clearance between the sheet feed rollers and the separation pads, as viewed in the axial direction of the sheet feed rollers, is closed, and which pivotal-movement prevention means prevents the forward pivotal movement of the sheet reset lever.

12. The sheet feeder according to claim 11, wherein each of the sheet feed rollers comprises a circular-arch portion and a linear portion and has a substantially D-shaped lateral cross section;

each of the separation pads is opposite to the linear portion of the sheet feed roller and maintains the clearance between the sheet feed roller and the separation pad at the time of non-separation operation; and idle rollers are provided outside the pair of sheet feed rollers in an axial direction of said sheet feed rollers and come into contact with the separation pads.

13. The sheet feeder according to claim 12, further comprising:

a separation mechanism which separates the separation pads from the idle rollers when the sheet reset lever is rearwardly pivoted so as to forcibly reset the next sheet in a rearward direction.

14. The sheet feeder according to claim 12, further comprising:

an idle roller retraction mechanism which separates the idle rollers from the separation pads when the front edge of the sheet to be fed passes through the clearance between the separation pads and the idle rollers, and brings the idle rollers into contact with the separation pads after the front edge of the sheet has passed through the clearance while the circular-arch portions of the sheet feed rollers still remain in contact with the separation pads with the sheet between them.

15. The sheet feeder according to claim 11, wherein the hopper supports the sheet in an inclined state toward the clearance.

16. The sheet feeder according to claim 11, wherein the sheet reset lever is actuated by operation members which are pivoted together with the sheet drive rollers and constitute the pivotal-movement prevention means.

17. The sheet feeder according to claim 11, wherein the hopper separates the sheet stacked on the hopper from the sheet feed rollers when the sheet reset lever is rearwardly pivoted;

a support surface for supporting the front edge of the sheet stacked on the hopper is provided at the front end of the hopper in the sheet-feeding direction;

the sheet reset lever forcibly resets the next sheet such that the front edge of the next sheet reaches a position behind the support surface; and the position behind the support surface is a location where the clearance between the sheet feed rollers and the separation pads is closed.

18. The sheet feeder according to claim 17, further comprising:

a forcing member for forcing the sheet stacked on the hopper toward the support surface of the hopper.

19. The sheet feeder according to claim 14, wherein the idle roller retraction mechanism is actuated by cams which are fitted around the shafts of the sheet fed rollers and rotate together with these shafts.

20. A sheet feeder comprising:

a sheet feed roller which is rotatable during a sheet feeding operation;

a hopper which holds in a stacked manner a plurality of sheets to be fed on contact with a circumferential surface of the sheet feed roller and brings a sheet into pressed contact with the sheet feed roller when the sheet feed roller forwardly rotates;

a separation pad for separating a sheet to be fed by the sheet feed roller from a next sheet by nipping the sheet between the circumferential surface of the sheet feed roller and the separation pad; and an idle roller which is forced toward the separation pad and comes into contact with the separation pad so as to prevent lowering of the next sheet from the hopper when the next sheet is not nipped between the separation pad and the sheet feed roller, wherein the hopper supports a front portion of the sheets in an inclined state and has at a rear portion thereof a support member for supporting the rear portion of the sheets in a substantially horizontal state.

21. The sheet feeder according to claim 20, wherein the support member is pivotable and capable of supporting the rear portion of the sheet in an inclined state.

22. A printer comprising:

a sheet feed roller which has a circular-arch portion, a linear portion, and a substantially D-shaped lateral cross section;

a hopper which holds in a stacked manner a plurality of sheets to be fed on contact with the circular-arch portion of the sheet feed roller, and brings a sheet into pressed contact with the sheet feed roller when the sheet feed roller forwardly rotate;

a support surface for supporting the front edge of the sheet stacked on the hopper;

a separation pad which is positioned on a rotation locus of the circular-arch portion of the sheet feed roller and forced toward the sheet feed roller by pad forcing means, and separates the sheet to be fed by the sheet feed rollers from the next sheet by nipping the sheet between the circular-arch portion and the separation pad;

a idle roller which comes into contact with the separation pad when the sheet is not nipped between the separation pad and the circular-arch portion of the sheet feed roller; and a conveyor roller for carrying the sheet fed from the sheet feed roller, wherein the conveyor roller which reversely carries the sheet at least over the distance between the support surface on the course of transmission of the sheet and the area where the separation pad comes into contact with the idle roller, by being reversely rotated after having carried the front edge of the sheet over the distance or more.

23. The printer according to claim 22, further comprising:

a sheet reset lever which is rearwardly pivoted so as to forcibly reset the next sheet in a rearward direction in such a way that the front edge of the next sheet in placed in a position in a rearward direction in relation to the area where the front edge of the next sheet comes into contact with the separation pad, after the passage of the rear edge of the uppermost sheet fed by the sheet feed roller.

24. The printer according to claim 23, fisher comprising:

a separation mechanism which separates the separation pads from the idle roller when the sheet reset lever is rearwardly pivoted so as to forcibly reset the next sheet in a rearward direction.

25. The printer according to claim 23, wherein the sheet reset lever forcibly resets the next sheet in a rearward direction in such a way that the front edge of the next sheet reaches a location behind the support surface.

26. The printer according to claim 23, wherein the sheet feed rollers are temporarily rotated reversely before performing one forward rotation, thereby reversely pivoting the sheet reset lever.

27. The printer according to claim 22, further comprising:

a forcing member which forces the sheet stacked on the hopper toward the support surface of the hopper.

28. The printer according to claim 22, further comprising an idle roller retraction mechanism which separates the idle roller from the separation pad when the front edge of the sheet to be fed passes through a clearance between the separation pads and the idle roller, and brings the idle roller into contact with the separation pad after the front edge of the sheet has passed through the clearance while the circular-arch portion of the sheet feed roller still remains in contact with the separation pad with the sheet between them.

29. The printer according to claim 28, wherein the idle roller retraction mechanism is actuated by cams which are fitted around shaft of the sheet feed roller and rotate together with these shaft.

* * * * *